US010096275B2

(12) United States Patent
Masumura et al.

(10) Patent No.: US 10,096,275 B2
(45) Date of Patent: Oct. 9, 2018

(54) DISPLAY APPARATUS AND METHOD OF PROCESSING AN IMAGE SIGNAL INPUT TO A DISPLAY PANEL

(71) Applicant: NLT TECHNOLOGIES, LTD., Kawasaki, Kanagawa (JP)

(72) Inventors: Kazunori Masumura, Kanagawa (JP); Koji Shigemura, Kanagawa (JP); Tetsushi Sato, Kanagawa (JP)

(73) Assignee: NLT TECHNOLOGIES, LTD., Kawasaki, Kanagawa (JP)

( * ) Notice: Subject to any disclaimer, the term of this patent is extended or adjusted under 35 U.S.C. 154(b) by 8 days.

(21) Appl. No.: 15/226,234

(22) Filed: Aug. 2, 2016

(65) Prior Publication Data

US 2017/0039927 A1 Feb. 9, 2017

(30) Foreign Application Priority Data

Aug. 5, 2015 (JP) ..... 2015-155409
Apr. 13, 2016 (JP) ..... 2016-080375

(51) Int. Cl.
*G09G 3/20* (2006.01)
*G09G 5/02* (2006.01)

(52) U.S. Cl.
CPC ..... *G09G 3/2018* (2013.01); *G09G 5/02* (2013.01); *G09G 2310/08* (2013.01); *G09G 2330/025* (2013.01); *G09G 2370/08* (2013.01)

(58) Field of Classification Search
CPC .... G02B 27/2214; G02B 27/26; G02B 27/22; G02B 27/2264; G02B 27/225; G02B 27/2228; G02B 27/0093; G02B 27/2235; H04N 13/0404; H04N 13/0497; H04N 13/0409; H04N 13/0438; H04N 13/0434; H04N 13/0422; H04N 13/0454; H04N 13/0468; H04N 13/0022; H04N 13/0402; H04N 13/0415; H04N 13/0452; H04N 13/0477; H04N 13/0447; H04N 13/044; H04N 13/0459; H04N 13/04; H04N 13/0418; H04N 13/0425; H04N 2213/001; H04N 13/0484; H04N 13/0018;
(Continued)

(56) References Cited

U.S. PATENT DOCUMENTS 6,266,039 B1 * 7/2001 Aoki ..... G09G 3/3611 345/94
6,320,572 B1 11/2001 Takabayashi et al.
(Continued)

FOREIGN PATENT DOCUMENTS

JP 6-289822 A 10/1994
JP 11-249622 A 9/1999
JP 3993297 B2 10/2007

*Primary Examiner* — Koosha Sharifi-Tafreshi
(74) *Attorney, Agent, or Firm* — Sughrue Mion, PLLC

(57) ABSTRACT

An example of display apparatus includes: a display panel in which unit pixels each constituted by at least a first subpixel displaying a first pattern and a second subpixel displaying a second pattern are alternately arranged in a row or column direction; and a signal processing unit modulating, for image data including the first pattern and image data including the second pattern, a difference in maximum gradation values in the image data, and controlling synchronization or non-synchronization of a rise or fall between bit signals of a coupled image signal input to the display panel.

16 Claims, 44 Drawing Sheets

(58) Field of Classification Search
CPC ..... H04N 13/0413; H04N 13/0456; H04N 13/0239; H04N 13/0411; H04N 13/0445; H04N 13/0443; H04N 13/0475; H04N 13/047; H04N 13/0055; H04N 13/0495; H04N 2213/008; H04N 13/0486; H04N 13/0037; H04N 13/0059; H04N 13/042; H04N 2013/0081; G09G 3/003; G09G 2320/0209
See application file for complete search history.

(56) References Cited

U.S. PATENT DOCUMENTS

| | | | | |
|---|---|---|---|---|
| 6,980,192 | B1 | 12/2005 | Matsumura et al. | |
| 2003/0112257 | A1* | 6/2003 | Tamura | G09G 3/20 345/690 |
| 2011/0157161 | A1* | 6/2011 | Choi | G09G 3/003 345/419 |

* cited by examiner

FIG. 14

| | D1 | D2 | D3 | D4 | D5 |
|---|---|---|---|---|---|
| G1 | Null | 1L | Null | 2L | Null |
| G2 | 3R | 1R | 4R | 2R | Null |
| G3 | Null | 5L | 3L | 6L | 4L |
| G4 | 7R | 5R | 8R | 6R | Null |
| G5 | Null | Null | 7L | Null | 8L |

| | STATE OF DB AND GND, LEFT BLACK/RIGHT WHITE | LEFT BLACK/ RIGHT WHITE RATE OF VARIATION IN NEGATIVE POWER SUPPLY | VARIATION RATE OF LUMINANCE PROFILE |
|---|---|---|---|
| (1) |   | 2 % | 20% |
| (2) |   | 0.06 % | 8% |
| (3) |   | 0.04 % | |

FIG. 22

| | IMAGE | BACKGROUND IMAGE | | OBJECT IMAGE | |
|---|---|---|---|---|---|
| | | LEFT-EYE | RIGHT-EYE | LEFT-EYE | RIGHT-EYE |
| (a) | | 255/255 (100%) | 255/255 (100%) | NOTHING | NOTHING |
| (b) | | 0/255 (100%) | 255/255 (100%) | NOTHING | NOTHING |
| (c) | | 100/255 (100%) | 255/255 (100%) | NOTHING | NOTHING |
| (d) | | 255/255 (100%) | 255/255 (100%) | 0/255 (25%) | 0/255 (25%) |
| (e) | | 255/255 (100%) | 255/255 (100%) | 100/255 (25%) | 100/255 (25%) |
| (f) | | 255/255 (100%) | 255/255 (100%) | 0/255 (10%) | 0/255 (10%) |

DISPLAY APPARATUS AND METHOD OF PROCESSING AN IMAGE SIGNAL INPUT TO A DISPLAY PANEL

CROSS-REFERENCE TO RELATED APPLICATIONS

This non-provisional application claims priority under 35 U.S.C. § 119(a) on Patent Application No. 2015-155409 filed in Japan on Aug. 5, 2015, and Patent Application No. 2016-080375 filed in Japan on Apr. 13, 2016, the entire contents of which are hereby incorporated by reference.

FIELD

The present disclosure relates to a display apparatus having multiple pixels and a processing method, and more particularly to a method of transmitting display data from a signal processing unit in the display apparatus to a display panel.

BACKGROUND

In recent years, as the technology for computers, cameras, image processing and so forth have made progress, a high sense of reality is required for a display apparatus. For a display apparatus achieving a high sense of reality, a stereoscopic display apparatus providing an observer's right and left eyes with parallax images or a display apparatus on which a superfine image of 4K or 8K is displayed has been developed.

While the stereoscopic display apparatus includes an eyeglass type employing special eyeglasses and a naked-eye type requiring no eyeglasses as a technique for sending different images, respectively, to the right and left eyes of an observer, the development of the naked-eye type has been expected in terms of the burden of wearing eyeglasses.

Generally, in the stereoscopic display apparatus of the naked-eye type, a unit pixel for displaying a viewpoint image for the left eye and the right eye on a display panel is provided, to sort corresponding images to the right and left eyes of an observer by an optical member such as lenticular lens or parallax barrier. This requires unit pixels constituting viewpoint images by the number corresponding to the number of viewpoints, and an even larger number of pixels (the number of pixels in a regular display×the number of viewpoints) is required for stereoscopic display with an image quality having the smoothness and resolution of an image equal to that in a regular (two-dimensional) display, in order to achieve an increased sense of reality.

However, the increase in the number of pixels in a display panel causes the increase in the amount of display data to be sent from the signal processing unit in the display apparatus to the display panel, which further increases the transfer frequency of display data and the frequency of clock signals. As the frequency is higher, data signals and clock signals have larger distortion, causing a problem of degrading in the display quality and increasing in the power consumption by a driver IC due to the ground (GND) being unstable. Moreover, if display data signals in a data bus are changed at the same timing, the power line is significantly affected, which will cause noise in a driver circuit, deteriorating the display quality and increasing the power consumption. This phenomenon is generally called simultaneous switching noise.

The above-described influence of signal distortion, power-supply variation and noise on the display quality due to the increase in the drive frequency (display data transfer frequency and clock frequency) associated with the recent increase in the resolution (increase in the number of pixels) has been a cause to decelerate the development of the naked-eye type stereoscopic display apparatus. For example, a problem arises in that the stereoscopic optical characteristic (3D crosstalk) cannot be correctly evaluated. In general, a display panel of a naked-eye display apparatus supplies data to unit pixels respectively constituting different viewpoint images by the adjacent data lines. In order to evaluate the stereoscopic optical characteristic (3D crosstalk), a display pattern is used which maximizes the difference in gradation levels, i.e. gradation difference, of different viewpoint images (for example, black for the right-eye image and white for the left-eye image). This display pattern causes a simultaneous switching noise because each bit in the data bus are simultaneously changed. The noise further affects the result of measurement of the optical characteristics of an optical element which separates viewpoint images when the luminance is lowered in the display panel. This causes the stereoscopic optical characteristics (3D crosstalk), which are basically decided by the pixel layout and the characteristics of optical elements, to include the problem of a drive circuit, which hinders a correct evaluation.

Moreover, the above-described problems of signal distortion, power-supply variation and noise due to the higher drive frequency is caused also in a two-dimensional (2D) display apparatus for displaying superfine images of 4K or 8K as the number of pixels is increased, possibly deteriorating the display quality.

As a technique for suppressing the transfer frequency of the display data described above, a technique of dividing data signals to be sent to the display panel, to multiple buses. Furthermore, the technique of suppressing the peak of the noise components by shifting the phase of data for each bus, which is divided data signal, is known for suppressing simultaneous switching noise.

For example, Japanese Patent Application Laid-Open Publication No. H6-289822 discloses a method of dividing display data into two pieces and transferring one of the data pieces with a polarity opposite to that of the other data piece. Moreover, Japanese Patent Application Laid-Open Publication No. H11-249622 discloses a technique in which an input data signal is divided into multiple output signals and a phase difference is provided between the divided output signals so as to reduce the number of simultaneous changes of the output signals. Furthermore, Japanese Patent No. 3993297 discloses a method of outputting data signals with multiple stages of phases different for each data group (the RGB data group is divided into red(R), green(G) and blue (B), for example), and changing the phase difference randomly in terms of time.

SUMMARY

Japanese Patent Application Laid-Open Publication No. H6-289822, however, poses problems in that the number of divided signal lines is limited to an even number, that one of the display data needs to have an opposite polarity and that the relationship between the wiring path in the panel and the driver IC arrangement is limited.

Furthermore, Japanese Patent Application Laid-Open Publication No. H11-249622 has a problem in that the drive frequency for the display apparatus is limited because the phase difference between divided data buses of a data output clock cycle 1CLKO is determined based on an input clock cycle 1CLKI. FIG. 1 is a waveform diagram illustrating divided output signals and phase differences. In the display apparatus, a display data input signal comprising multiple bits is divided into a first display data output signal, a second display data output signal and a third display data output signal. Phase differences corresponding to 0.5 times, one time and 1.5 times the cycle of a clock input signal are provided between each of the divided output signals and the clock output signal.

In the case where the cycle of a clock output signal is shorter than the cycle of a clock input signal, multiple display data output signals with limited phase differences according to the cycles of the clock input signals are difficult to be latched by one clock output signal alone. For example, in a display apparatus which aims to have increased resolution by time-division display for each color in one pixel, or a display apparatus to which double speed driving is applied in order to enhance the performance of moving images, the cycle of a clock output signal is shortened compared to the cycle of a clock input signal. In such a display apparatus, data output signals are inconstant for the display data signal that cannot be latched, thereby causing a large disturbance in the display.

In Japanese Patent No. 3993297, the phase difference is randomly changed in terms of time, so that the timing for switching data can be dispersed, reducing the simultaneous switching. If, however, the case where the applied phase difference is 0 continues for a display pattern with frequent timing of data switching, such a problem arises that the effect of suppressing a peak of a noise component is insufficient.

All of the techniques disclosed in the prior art documents described above serve to suppress simultaneous switching noise by shifting the phase of display data irrespective of an input display pattern (data of an input image). However, shifting the phase between data shortens the setup time and hold time of data, increasing a probability of the occurrence of a data reading error as the transfer frequency becomes higher. That is, another problem of a smaller operation margin of data transfer occurs.

A display apparatus according to the present disclosure includes: a display panel in which unit pixels each constituted by a subpixel for displaying a first pattern and a subpixel for displaying a second pattern are alternately arranged in a column or a row direction; a determination part detecting a gradation difference between a first image signal input to the first subpixel and a second image signal input to the second subpixel and determining whether or not the gradation difference is equal to or larger than a preset threshold; a data output part outputting data to the display panel; and a timing control part varying phases so as to avoid synchronization of rise and fall of the first image signal and the second image signal and outputting the signals to the data output part if it is determined that the gradation difference is equal to or larger than the threshold.

In the display apparatus according to the present disclosure, the determination part determines, after it is determined that the gradation difference is equal to or larger than the preset threshold, whether or not a region having the gradation difference is equal to or larger than a predetermined number of subpixels preset in accordance with the gradation difference.

A method of processing an image signal input to a display panel in which unit pixels each constituted by a first subpixel displaying a first pattern and a second subpixel displaying a second pattern are alternately arranged in a row or column direction, according to the present disclosure, includes: obtaining a first image signal input to the first subpixel and a second image signal input to the second subpixel; detecting a gradation difference between the first image signal and the second image signal for each unit pixel; determining whether or not the gradation difference is equal to or larger than a threshold; outputting two or more clock signals with a same cycle, a same phase and a same pulse width generated for coupling the first image signal with the second image signal in synchronization with one another, if determined that the gradation difference is smaller than the threshold; and controlling the cycle, phase or pulse width such that the two or more clock signals are not synchronized with one another and outputting the two or more clock signals, if determined that the gradation difference is equal to or larger than the threshold.

It is to be understood that both the foregoing general description and the following detailed description are exemplary and explanatory and are not restrictive of this disclosure.

The above and further objects and features will more fully be apparent from the following detailed description with accompanying drawing.

BRIEF DESCRIPTION OF THE DRAWINGS

FIG. 14 illustrates a relationship between subpixels in a display panel and corresponding data according to Example 2.

FIG. 22 illustrates an example of combinations of six types of left-eye image data and right-eye image data according to Embodiment 2.

DETAILED DESCRIPTION OF NON-LIMITING EXAMPLE EMBODIMENTS

Embodiments of the present disclosure will be described below in detail with reference to the drawings. In the specification and drawings, components having substantially the same functional configurations are denoted by the same reference codes and the description thereof will not be repeated. Moreover, in the description below, the arrangement of pixels aligned in the "horizontal direction" corresponds to "row" whereas the arrangement of pixels aligned in the "vertical direction" corresponds to "column" in a display panel.

Embodiment 1

Figure 1:
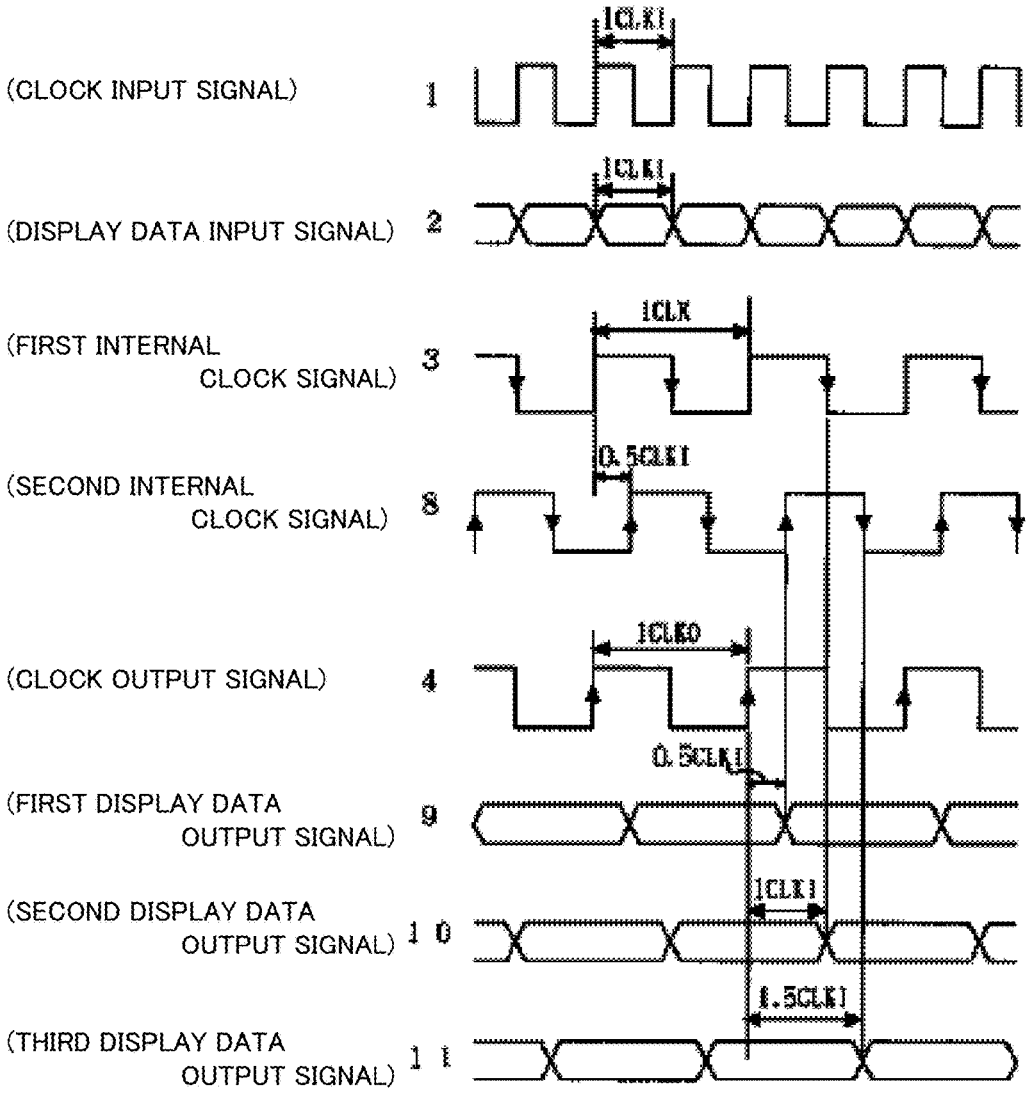
FIG. 1 RELATED ART
FIG. 1 illustrates waveforms illustrating that phase differences are provided among divided output signals in the conventional liquid crystal display apparatus.
Figure 2:
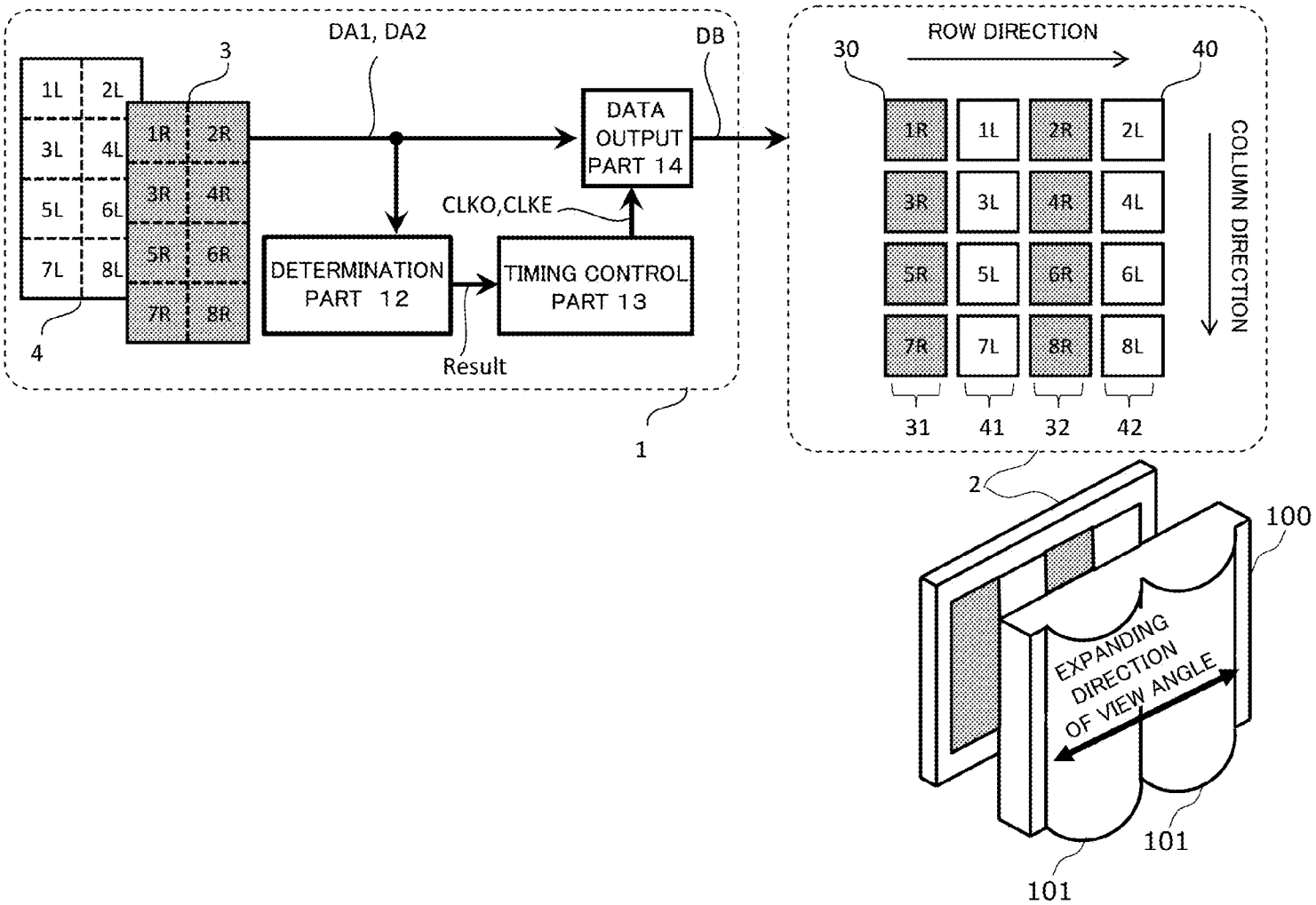
FIG. 2 is a block diagram illustrating the overall configuration of an example of non-limiting display apparatus according to Embodiment 1.

FIG. 2 is a block diagram illustrating the configuration of a display apparatus according to an embodiment of the present disclosure. The display apparatus according to Embodiment 1 comprises a signal processing unit 1 and a display panel 2.

The signal processing unit 1 includes a determination part 12 to which an image signal DA1 of a first pattern 3 as well as an image signal DA2 of a second pattern 4 are input and outputting a determination result Result. The signal processing unit 1 further includes a timing control part 13 outputting two data coupling clock signals CLKO and CLKE that are controlled based on the determination result Result. Furthermore, the signal processing unit 1 includes a data output part 14 outputting a coupled image signal DB obtained by coupling DA1 with DA2 using CLKE and CLKO to the display panel 2.

The first pattern 3 represents parallax image data for the right eye in which eight pixels from 1R to 8R are arranged in four rows and two columns, whereas the second pattern 4 represents parallax image data for the left eye in which eight pixels from 1L to 8L are arranged in four rows and two columns. The image signals DA1 and DA2 correspond to signals indicating gradation levels of the respective pixels of 1R to 8R and 1L to 8L. The display panel 2 is constituted by the matrix of four rows and four columns in which the first subpixels 30 and the second subpixels 40 are alternately arranged in the row direction.

Each of the first subpixels 30 and the second subpixels 40 is a pixel with variable luminance. The luminance of the first subpixel 30 is decided by the corresponding first pattern 3 whereas the luminance of the second subpixel 40 is decided by the corresponding second pattern 4.

For example, the luminance of the first subpixel 30 located at the position of 1R in the display panel 2 is decided by 1R in the first pattern 3, whereas the luminance of the second subpixel 40 located at the position of 1L in the display panel 2 is decided by 1L in the second pattern 4. Accordingly, 1R to 8R in the first pattern 3 respectively correspond to 1R to 8R of the first subpixels 30 in the display panel 2, whereas 1L to 8L in the second pattern 4 respectively correspond to 1L to 8L of the second subpixels 40 in the display panel 2.

Furthermore, a lenticular lens 100 is arranged on the display surface side of the display panel 2. In the lenticular lens 100, cylindrical lenses 101 are aligned. The cylindrical lens 101 has a lens effect in the row direction in association with a unit pixel constituted by subpixels adjacent with each other in the row direction, in order of the first subpixels 30 and the second subpixels 40, for example, the combinations of 1R and 1L, 2R and 2L and so forth. The cylindrical lens 101 sorts out the light emitted from a pixel group 31 or 32 for the right eye constituted by the first subpixels 30 among the light emitted from a unit pixel, and assigns the light to the right eye of an observer. Moreover, the cylindrical lens 101 sorts out the light emitted from a pixel group 41 or 42 for the left eye constituted by the second subpixels 40, and assigns the light to the position of the left eye of the observer. Parallax images are used for the first pattern 3 and the second pattern 4, so that the observer is provided with a stereoscopic image.

Figure 3:
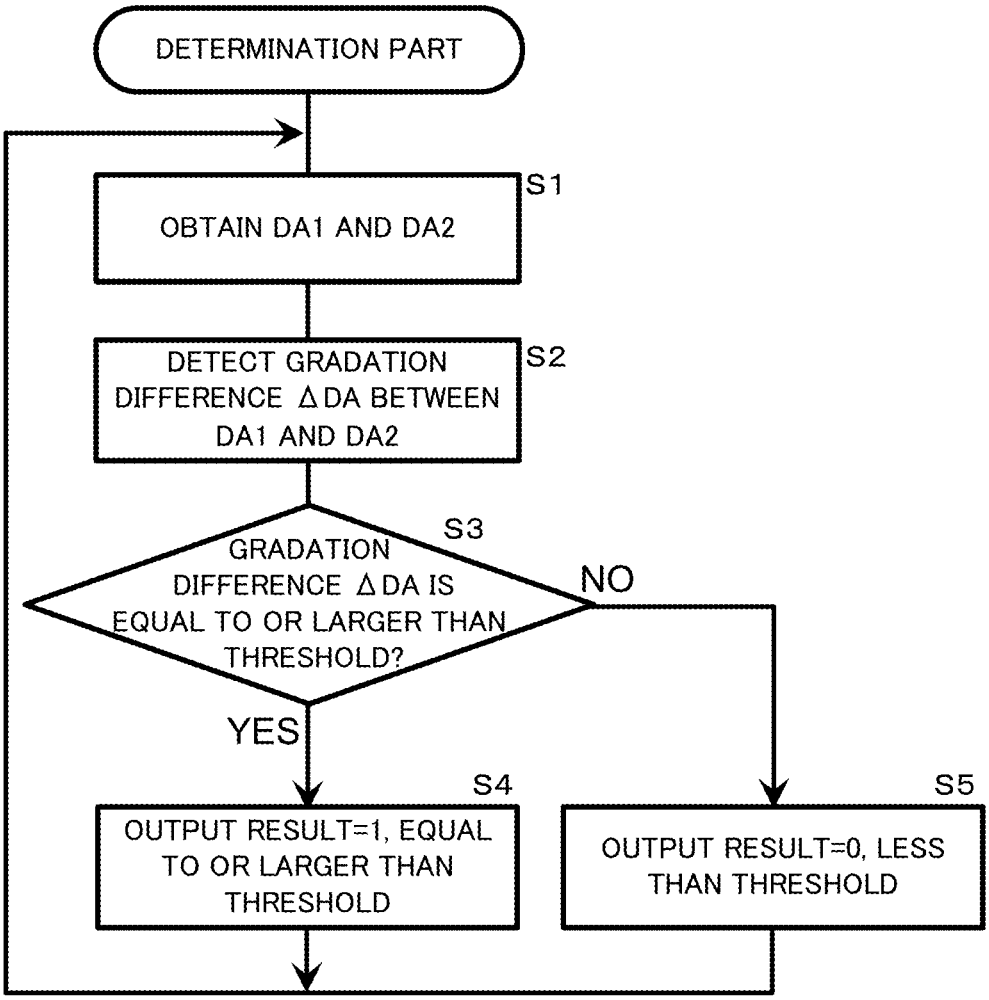
FIG. 3 is a flowchart illustrating the operation of a determination part according to Embodiment 1.

The operation of the signal processing unit 1 will now be described with reference to FIGS. 3, 4, 5 and 6. The signal processing unit 1 operates as described below in accordance with a predetermined program. FIG. 3 is a flowchart illustrating the operation of the determination part 12. The determination part 12 obtains DA1 which is an image signal of the first pattern 3 and DA2 which is an image signal of the second pattern 4 that are input to the determination part 12 (S1). Subsequently, the determination part 12 detects a difference ΔDA between DA1 and DA2 corresponding to the first subpixel 30 and the second subpixel 40 (1L and 1R, or 2L and 2R) constituting a unit pixel (S2). The determination part 12 determines whether or not the detected ΔDA is equal to or larger than a preset threshold (S3), and if it is equal to or larger than the threshold (S3: YES), sets 1 to a determination result Result and outputs Result to the timing control part 13 (S4). The determination part 12 thereafter returns the processing to step S1. If it is determined otherwise (S3: NO), the determination part 12 sets 0 to the determination result Result and outputs Result to the timing control part 13 (S5), and returns the processing to step S1.

Figure 4:
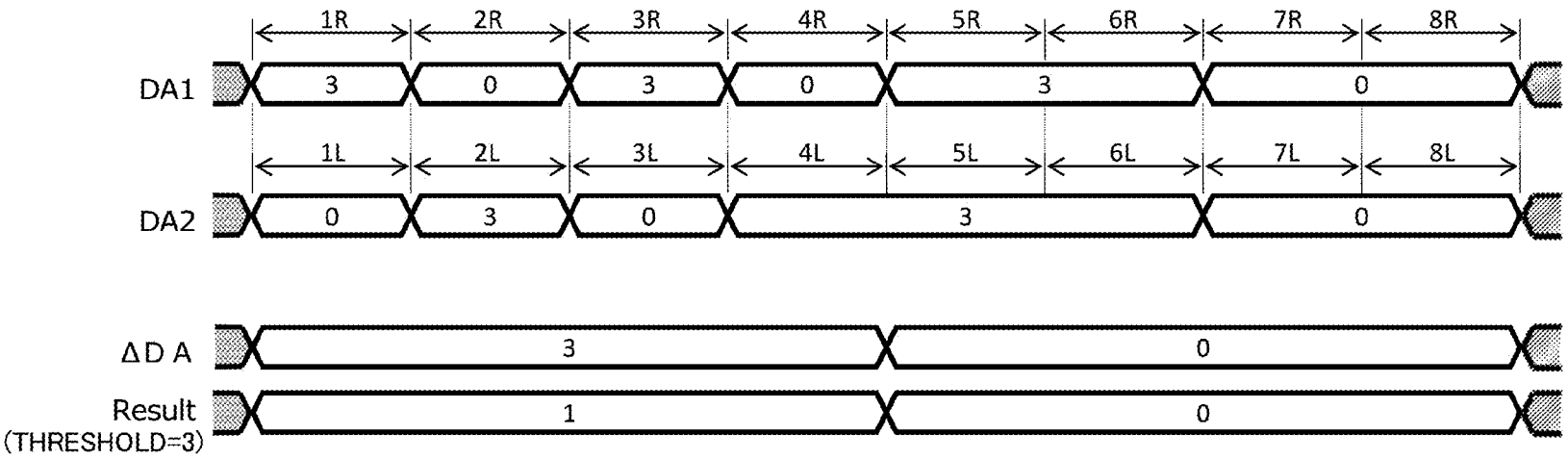
FIG. 4 is a timing chart illustrating the operation of the determination part according to Embodiment 1.

FIG. 4 is a timing chart illustrating the operation of the determination part 12. DA1 and DA2 in FIG. 4 represent digital signals of four gradation levels indicated by 0 to 3. For DA1, 3, 0, 3, 0, 3, 3, 0, 0 are set sequentially from 1R to 8R. For DA2, 0, 3, 0, 3, 3, 3, 0, 0 are set sequentially from 1L to 8L.

ΔDA is a difference between DA1 and DA2. Thus, ΔDA is 3 during the period from 1R-1L to 4R-4L, whereas it is 0 during the period from 5R-5L to 8R-8L. The determination result Result output by the determination part 12 is obtained by setting the threshold as 3, so that Result is 1 during the period in which ΔDA is 3 and is 0 during the period in which ΔDA is 0.

Figure 5:
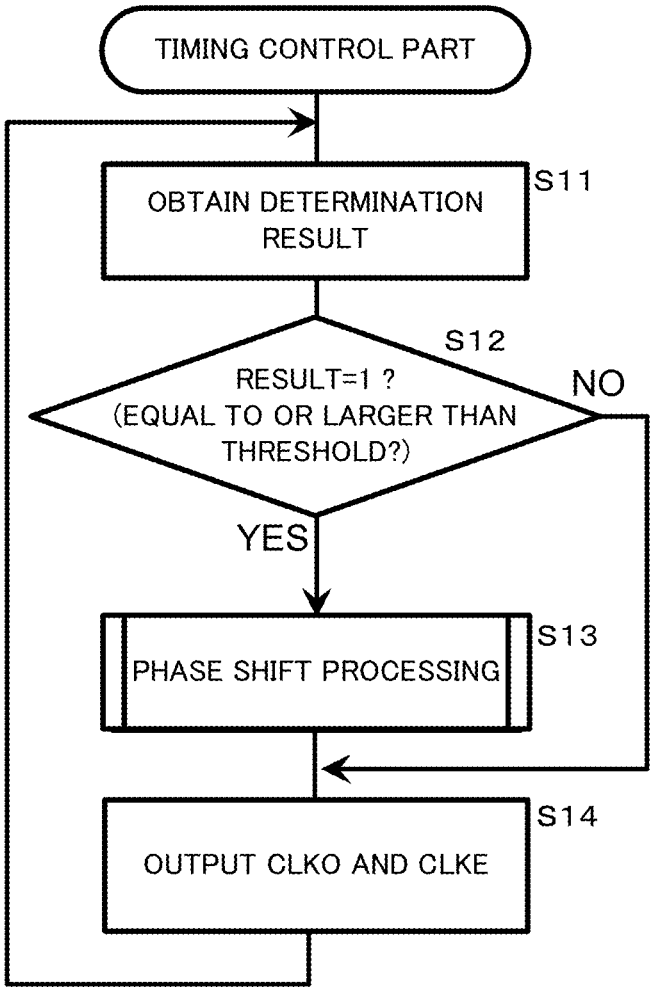
FIG. 5 is a flowchart illustrating the operation of a timing control part according to Embodiment 1.

FIG. 5 is a flowchart illustrating the operation of a timing control part 13. The timing control part 13 obtains the determination result Result (S11), and determines whether or not the determination result Result is 1, that is, equal to or larger than a threshold (S12). If the determination result Result is 1 (S12: YES), the timing control part 13 performs phase shift processing (S13). If the determination result Result is 0 (S12: NO), the timing control part 13 outputs CLKO and CLKE to the data output part 14 (S14) without performing phase shift processing, and returns the processing to step S11.

Figure 6:
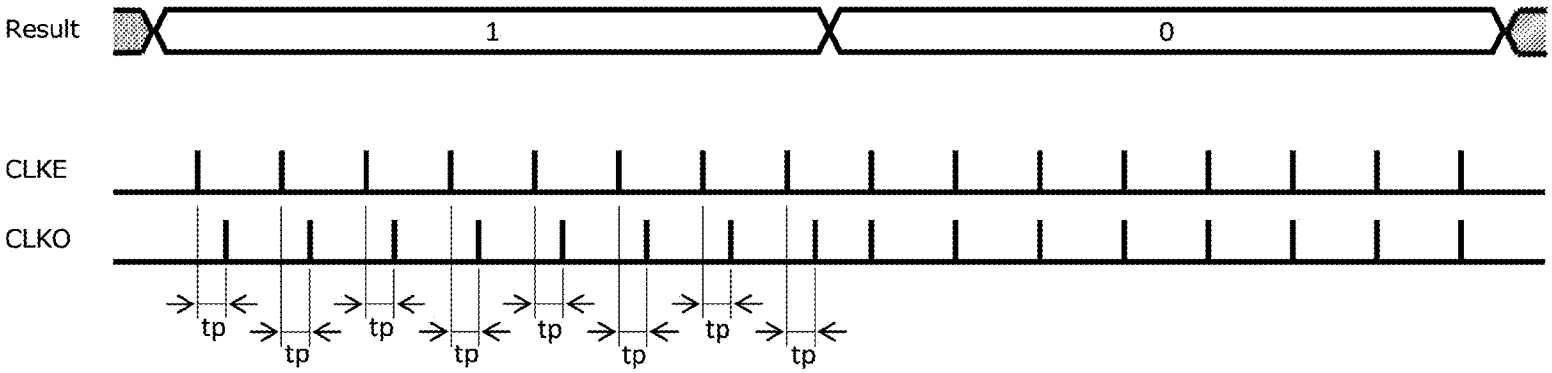
FIG. 6 is a timing chart illustrating the operation of the timing control part according to Embodiment 1.

FIG. 6 is a timing chart illustrating the operation of the timing control part 13. CLKE and CLKO have a phase difference tp because of the phase shift processing performed during the period in which the determination result Result is 1, whereas CLKE and CLKO have no phase difference because no phase shift processing is performed during the period in which the determination result Result is 0. It is to be noted that the cycle of CLKE and CLKO corresponds to half the cycle of DA1 and DA2.

Figure 7:
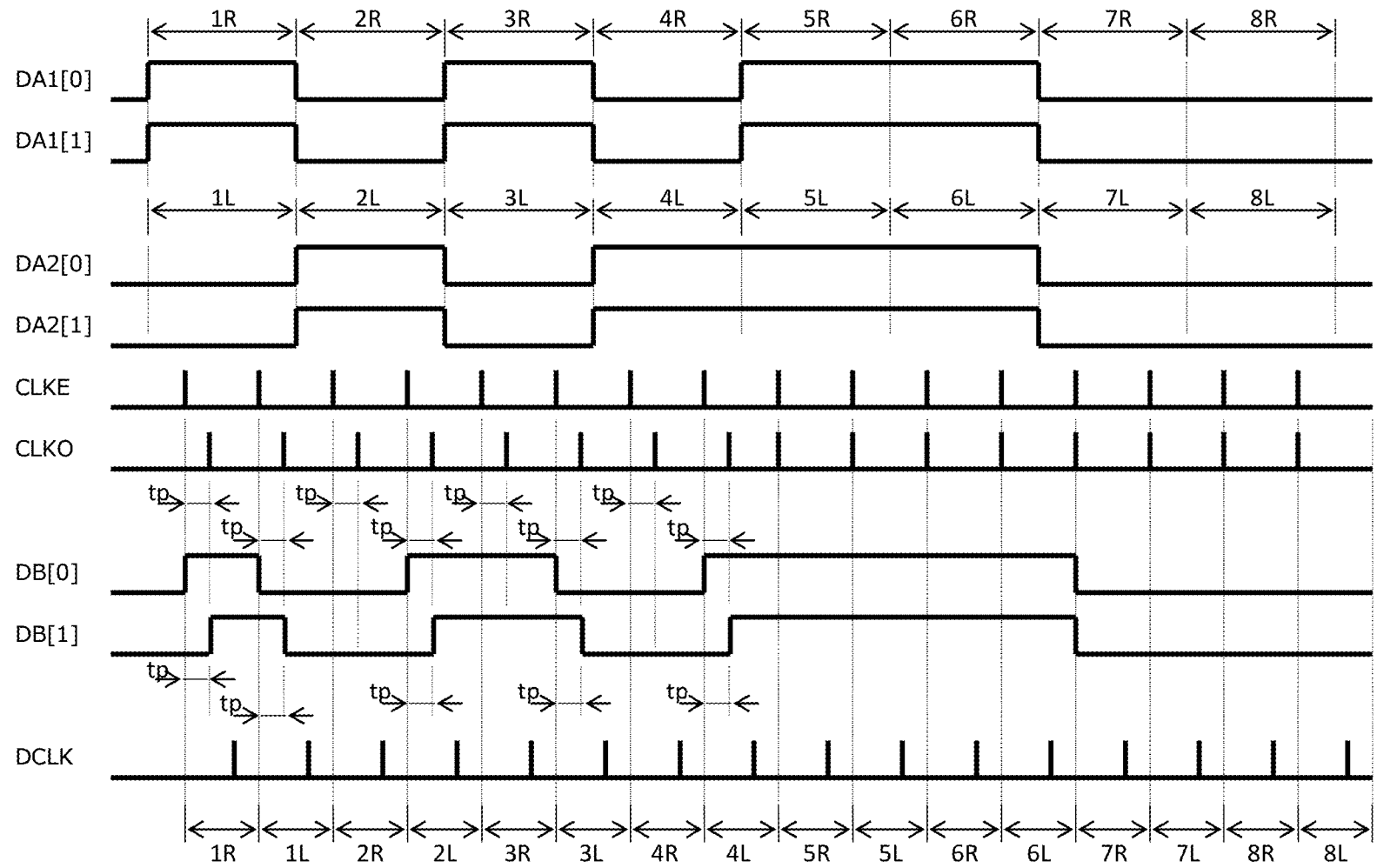
FIG. 7 is a timing chart illustrating the operation of a data output part according to Embodiment 1.

The data output part 14 latches either one of DA1 and DA2 to DB for each bit, using CLKE and CLKO, alternately in order of DA1 and DA2. The operation of the data output part 14 will be described in detail with reference to FIG. 7. FIG. 7 is a timing chart illustrating the operation of the data output part 14. FIG. 7 illustrates DA1, DA2 and DB of four gradation levels represented by 0 to 3 that are indicated by two-bit digital signals of $(00)_2$ to $(11)_2$ with the High level being $(1)_2$ and the Low level being $(0)_2$.

First, DA1 in the period of 1R is latched to DB. Here, DA1[0] is latched by CLKE to make DB[0] at the High level, and DA1[1] is latched by CLKO to make DB[1] at the High level.

Next, DA2 in the period of 1L is latched to DB after one cycle of CLKE or CLKO. Similarly to the DA1 described above, DA2[0] is latched by CLKE to make DB[0] at the Low level, whereas DA2[1] is latched by CLKO to make DB[1] at the Low level.

Likewise, after one cycle of CLKE or CLKO, in 2R, 2L, 3R, 3L, 4R, 4L, 5R, 5L, 6R, 6L, 7R, 7L, 8R and 8L, in sequence, DA1[0] and DA2[0] are latched to DB[0] by CLKE, whereas DA1[1] and DA2[1] are latched to DB[1] by CLKO. In latching, a phase difference tp is generated between DB[0] and DB[1] if the phase difference tp is present between CLKE and CLKO, whereas no phase difference is generated between DB[0] and DB[1] if no phase difference is present between CLKE and CLKO.

As the signal processing unit 1 operates as described above, CLKE output by the timing control part 13 is used to latch DB[0], whereas CLKO output by the timing control part 13 is used to latch DB[1], for each bit. Accordingly, if it is determined that the gradation difference ΔDA between DA1 and DA2 is equal to or larger than the threshold, there is the phase difference tp between CLKE and CLKO, so that the phase difference tp is present between DB[0] and DB[1] to be output to the display panel 2.

It is noted that digital signals consisting of multiple bits such as DB are, in general, simultaneously latched by a single clock signal. Thus, the phase difference tp preferably remains within a range which allows DB[0] and DB[1] to be simultaneously latched by a single clock signal such as a dot clock DCLK.

Now, the effect of the phase difference tp between the adjacent DB[0] and DB[1] will be described with reference to FIGS. 8A, 8B, 8C, and 8D. FIGS. 8A, 8B, 8C and 8D illustrate CLKE and CLKO input to the data output part 14, DB[0] and DB[1] output by the data output part 14, and GND. For each timing chart, the timings of CLKE and CLKO output by the timing control part 13 are different. In the description, the timing at which DB in FIGS. 8A, 8B, 8C and 8D is switched from the Low level to the High level is regarded as a rise time, whereas the timing at which DB is switched from the High level to the Low level is regarded as a fall time.

Figure 8A:
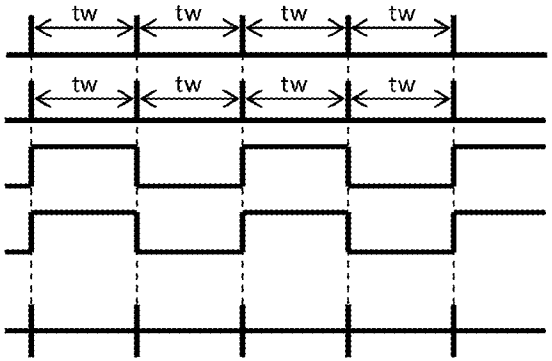
FIG. 8A illustrates the influence of distortion on GND according to Embodiment 1.

In FIG. 8A, no phase difference is present between CLKE and CLKO, while DB[0] and DB[1] latched at a constant cycle tw are synchronized in their rise and fall. At GND, a spike-like noise is generated at the timings of rise and fall of DB[0] and DB[1] at the constant cycle tw.

Figure 8B:
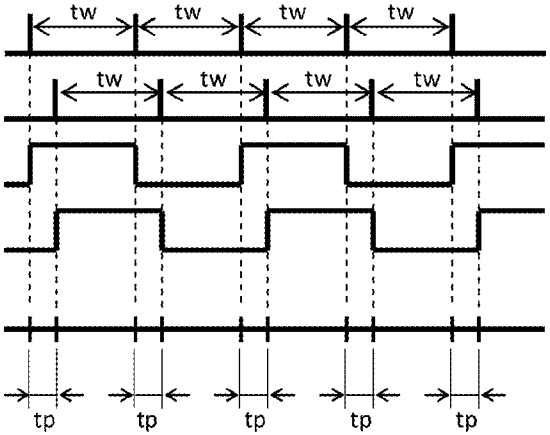
FIG. 8B illustrates the influence of distortion on GND according to Embodiment 1.

FIG. 8B is an example where a phase difference is provided between DB[0] and DB[1], in which both CLKE and CLKO have the constant cycle tw while the phase difference tp is present between CLKE and CLKO. Thus, the phase difference tp is also present between DB[0] latched by CLKE and DB[1] latched by CLKO, and the spike-like noise generated at GND is dispersed in the time axis direction because of the phase difference tp, thereby suppressing the amplitude. That is, by shifting the timings of fall and rise between data outputs to disperse the influence of distortion on GND in the time axis direction, the effect of suppressing a drive load as well as a noise affecting the display quality may be produced.

Figure 8C:
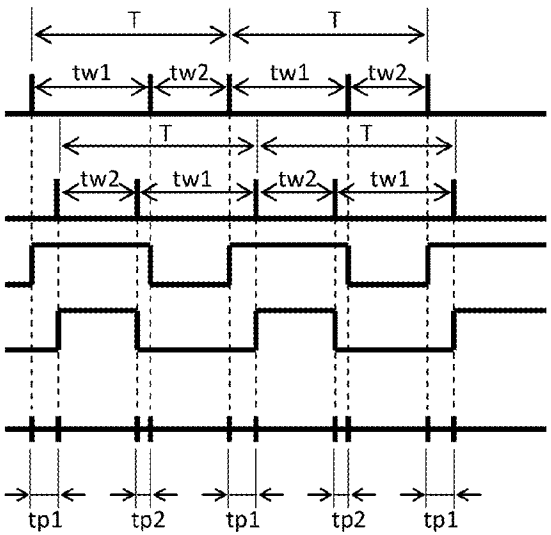
FIG. 8C illustrates the influence of distortion on GND according to Embodiment 1.

FIG. 8C is an example where, in addition to the phase difference between DB[0] and DB[1], each pulse width of DB[0] and DB[1] is varied. While the a phase difference tp1 is present at a constant cycle T between CLKE and CLKO, for cycles tw1 and tw2 constituting the cycle T, the cycles are alternately repeated in order of tw1 and tw2 for CLKE, and in order of tw2 and tw1 for CLKO.

As such, a phase difference tp1 is present at the constant cycle T between DB[0] latched by CLKE and DB[1] latched by CLKO. Moreover, DB[0] and DB[1] are switched logically from High to Low or Low to High during the cycle T. Accordingly, the pulse width in the period during which DB[0] and DB[1] are High corresponds to either tw1 or tw2, and a phase difference tp2 is generated at the timings of rise and fall of DB[0] and DB[1].

As such, in addition to the phase difference tp1 between DB[0] and DB[1], the pulse width in the period during which each of DB[0] and DB[1] is High is varied to generate the phase difference tp2, so that the spike-like noise generated at GND is dispersed by the two phase differences tp1 and tp2 on the time axis. Therefore, compared to the example illustrated in FIG. 8B, the frequency component constituting distortion affecting GND is switched on the continuous time axis, which can reduce the probability of being affected by an external noise other than DB.

Figure 8D:
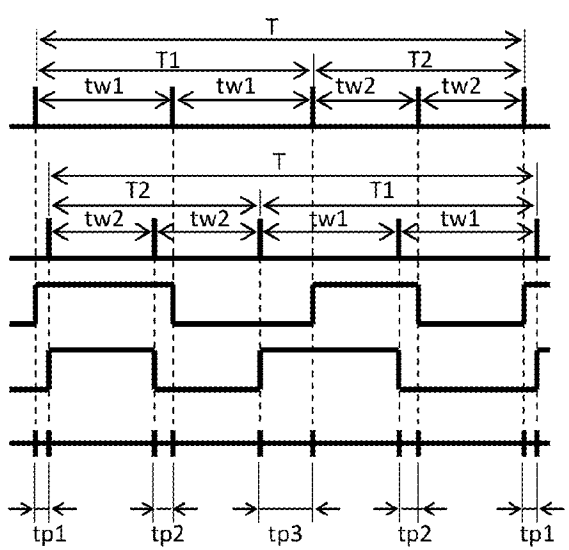
FIG. 8D illustrates the influence of distortion on GND according to Embodiment 1.

FIG. 8D is an example where, in addition to the phase difference between DB[0] and DB[1], the cycles of DB[0] and DB[1] are varied. While the phase difference tp1 is present at the constant cycle T between CLKE and CLKO, for cycles T1 and T2 constituting the cycle T, the cycles are alternately repeated in order of T1 and T2 for CLKE, and in order of T2 and T1 for CLKO. Moreover, the cycle T1 is constituted by the cycle tw1, and the cycle T2 is constituted by the cycle tw2.

Thus, the phase difference tp1 is present at the cycle T between DB[0] latched by CLKE and DB[1] latched by CLKO. Furthermore, in the period of cycles T1 and T2, DB[0] and DB[1] are switched logically from High to Low or Low to High, so that the phase difference tp2 is generated at the timing of rise and fall of each of DB[0] and DB[1]. Moreover, during the period of cycle T, the cycle of DB[0] and DB[1] is varied from T1 to T2 or T2 to T1, which generates a phase difference tp3 at the timing of rise and fall of each of DB[0] and DB[1].

As such, in addition to the phase difference tp1 between DB[0] and DB[1], in each of DB[0] and DB[1], the cycle is varied to generate the phase differences tp2 and tp3, so that the spike-like noise generated on GND is dispersed by the three phase differences tp1, tp2 and tp3. Thus, compared to the example illustrated in FIG. 8C, the frequency component constituting distortion may be spread, which can further reduce the probability of being affected by an external noise other than DB.

While an example has been described above where a display apparatus constituted by four rows and four columns in Embodiment 1, the number of subpixels constituting the display apparatus of the present disclosure is not limited thereto.

While digital signals of four gradation levels represented by 0 to 3 have been used in the description, the display apparatus according to the present disclosure is not intended to limit the number of gradation levels. Any digital signal of a gradation level constituted by multiple bits may be controlled for the presence/absence of a phase difference between an even bit and an odd bit.

Figure 9A:
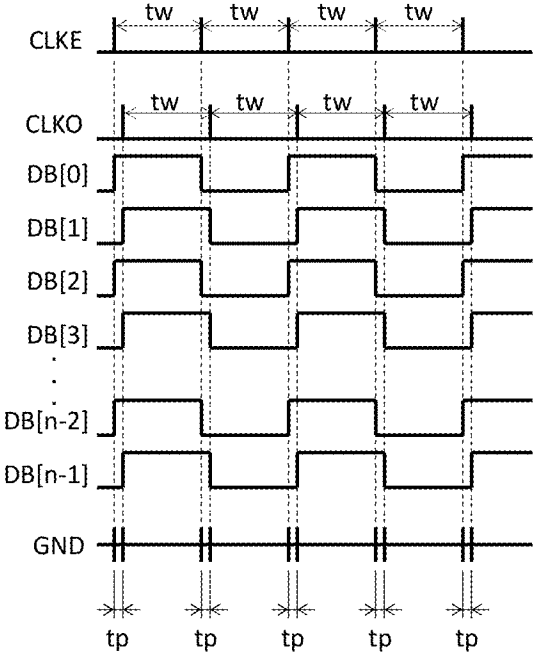
FIG. 9A illustrates an example of control with even bits and odd bits according to Embodiment 1.
Figure 9B:
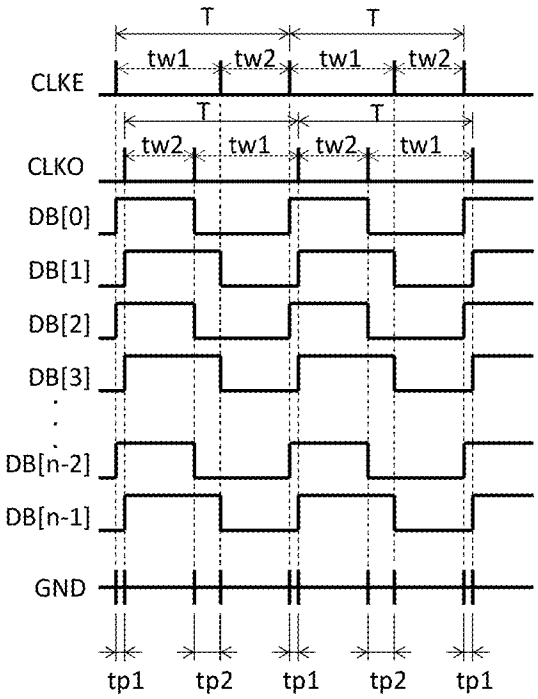
FIG. 9B illustrates an example of control with even bits and odd bits according to Embodiment 1.

FIGS. 9A and 9B illustrate an example of control for even bits and odd bits. FIGS. 9A and 9B illustrate two data coupling clock signals CLKO and CLKE output by the timing control part 13, coupled image signals DB[0], DB[1], DB[2], DB[3], . . . DB[n-1], output by the data output unit 14, that are digital signals of 2n gradation levels consisted of n bits (n is a natural number equal to or larger than 2, e.g., 8 or 10), and GND.

Figure 9C:
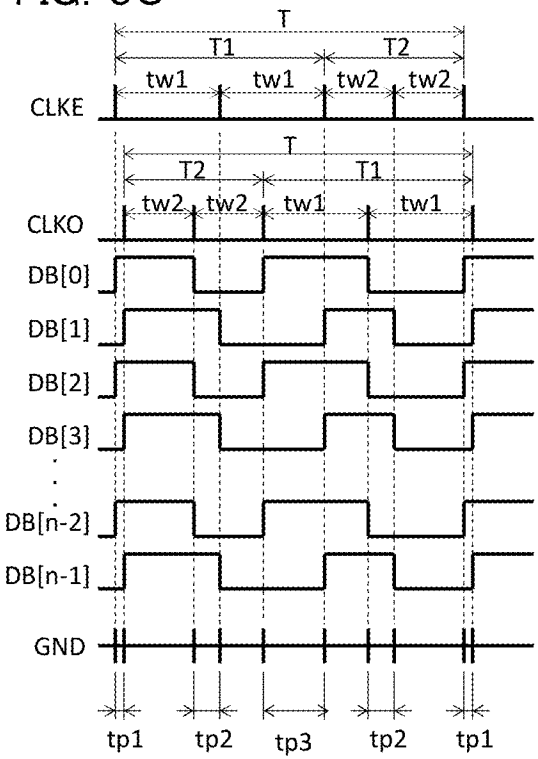
FIG. 9C illustrates an example of control with even bits and odd bits according to Embodiment 1.

FIG. 9A is an example where a phase difference is provided as described with reference to FIG. 8B, FIG. 9B is an example where a pulse width is varied as described with reference to FIG. 8C, and FIG. 9C is an example where a cycle is varied as described with reference to FIG. 8D.

As illustrated in FIGS. 9A, 9B, and 9C, between an even bit latched by CLKE (DB[0], DB[2], . . . DB[n-2]) and an odd bit latched by CLKO (DB[1], DB[3], . . . DB[n-1]), the phase difference tp is present in FIG. 9A, two phase differences tp1 and tp2 are present at the constant cycle T in FIG. 9B, and three phase differences tp1, tp2 and tp3 are present at the constant cycle T in FIG. 9C. Accordingly, for a digital signal constituted by multiple bits, an effect similar to that described for FIGS. 8B, 8C and 8D may be obtained.

Moreover, in a digital signal constituted by a number of bits, such as a digital signal constituted by 24 bits including 8 bits for each of RGB, for example, in the case where a large number of spike-like noises generated on GND are overlapped with one another, the number of the data coupling clock signals to be output to the data output part 14 by the timing control part 13 may be set as three, and a phase difference may be provided between digital signals adjacent to each other at the cycle of 3 bits. Moreover, an even larger number of data coupling clock signals may also be used.

Figure 10:
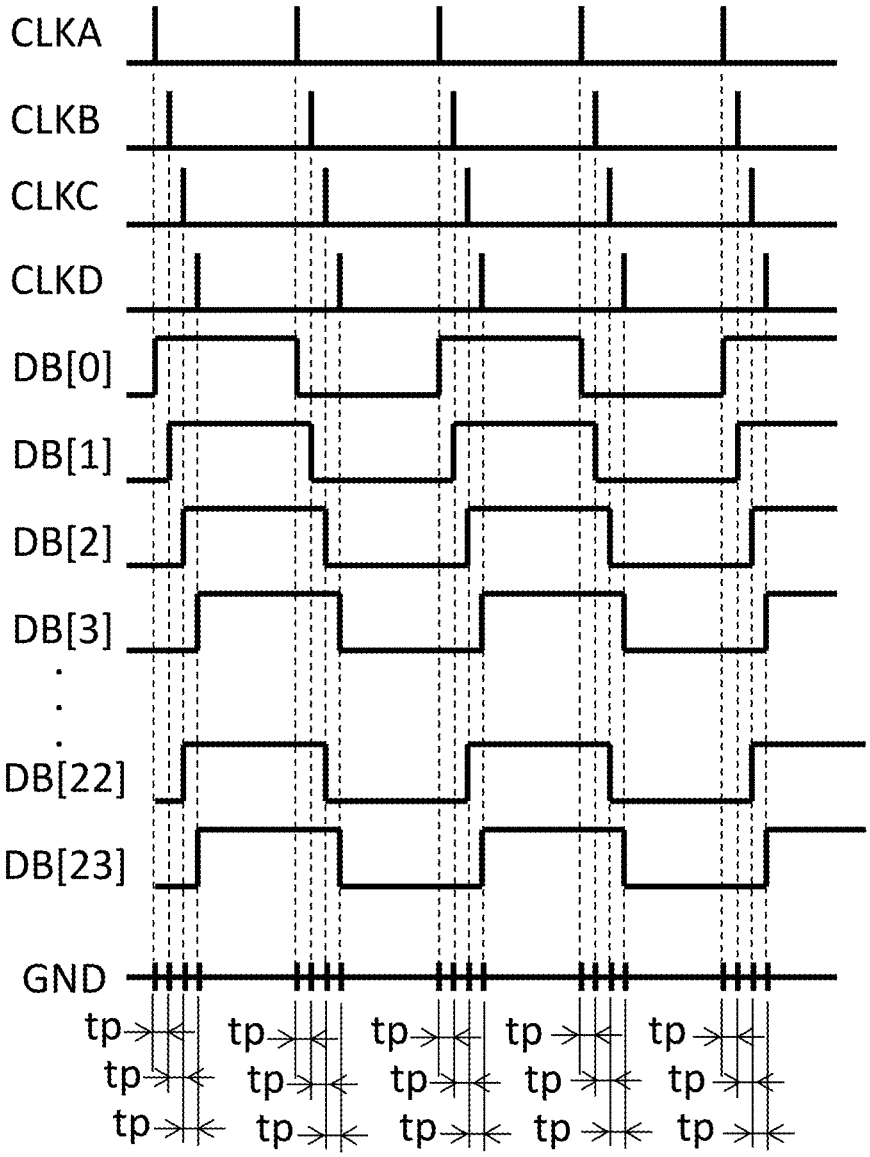
FIG. 10 illustrates examples of four data coupling clock signals according to Embodiment 1.

FIG. 10 illustrates an example where the number of data coupling clock signals is increased. FIG. 10 illustrates four data coupling clock signals (CLKA, CLKB, CLKC, CLKD) output by the timing control part 13, coupled image signals DB[0], DB[1], DB[2], DB[3] . . . DB[23], output by the data output part 14, that are digital signals composed of 24 bits, and GND.

The timing control part 13 controls the phase differences among the data coupling clock signals CLKA, CLKB, CLKC and CLKD in accordance with the determination result of the determination part 12, and outputs the signals.

The data output part 14 controls adjacent digital signals such as DB[0] and DB[1] so as to have different phase differences using the data coupling clock signals CLKA, CLKB, CLKC and CLKD controlled for their respective phase differences, so that the spike-like noise generated on GND may further be dispersed in the time axis direction, compared to the case of the control using the two data coupling clock signals CLKO and CLKE as illustrated in FIG. 9A, and thus the amplitude may be reduced.

While the control is carried out using the phase difference tp between the adjacent coupled image signals DB in the example illustrated in FIG. 10, variation in the pulse width as described with reference to FIG. 8C as well as variation in the cycle as described with reference to FIG. 8D may also be possible, which may obtain an effect similar to that described with reference to FIGS. 8C and 8D.

Moreover, the number of data coupling clock signals is not limited to four as described in the example above, but an even larger number of data coupling clock signals may also be used.

Now, examples of the present disclosure will be described below in detail with reference to the drawings.

Example 1

Figure 11:
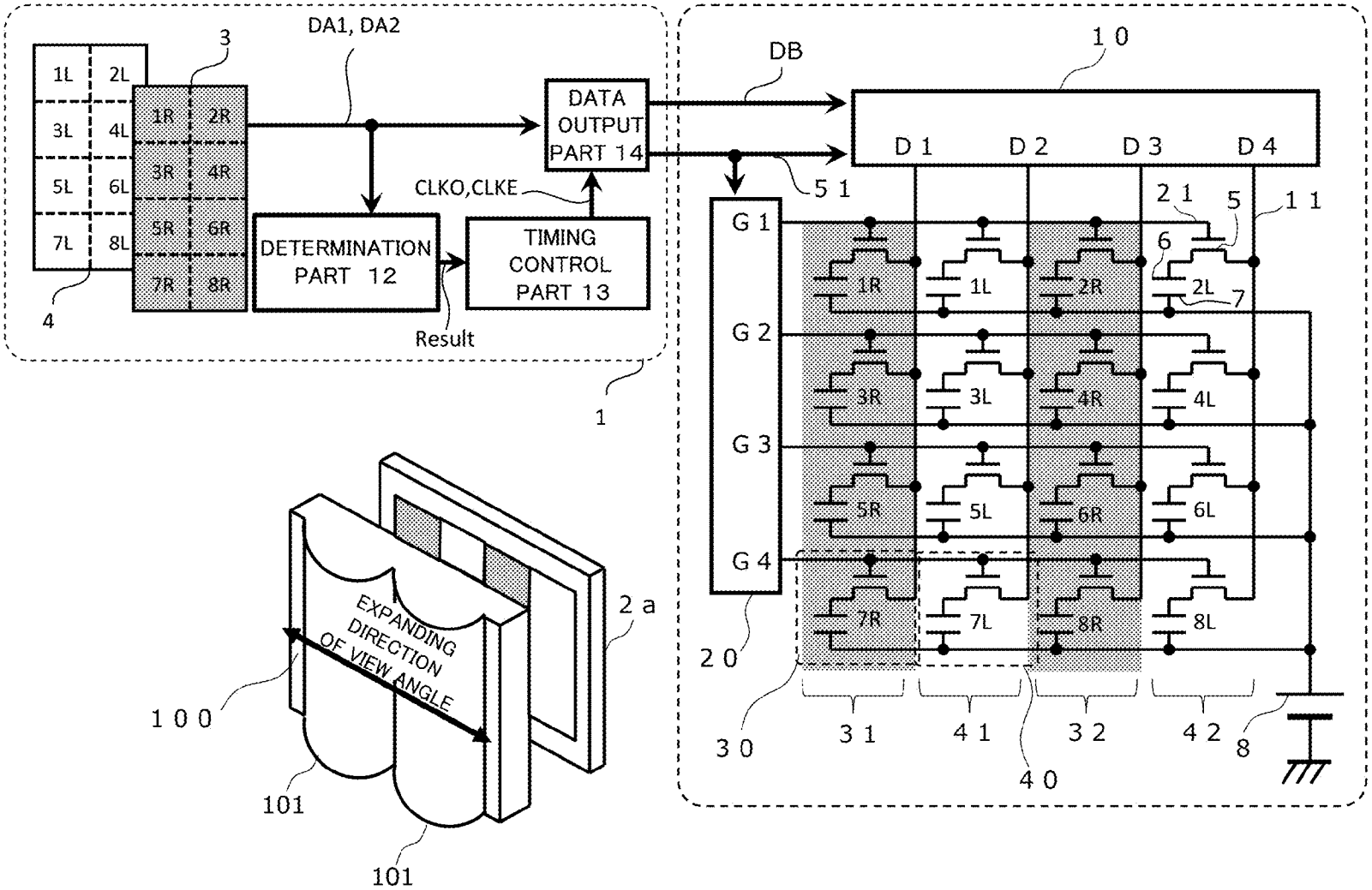
FIG. 11 is a block diagram illustrating the overall configuration of a display apparatus according to Example 1.

FIG. 11 is a schematic view of a liquid crystal display panel of the active matrix type which is applied to the display panel 2*a* of the display apparatus according to the present disclosure. The display apparatus illustrated in FIG. 11 comprises a display panel 2*a* on which a first pattern 3 and a second pattern 4 are displayed, and a signal processing unit 1 supplying signals to the display panel 2*a*.

The display panel 2*a* includes first subpixels 30 for displaying the first pattern 3 and second subpixels 40 for displaying the second pattern 4, constituting a unit pixel, that are alternately aligned in the row direction on a transparent substrate (not illustrated). Each of the first subpixel 30 and the second subpixel 40 is constituted by the TFT(Thin Film Transistor) 5, pixel electrode 6 and common electrode 7, and is connected to the data line 11, gate line 21 and common electrode power supply 8. The data line 11 is connected to the data driver 10 having the outputs of D1 to D4, and the gate line 21 is connected to the gate driver 20 having the outputs of G1 to G4. Though not illustrated, another surface of the display panel 2*a* different from the display surface is provided with a planar light source emitting light toward the direction of the display surface of the display panel 2*a*. Furthermore, as in Embodiment 1, a lenticular lens 100 constituted by cylindrical lenses 101 is provided at the display surface side of the display panel 2*a*.

The gate driver 20 outputs scanning signals, sequentially from the outputs G1 to G4, so as to select the gate line 21 to which each of the outputs is connected. Moreover, the data driver 10 supplies a signal corresponding to a subpixel connected to a gate line 21 being selected, from D1 to D4 to the data line 11 connected to each output. Thus, a signal voltage is supplied to the pixel electrode 6 through the TFT 5 connected to the selected gate line 21. The difference between the signal voltage supplied to the pixel electrode 6 and the Vcom voltage of the common electrode power supply 8 applied to the common electrode 7 serves to drive an electric optical element such as a liquid crystal.

Figure 12:
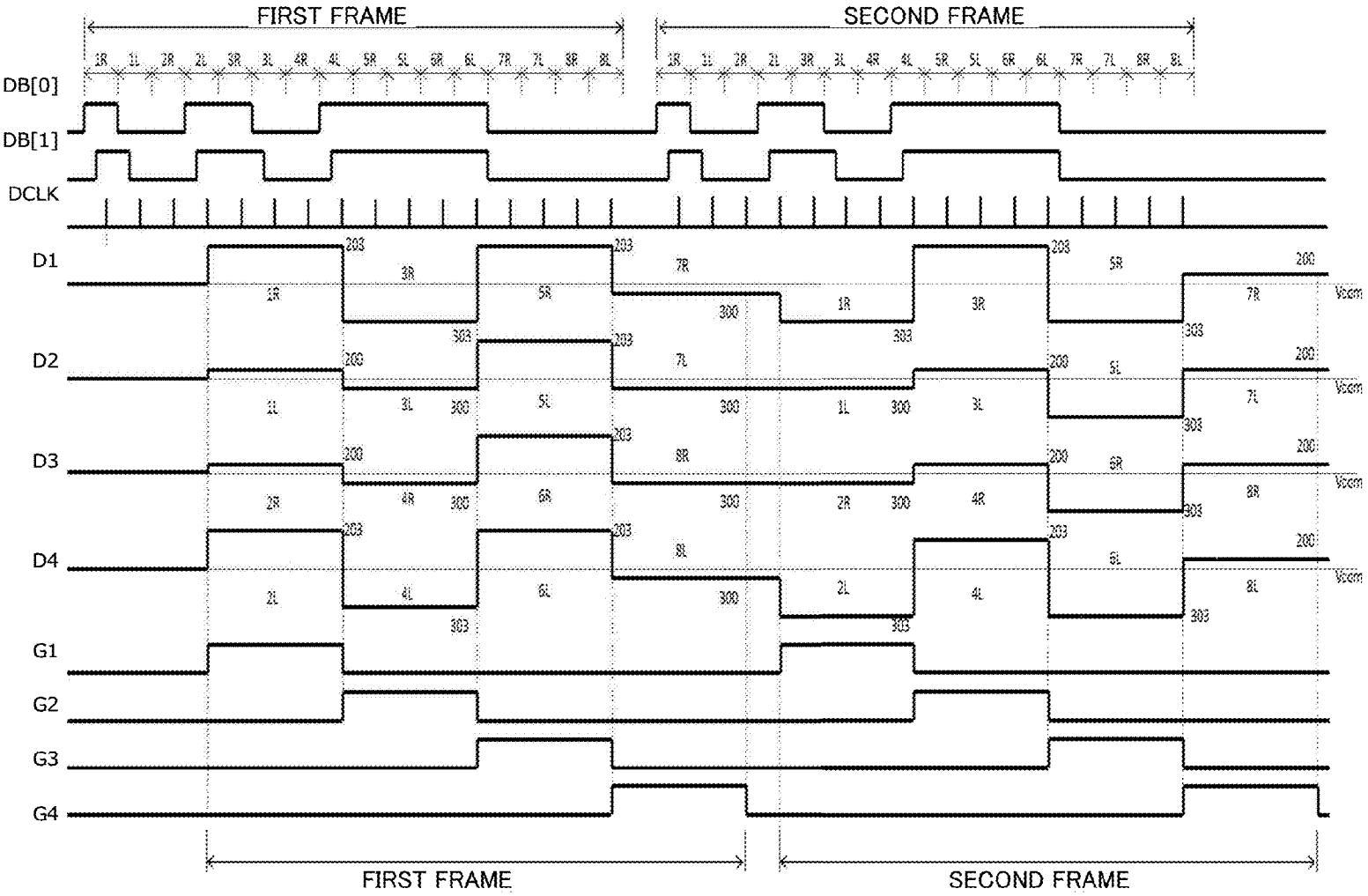
FIG. 12 is a timing chart illustrating the operation of a display panel according to Example 1.

The operation of the display panel 2*a* will now be described with reference to FIG. 12. FIG. 12 is a timing chart illustrating the operation of the internal structure of the display panel 2*a*. FIG. 12 illustrates a dot clock signal DCLK indicating the timing of latching DB[0] and DB[1] input to the data driver 10, the outputs D1-D4 and the timing of G1-G4 outputs of the gate driver 20, for a period of two frames.

After latching the input DB[0] and DB[1] at the timing of DCLK, the data driver 10 performs sampling in accordance with DB in order from D1 to D4, to sequentially output the signals to the data line 11. For example, in the first frame, a potential 203 of the gradation level 3 sampled during the period of 1R is output to D1, whereas a potential 200 of the gradation level 0 sampled during the period of 1L is output to D2. The potential 200 of the gradation level 0 sampled during the period of 2R is output to D3, whereas the potential 203 of the gradation level 3 sampled during the period of 2L is output to D4. Subsequently, for the periods from 3R to 8L, potentials sampled in an orderly manner are sequentially output to D1 to D4 in similar manners.

The gate driver 20 sequentially outputs the High level to the gate line 21 in order from G1 to G4. In the period of High level, the sampled potential of the data line 11 is sequentially applied to the pixel electrode 6 through the TFT 5 connected to the gate line 21, so that predetermined image signals are written into subpixels.

In FIG. 12, since DC driving of an electric optical element such as liquid crystal shortens the life duration thereof, AC driving is employed by inverting polarities with Vcom set as the center for each frame unit. For example, the potential sampled during the period of 1R is the potential 203 in the first frame, whereas it is the potential 303 in the second frame. Furthermore, the inversion of polarities for each frame unit alone may cause flickering to easily be recognized if the frame frequency is low. Thus, the polarities are inverted also at the timing corresponding to each row direction of the display panel 2*a* in order to prevent flickering from being visually recognized. For example, in the first frame, the potential 203 sampled during period of 1R and the potential 303 sampled during period of 3R are, though they are at the same gradation level 3, inverted for their polarization with Vcom set as the center. Likewise, at the gradation level 0, the output to D2 after sampled during the period of 1L has the potential 200, whereas the output to D2 after sampled during the period of 3L has the potential 300.

The other AC driving includes a mode in which the polarity is inverted in the column direction or a mode in which the polarity is inverted for each subpixel. By the use of the technique above described, in either mode of inversion, the timing of rise and fall between data outputs is shifted one from another, to disperse the influence of the distortion on GND in the time axis direction. This produces an effect of suppressing a drive load as well as a noise affecting the display quality.

The configuration and operation of Example 1 are the same as those in Embodiment 1 except for the differences described above, and thus the description thereof will not be repeated here.

While the display panel 2*a* used in the display apparatus according to Example 1 of the present disclosure includes subpixels arranged in a matrix of four rows and four columns for merely simplifying the illustration, this will not limit in any way the number of pixels. Furthermore, each of DA1, DA2 and DB is described as a digital signal composed of two bits for the sake of convenience, which however is not intended to limit the number of bits of a digital signal.

Example 2

Figure 13:
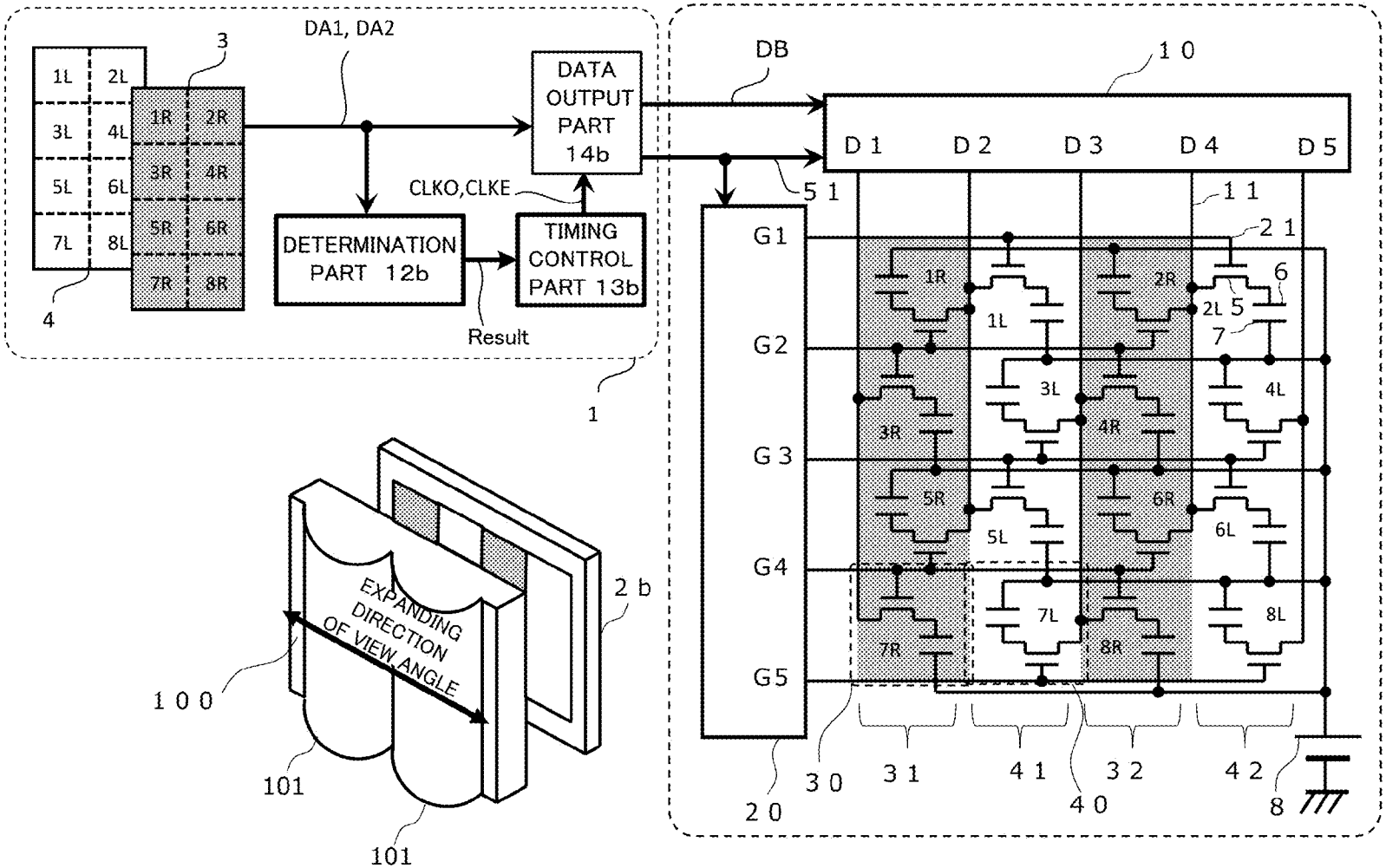
FIG. 13 is a block diagram illustrating the overall configuration of a display apparatus according to Example 2.

FIG. 13 illustrates a schematic view of a display apparatus according to Example 2. A display panel 2*b* of a display apparatus in FIG. 13 includes pixel groups constituted by first subpixels 30 and second subpixels 40 that are alternately aligned in the row direction in order of 31, 41, 32 and 42. The display panel 2*b* is different from the display panel 2*a* in FIG. 11 in terms of connection between each TFT 5 and the data line 11 or the gate line 21. Moreover, the outputs of the data driver 10 are D1-D5, and the outputs of the gate drivers 20 are G1-G5, which are increased compared with Example 1, and the numbers of the data lines 11 and the gate lines 21 are also increased accordingly.

Here, the regularity for the gate line 21, the first subpixel 30 and the second subpixel 40 is described. At the output of the gate driver 20, the TFTs 5 of the second subpixels 40 that are adjacent to each other in the column direction, such as 3L and 5L, are connected to the gate line 21 selected by G1, G3 and G5. To the gate line 21 selected by G2 and G4, the TFTs 5 of the first subpixels 30 that are adjacent to each other in the column direction, such as 1R and 3R, are connected.

FIG. 14 is a table summarizing the relationship between the outputs G1-G5 of the gate driver 20 in the display panel 2*b*, the outputs D1-D5 of the data driver 10, and each subpixel connected to any one of the gate line 21 selected based on the outputs G1-G5 and any one of the data lines 11 to which potential is supplied based on the outputs D1-D5. FIG. 14 illustrates the first subpixels 30 of 1R-8R and the second subpixels 40 of 1L-8L. It is noted that no subpixel for supplying potential is present on the data line 11 connected to D1 of the data driver 10 when the gate line 21 connected to G1 of the gate driver 20 is selected. Such absent subpixels are indicated as Null in FIG. 14.

In the signal processing unit 1 according to Example 2, DA1 which is an image signal of the first pattern 3 and DA2 which is an image signal of the second pattern 4 are input to the determination part 12*b* as G1 to G5 illustrated in FIG. 14 are input alternately by the row unit.

Figure 15:
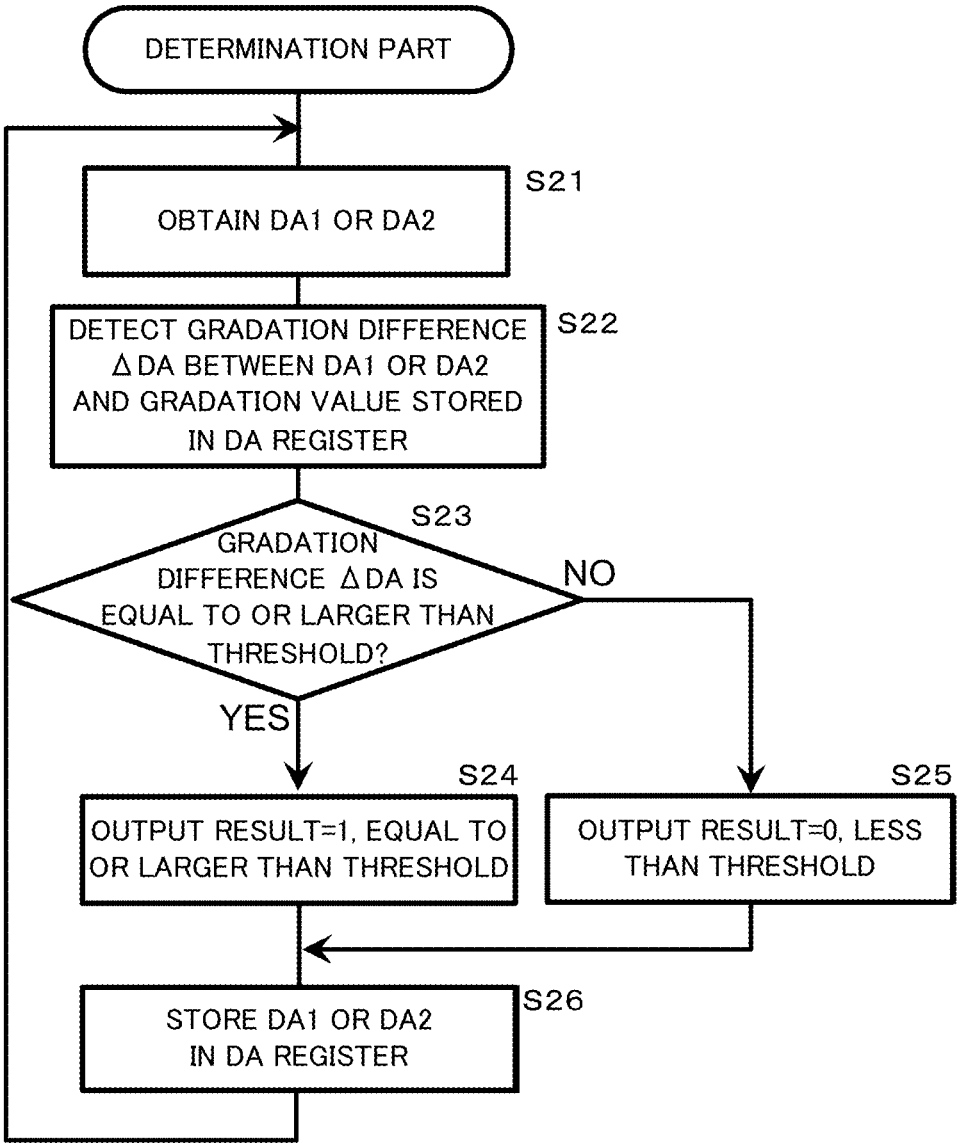
FIG. 15 is a flowchart illustrating the operation of a determination part according to Example 2.

Based on the gradation values corresponding to the first subpixels 30 adjacent to each other in the column direction or the second subpixels 40 adjacent to each other in the column direction, the determination part 12*b* determines whether or not the gradation difference ΔDA is equal to or larger than a threshold. FIG. 15 is a flowchart illustrating the operation of the determination part 12*b*. The determination part 12*b* obtains DA1 or DA2 (S21). The determination part 12*b* detects the gradation difference ΔDA between DA1 or DA2 input to the determination part 12*b* and the gradation value stored in a DA register which will be described later (S22), and determines whether or not the gradation difference ΔDA is equal to or larger than a threshold (S23). If the determination part 12*b* determines that the gradation difference ΔDA is equal to or larger than the threshold (S23: YES), the determination part 12*b* set 1 to a determination result Result and output Result to the timing control part 13 (S24). If the determination part 12*b* determines that the gradation difference ΔDA is lower than the threshold (S23: NO), the determination part 12*b* set 0 to the determination result Result and output Result to the timing control part 13 (S25). That is, the determination part 12*b* outputs Result in accordance with the determination result. After outputting Result, the determination part 12*b* writes the gradation value into the DA register which temporarily stores gradation values therein (S26), and returns the processing to step S21. Unless the gradation value is overwritten, the DA register holds and thus uses the gradation value to detect the gradation difference ΔDA from the gradation value corresponding to an adjacent subpixel in the column direction which is to be obtained next.

Moreover, the timing control part 13*b* and the data output part 14*b* operate differently from those in Embodiment 1 so as to correspond to the relationship illustrated in FIG. 14.

Figure 16:
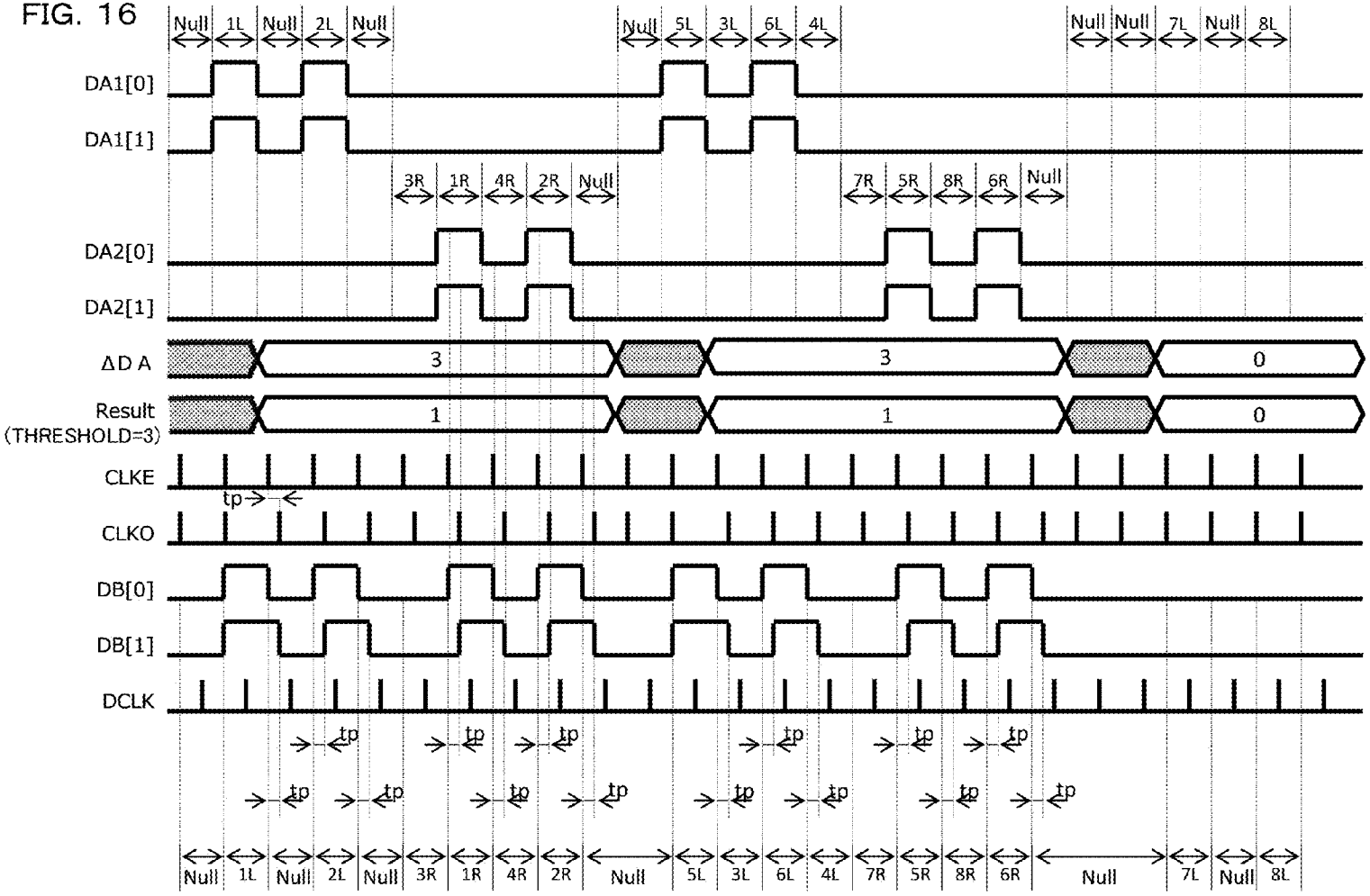
FIG. 16 is a timing chart illustrating an example of the operation of a signal processing unit according to Example 2.

FIG. 16 is a timing chart illustrating the operation of the signal processing unit 1 including the determination part 12*b* and the timing control part 13*b*. As the four gradation levels represented by 0-3 are displayed in horizontal stripes including the repetition of 3 and 0, the values 3, 3, 0, 0, 3, 3, 0 and 0 are set for the first pattern 3 in order from 1R to 8R. Moreover, for the second pattern 4, in order from 1L to 8L, the values 3, 3, 0, 0, 3, 3, 0 and 0 are set. It is noted that 0 is set as a dummy for the gradation value corresponding to Null. DA1 and DA2 in FIG. 16 indicate the gradation values of 0 to 3 by digital signals of two bits of $(00)_2$ to $(11)_2$, with the High level being $(1)_2$ and the Low level being $(0)_2$.

DA1 and DA2 are input to the determination part 12*b* as in G1 to G5 illustrated in FIG. 14 are input alternately by the row unit. First, in the row of G1 in FIG. 14, Null, 1L, Null, 2L and Null, indicated for D1 to D5, are input in sequence to the determination part 12*b*. The detected gradation difference ΔDA is 3 because it is the gradation difference between 1L and Null, and the gradation difference between 2L and Null.

Next, in the row of G2 illustrated in FIG. 14, 3R, 1R, 4R, 2R and Null, indicated for D1 to D5, are input in sequence to the determination part 12*b*. The detected gradation difference ΔDA is 3 because it is the gradation difference between 1R and 3R, and the gradation difference between 2R and 4R.

Subsequently, in a similar manner, the gradation values are input to the determination part 12*b* so as to correspond to the order indicated by D1 to D5, in the G3 to G5 rows in FIG. 14. As for the gradation difference ΔDA to be detected, the value 3 is applied to the gradation difference between 3L and 5L, the gradation difference between 4L and 6L, the gradation difference between 5R and 7R as well as the gradation difference between 6R and 8R, while 0 is applied to the gradation difference between Null and 7L as well as the gradation difference between 8L and Null. The determination result Result in FIG. 16 is obtained when the threshold is set as 3, which is determined as 1 at the gradation difference ΔDA of 3 and 0 at the gradation difference ΔDA of 0.

At the timing control part 13*b*, as in Embodiment 1, in the period during which the determination result Result is 1, CLKE and CLKO have a phase difference tp generated by the phase shift processing. In the period where the determination result Result is 0, no phase shift processing is performed so that there is no phase difference between CLKE and CLKO. In Example 2, CLKE and CLKO have the same cycles as those of DA1 and DA2.

At the data output part 14*b*, DA1 and DA2 are latched to DB. To latch the signals to DB, CLKE and CLKO are used to alternately latch DA1 and DA2 so as to correspond to the respective row units of G1 to G5 illustrated in FIG. 14, as in the case of input to a timing input part. Since CLKE and CLKO that are controlled for the phase difference tp are used for latching of DB, DB may also be provided with the phase difference tp.

As described above, also in the display panel 2*b* with a connection between each TFT 5 and the data line 11 or the gate line 21 different from that in Example 1, the gradation difference ΔDA may be detected based on the first subpixels 30 adjacent to each other in the column direction or the second subpixels 40 adjacent to each other in the column direction. Accordingly, as in Embodiment 1, the phase difference tp for DB may be controlled, producing such an effect that the distortion affecting GND is dispersed in the time axis direction.

Figure 17:
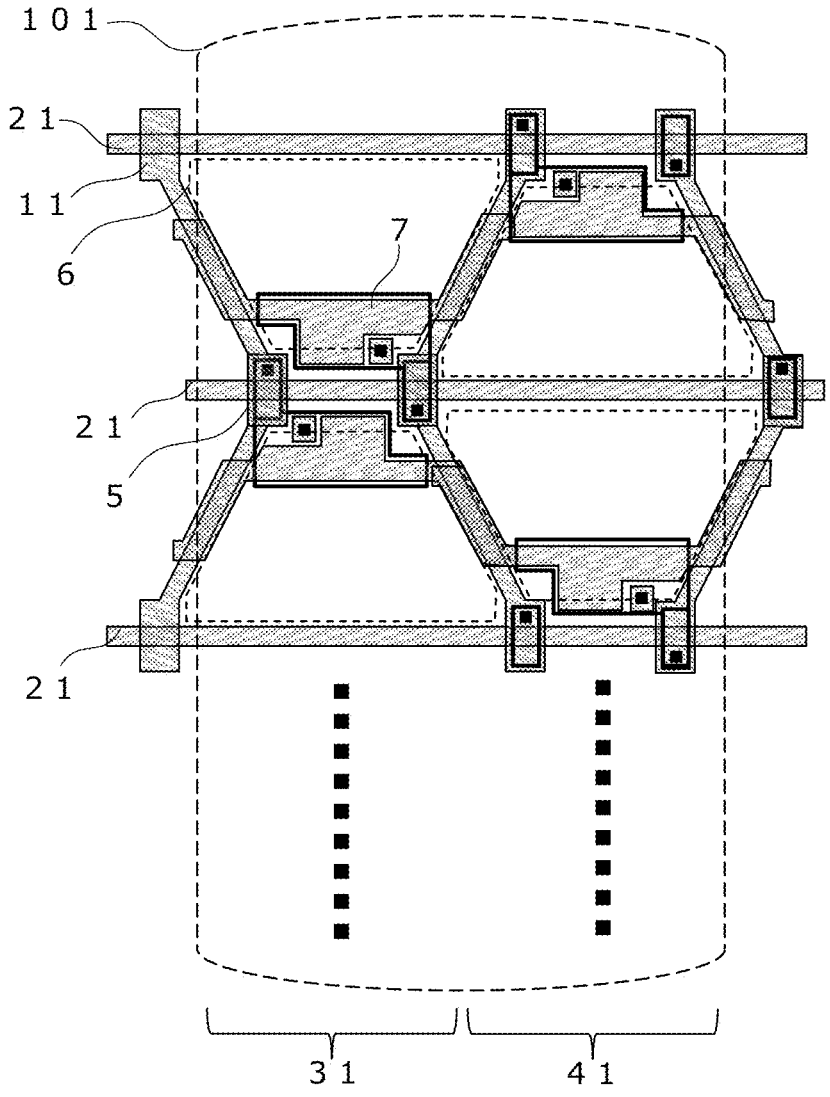
FIG. 17 is a plan view illustrating a pixel layout of a display panel according to Example 2.

The connection between the data line 11 or gate line 21 and TFT 5 schematically illustrated in FIG. 13 has an effect of increasing the aperture rate in a practical pixel layout. FIG. 17 illustrates an example of a pixel layout. As illustrated in FIG. 17, as the aperture for a unit pixel has the shape of a trapezoid, the stereoscopic optical characteristic (3D cross talk) may be improved. In the case where a trapezoid is employed for the shape of the aperture, the connection between the TFT 5 and the data line 11 or the gate line 21 is made to have relationships as illustrated in the schematic view of FIG. 13, which allows each TFT 5 to be arranged on the shorter side of each trapezoid. This can increase the aperture rate compared to the connection between the TFT 5 and wirings in Example 1.

The configuration and operation of Example 2 are the same as those in Embodiment 1 except for the differences described above, and thus the description thereof will not be repeated here.

As in Embodiment 1, such an effect is produced that the distortion affecting GND is dispersed in the time axis direction. Furthermore, as the pixel layout illustrated in FIG. 17 may be employed, such effects may be produced that the aperture rate is increased while the display quality is enhanced.

Example 3

Figure 18:
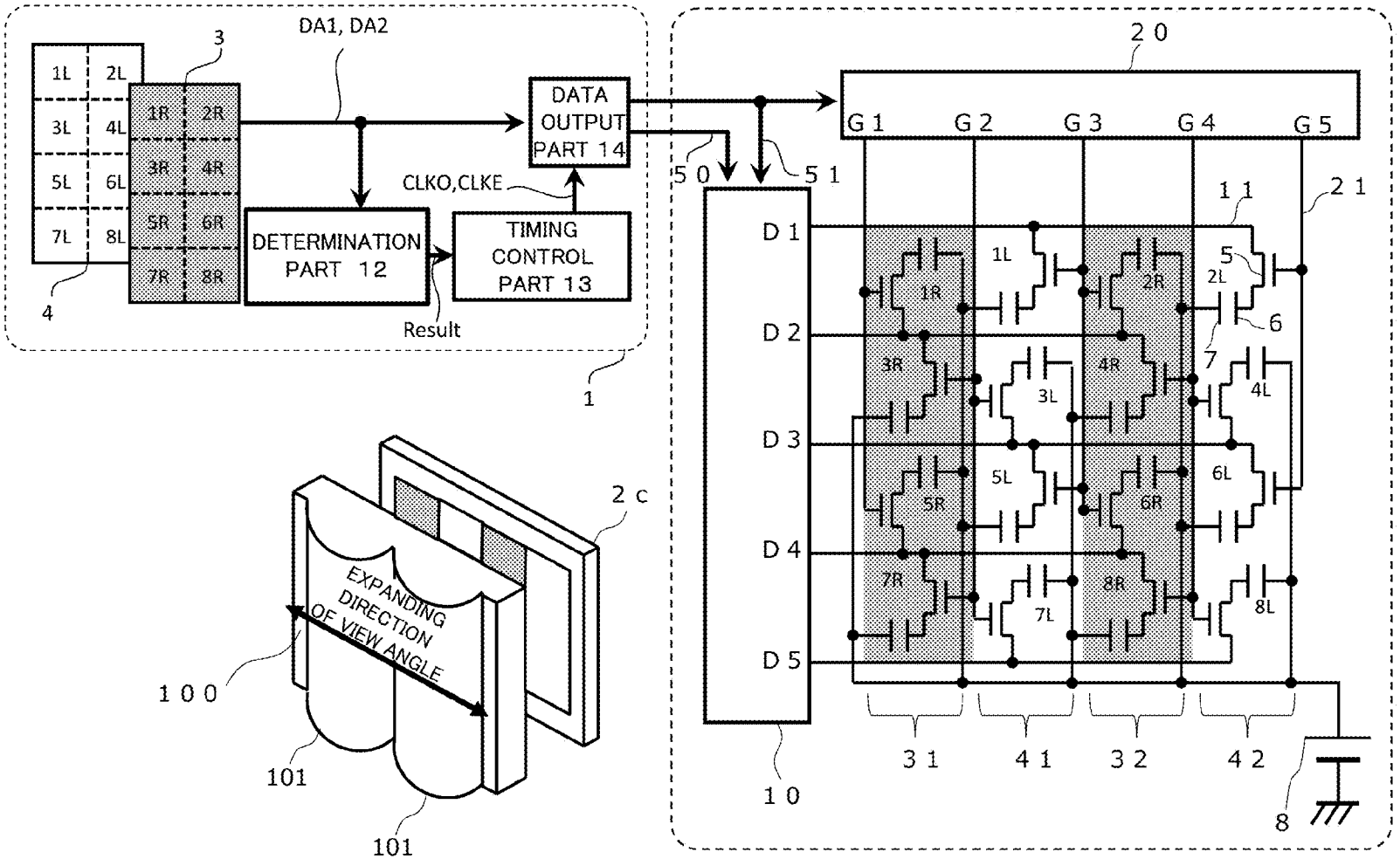
FIG. 18 is a block diagram illustrating the overall configuration of a display apparatus according to Example 3.

FIG. 18 illustrates a schematic view of a display apparatus according to Example 3. In the display panel 2*c* of the display apparatus in FIG. 18, the pixel groups 31, 41, 32 and 42 are sequentially arranged in the row direction as in the display panel 2*b* in FIG. 13, while the data driver 10 and the gate driver 20 are switched in their positions. The present example is different from Example 1 or 2 in terms of the connection between each TFT 5 and the data line 11 or the gate line 21.

Figure 19:
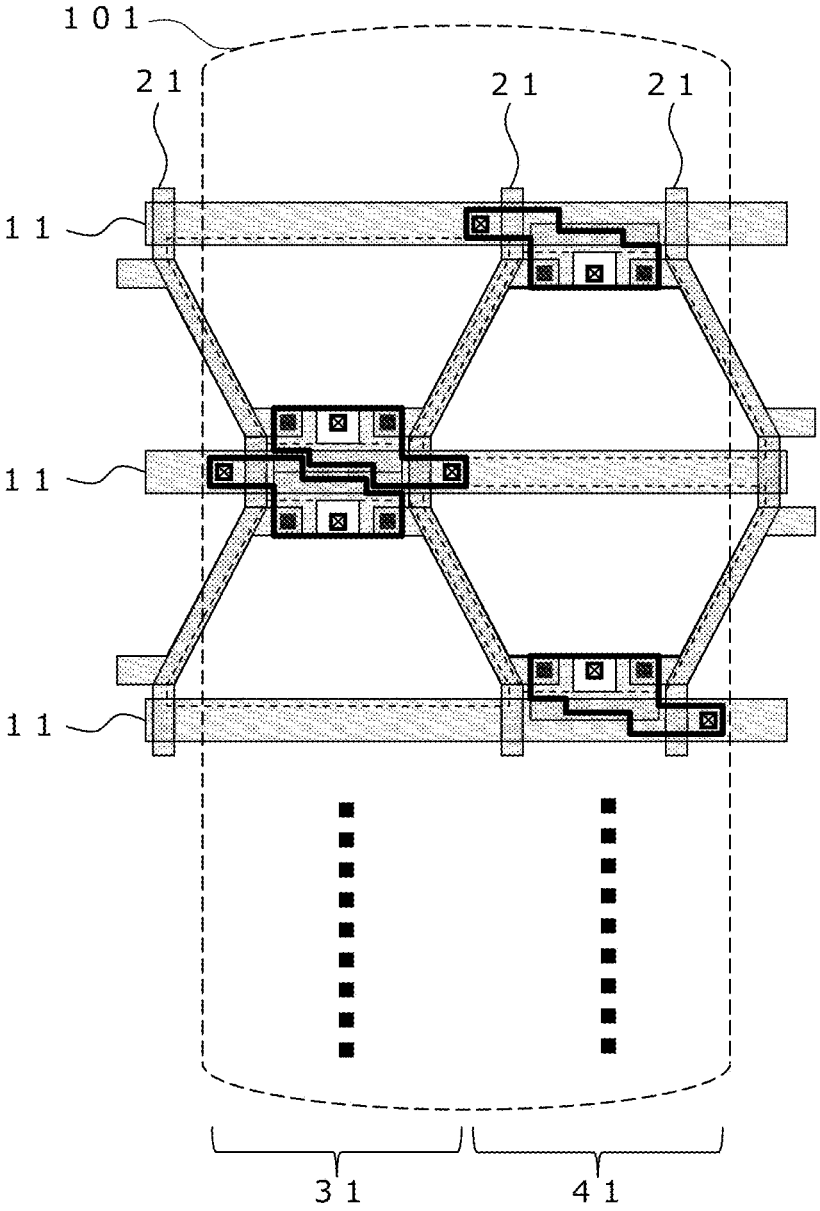
FIG. 19 is a plan view illustrating a pixel layout of a display panel according to Example 3.

The connection between the data line 11 or the gate line 21 and TFT 5 schematically illustrated in FIG. 18 has an effect of increasing the aperture rate in a practical pixel layout, as in Example 2 (FIG. 13). FIG. 19 illustrates an example of a pixel layout.

The configuration and operation of Example 3 are the same as those in Embodiment 1 except for the differences described above, and thus the description thereof will not be repeated here.

As in Embodiment 1, such an effect is produced that the distortion affecting GND is dispersed in the time axis direction. Furthermore, as the pixel layout illustrated in FIG. 19 may be employed, such effects may be produced that the aperture rate is increased while the display quality is enhanced compared to Example 1.

In Example 3, the gate driver 20 is horizontally arranged whereas the data driver 10 is vertically arranged, as illustrated in FIG. 18. A television or the like in general has a screen ratio in which the screen size is longer in the horizontal direction and shorter in the vertical direction, and the recent widening of a screen prompts this horizontally long screen to be more popular. When the data drivers are arranged as described in Example 3, the number of data drivers is reduced compared to the arrangements in Examples 1 and 2. Since a data driver is more expensive than a gate driver, the configuration in Example 3 has an effect of cost reduction compared to Examples 1 and 2.

Comparative Example

Figure 20:
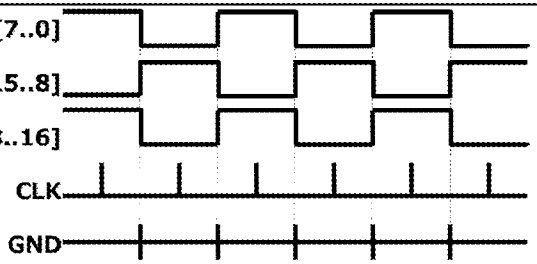
FIG. 20 illustrates a comparison result of the influence by distortion on GND.
Figure 20:
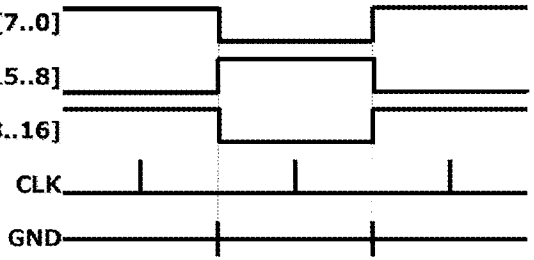
Figure 20:
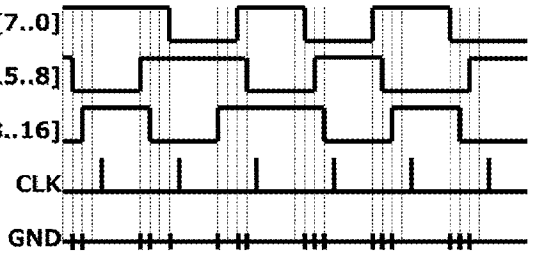

FIG. 20 illustrates a result of comparison for distortion affecting GND in a display apparatus according to Example 1. The illustrated (1) and (2) indicate comparative examples, while (3) indicates Example 1 of the present disclosure.

DB is a coupled image signal of a digital signal composed of 24 bits, which is divided into three groups (three 8-bit digital signals of DB[0]-[7], DB[8]-[15] and DB[16]-DB[23]), and CLK indicates a data coupling clock signal for latching DB.

For the three groups of DB, in the display panel 2*c* illustrated in FIG. 18, the potentials output from D1 and D4 of the data driver 10 correspond to DB[0]-DB[7], the potentials output from D2 and D5 correspond to DB[8]-DB[15], and the potentials output from D3 correspond to DB[16]-DB[23].

Figure 21:
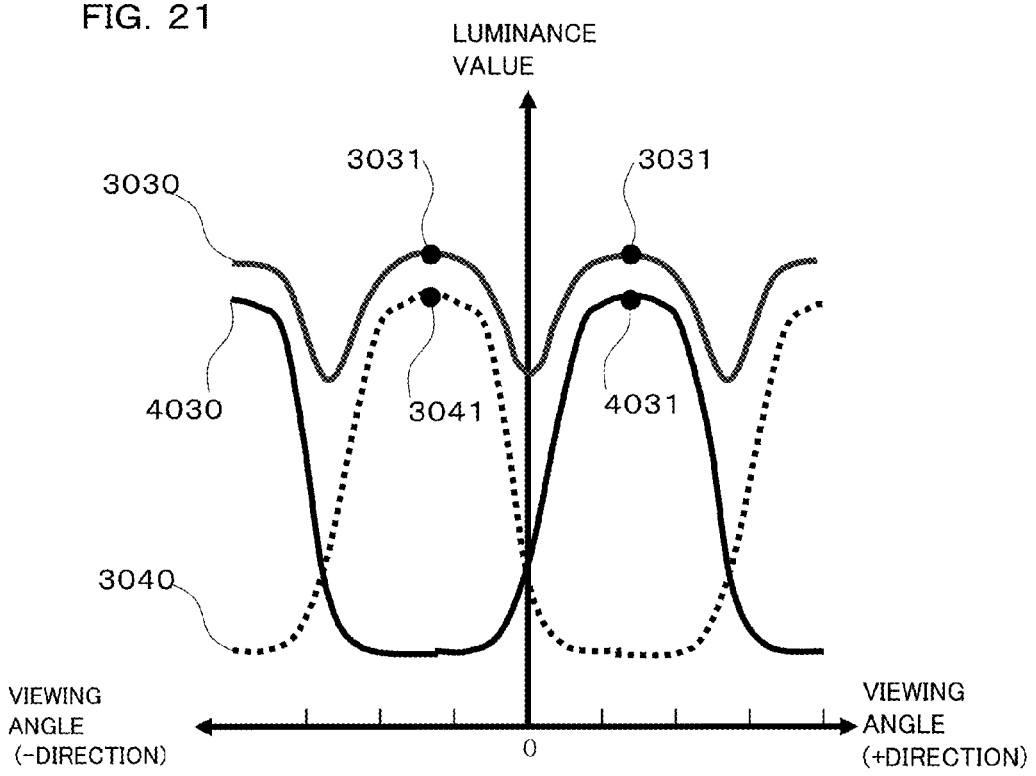
FIG. 21 illustrates an example of a luminance profile for a display panel 2*c*.

FIG. 21 illustrates an example of a luminance profile for the display panel 2*c* according to the present disclosure, in which the vertical axis represents the luminance whereas the horizontal axis represents the viewing angle. The viewing angle on the horizontal axis is obtained in the expanding direction of the viewing angle illustrated in FIG. 18 with the display center of the display panel 2*c* being set as 0, which is obtained by switching the display between the first pattern 3 and the second pattern 4. In FIG. 21, a luminance profile 3030 in the case where white is displayed for the first pattern 3 and the second pattern 4 is plotted as well as a luminance profile 3040 in the case where white is displayed for the first pattern 3 whereas black is displayed for the second pattern 4. Moreover, in FIG. 21, a luminance profile 4030 in the case where black is displayed for the first pattern 3 whereas white is displayed for the second pattern 4 is also plotted. Furthermore, FIG. 21 indicates the peak value of the luminance values in the luminance profile 3030 as 3031, and similarly indicates the peak value of the luminance values in the luminance profile 3040 as 3041, and the peak value of the luminance values in the luminance profile 4030 as 4031.

In FIG. 20, as items to be evaluated, the variation rate with respect to the reference voltage of a negative power supply of the display panel 2*c* appearing as the influence of distortion on GND described above, and the variation rate in the luminance profile which is obtained from the rate of the difference between the luminance peak value 3031 and the luminance peak value 3041 to the luminance peak value 3031 are set.

The rate of variation in the negative power supply caused by distortion in GND is large, i.e. 2%, in the case of (1) in FIG. 20 with no phase difference among three groups of DB. By comparison, in the example of (2) in FIG. 20 with the drive frequency being reduced in half without a phase difference, the distortion on GND is dispersed in the time axis direction, so that the variation rate of the negative power supply is suppressed compared with (1) in FIG. 20 to 0.06%, showing the effect that the drive frequency is reduced to half. In (3) in FIG. 20 with the phase differences applied among the three groups of DB, the amplitude of distortion on GND is reduced in addition to the dispersion of the distortion in the time axis direction, which thus suppresses the variation rate of the negative power supply to 0.04% compared to the case without the phase differences. This further produces an effect similar to or better than the case with the half-reduced drive frequency.

Moreover, the variation rate of the luminance profile is reduced by 20% in the case of (1) in FIG. 20 with no phase difference, while it is alleviated to the reduction of only 8% in the cases of (2) and (3) in FIG. 20 with the half-reduced drive frequency.

As to the operation in Embodiment 1 described above, the following description may be applied.

In the case where certain right eye image data and left eye image data are used, if the difference ΔDA between DA1 and DA 2 that are image signals for the respective data is large enough, the determination result Result of 1 is obtained as described above, and the signals are output as the rise or fall of the bit signals of the coupled image signal DB are not synchronized.

Figure 26:
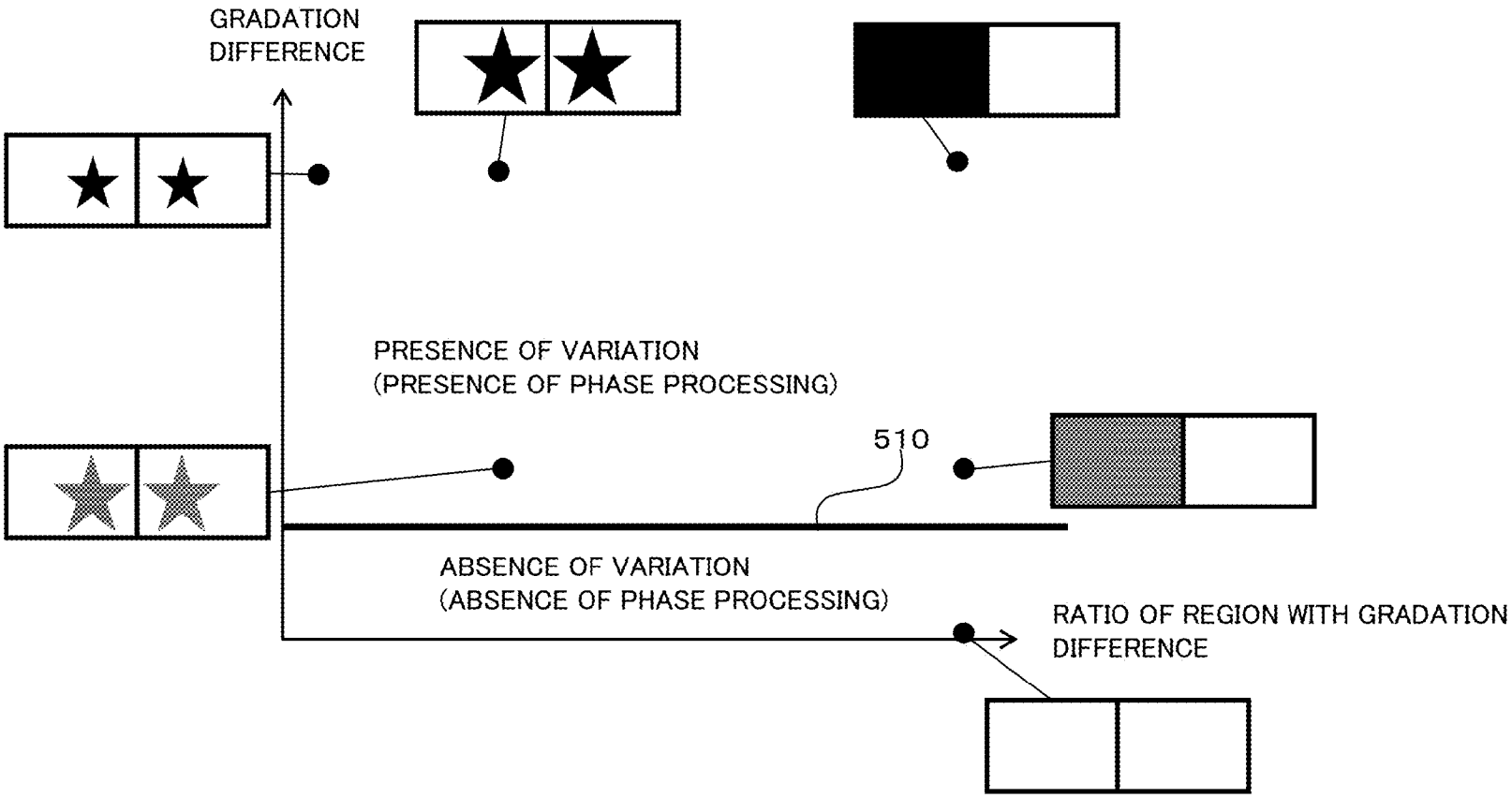
FIG. 26 illustrates an example of a threshold according to Embodiment 1.

For the right eye image data and left eye image data described above, the difference in the maximum gradation values between the respective image signals DA1 and DA2 is modulated in advance to a threshold plot 510 illustrated in FIG. 26 or lower. Accordingly, the determination result Result will be 0, which can synchronize the rise and fall of the bit signals of the coupled image signal DB while being output.

Also in the case where the same image data is used, synchronization or non-synchronization of the rise and fall of the bit signals in the coupled image signal DB may be controlled by only controlling in advance the difference between the maximum gradation values within an image.

As described above, according to Embodiment 1 of the present disclosure, by shifting the timing of fall and rise between data outputs to disperse the influence of distortion on GND in the time axis direction, the effect of suppressing a drive load as well as a noise affecting the display quality may be obtained even if the drive frequency is increased in the display apparatus.

Embodiment 2

In Embodiment 1, the determination part 12 determines, for each pixel, whether the difference between the maximum gradation value of the first pattern 3 (hereinafter referred to as right-eye image data) and that of the second pattern 4 (hereinafter referred to as left-eye image data) is equal to or larger than the threshold. In Embodiment 2, in addition to the determination described above, the ratio of the region having a large difference between gradation values of both of the data is calculated for determination.

FIG. 22 illustrates, in (a) to (f), combination examples of six types of left-eye image data and right-eye image data. Here, as for the numbers described in the columns, the gradation values (indicated by 0-255) are shown in the upper column whereas the occupancy ratio of the gradation value to the entire screen is shown in the lower column. The background image corresponds to the image data used in the background, whereas the object image corresponds to the images of stars used for (d)-(f) in FIG. 22. The stars occupy 25% of the entire screen for (d) and (e), and 10% of the entire screen for (f) in FIG. 22.

Figure 23:
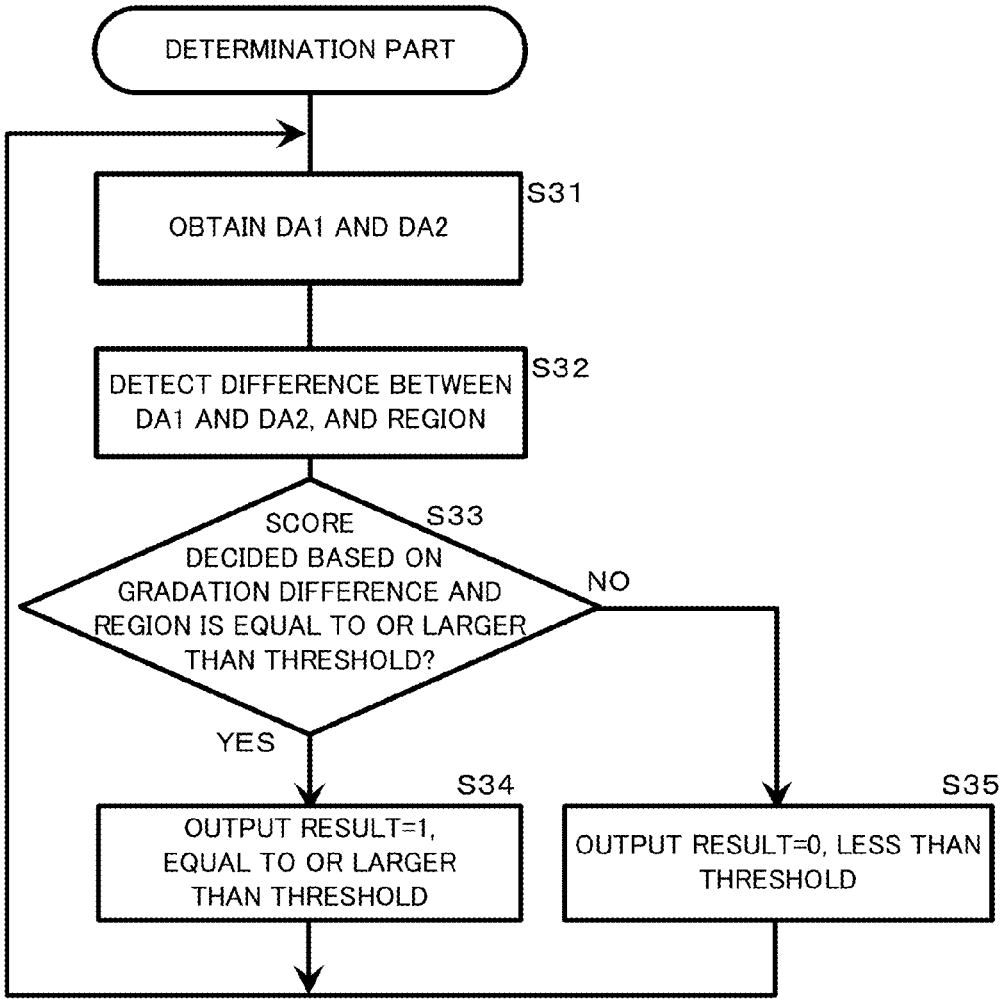
FIG. 23 is a flowchart illustrating the operation of a determination part according to Embodiment 2.

FIG. 23 is a flowchart illustrating the operation of the determination part 12 according to Embodiment 2. The determination part 12 obtains DA1 which is an image signal of the first pattern 3 corresponding to the right-eye image data input to the determination part 12 and DA2 which is an image signal of the second pattern 4 corresponding to the left-eye image data input to the determination part 12 (S31). Subsequently, the determination part 12 detects the difference ΔDA between DA1 and DA2 and its region A(ΔDA) (S32), and determines whether or not a score decided based on ΔDA and A(ΔDA), as a function of the detected ΔDA and A(ΔDA), is equal to or larger than a preset threshold (S33). If it is equal to or larger than the threshold (S33: YES), the determination part 12 sets 1 as the determination result Result and outputs Result to the timing control part 13 (S34), and returns the processing to step S31. If otherwise (S33: NO), the determination part 12 sets 0 as the determination result Result and outputs Result to the timing control part 13 (S35), and returns the processing to step S31. It is to be noted that the region A(ΔDA) indicates the region with the gradation value difference ΔDA.

Figure 24:
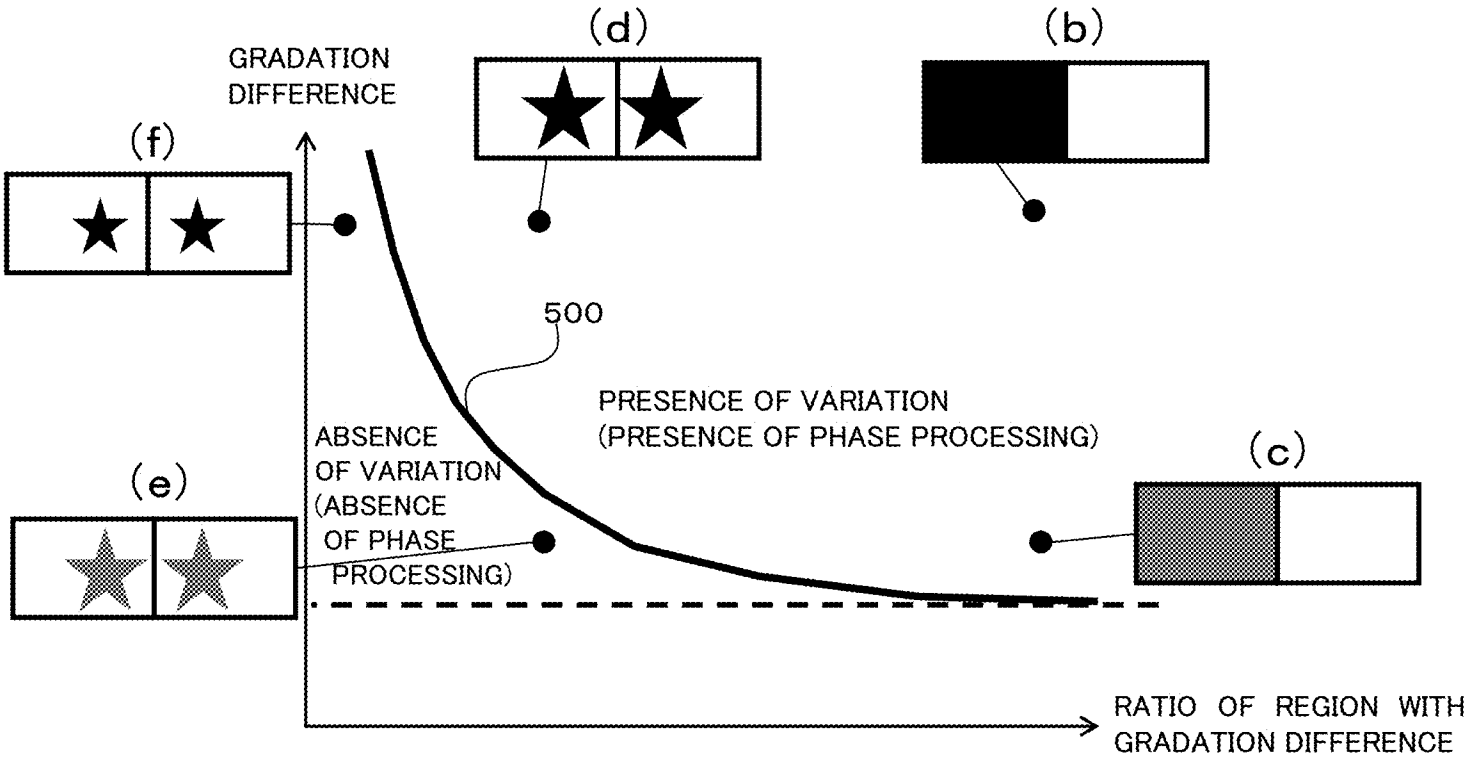
FIG. 24 illustrates an example of a threshold according to Embodiment 2.
Figure 25:
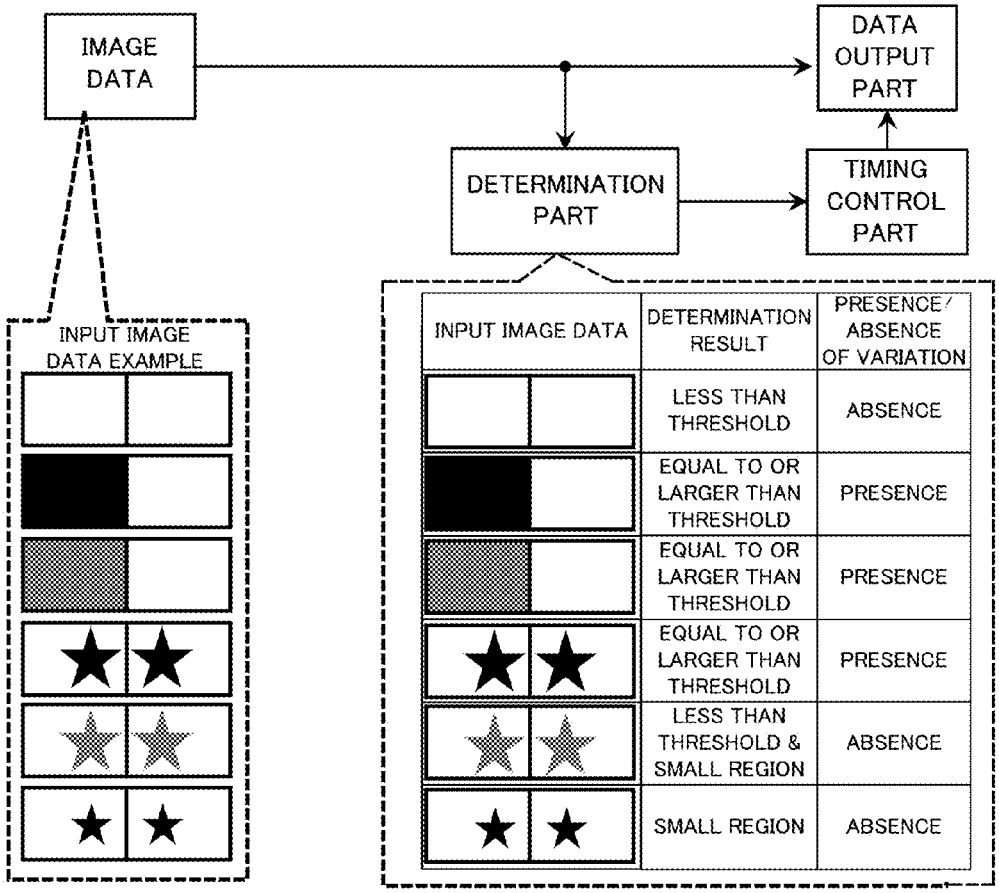
FIG. 25 illustrates a relationship between the threshold and image data according to Embodiment 2.

FIG. 24 illustrates an example of the threshold when the vertical axis represents the gradation difference ΔDA and the horizontal axis represents the region A with the gradation difference ΔDA. Here, the threshold plot 500 indicates a threshold function decided based on the gradation difference and the region. With the use of the threshold function in the image data example illustrated in FIG. 22, after determining that the gradation difference is equal to or larger than the preset threshold, it is then determined whether or not the region is equal to or larger than a predetermined number of subpixels preset in accordance with the gradation difference. Accordingly, as to the threshold plot 500 for example, (b) in FIG. 22 has a large gradation difference and a large region with the gradation difference, (d) in FIG. 22 has a large gradation difference and (c) in FIG. 22 has a large region with the gradation difference. It is therefore determined that (b), (c) and (d) are equal to or larger than the threshold. To the contrary, (f) in FIG. 22 is determined as less than the threshold since it has a large gradation difference but a small region with the gradation difference. Similarly, (e) in FIG. 22 is also determined as less than the threshold, since the gradation difference is small though the region with the gradation difference is at a medium degree. The relationship between the threshold illustrated in FIG. 24 and the image data in FIG. 22 is shown in FIG. 25.

Figure 27:
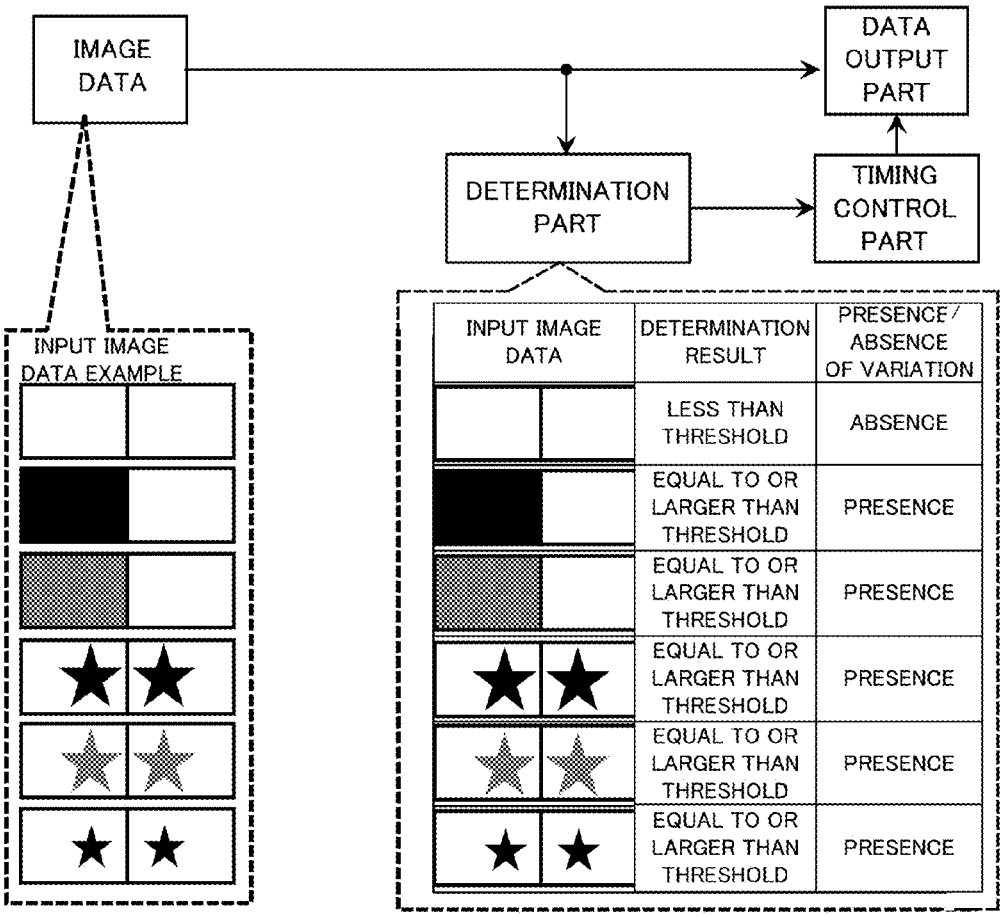
FIG. 27 illustrates a relationship between the threshold and image data according to Embodiment 1.

For the ease of description of the characteristics according to Embodiment 2, an example of the threshold in Embodiment 1 is illustrated in FIG. 24, and the relationship between the threshold illustrated in FIG. 26 and the image data in FIG. 22 is shown in FIG. 27. As illustrated in FIG. 26, the threshold is decided only by the gradation difference, not by the region with the gradation difference. While this has such an advantage that fast determination processing is possible, a determination value of equal to or larger than the threshold is obtained as illustrated in FIG. 27, increasing the appearance rate of the phase shift processing.

By contrast, determination is made based on two parameters of the gradation difference and the region with the gradation difference in Embodiment 2, allowing for detailed determination on the influence of the drive load and thereby suppressing the appearance rate of the phase shift processing to some degree. This can reduce the risk of the occurrence of a data error at the high drive frequency.

Though FIGS. 22 and 24 illustrate the example where only a single gradation difference is used in order to simplify the description, a similar method may be employed also for the image data having multiple gradation differences. For example, regions with multiple gradation differences are plotted for the respective gradation differences, and the value may be determined as equal to or larger than the threshold if any one of the regions exceeds the threshold. Alternatively, the region with gradation difference may be provided with $\alpha \times A(\Delta DA)$ and a weight coefficient $\alpha$ depending on the degree of gradation difference, to obtain the gradation difference region score $S=\Sigma(\alpha \times A(\Delta DA))$ when the image is scanned with one or more lines, and the determination as equal to or larger than the threshold may be made if the region with the gradation difference has a score exceeding a predetermined threshold. In setting of $\alpha$, either one of the linear function and non-linear function may be used for the gradation difference ΔDA.

As to the operation in Embodiment 2 described above, the following description may be applied.

In the case where certain right-eye image data and left-eye image data are used, if the difference ΔDA between DA1 and DA 2 that are image signals for the respective data as well as its region A(ΔDA) are large enough, the determination result Result of 1 is obtained as described above, and the signals are output as the rise or fall of the bit signals of the coupled image signal DB are not synchronized with each other.

For the right-eye image data and left-eye image data described above, the difference in the maximum gradation values between the respective image signals DA1 and DA2 is modulated in advance to a threshold plot 510 or smaller as illustrated in FIG. 26, so that the determination result Result of 0 is obtained and the signals may be output as the rise and fall of the bit signals in the coupled image signal DB are synchronized with one another.

As such, even if the same image data is used, by controlling only the maximum gradation difference within an image in advance, control for synchronizing or not synchronizing the rise and fall of bit signals in the coupled image signal DB may be carried out.

Embodiment 3

In the display apparatus according to Embodiments 1 and 2, parallax images are used for the first pattern 3 (right-eye image data) and the second pattern 4 (left-eye image data), so as to provide an observer with a stereoscopic image. The observer, however, does not always desire to view a stereoscopic image.

Figure 28:
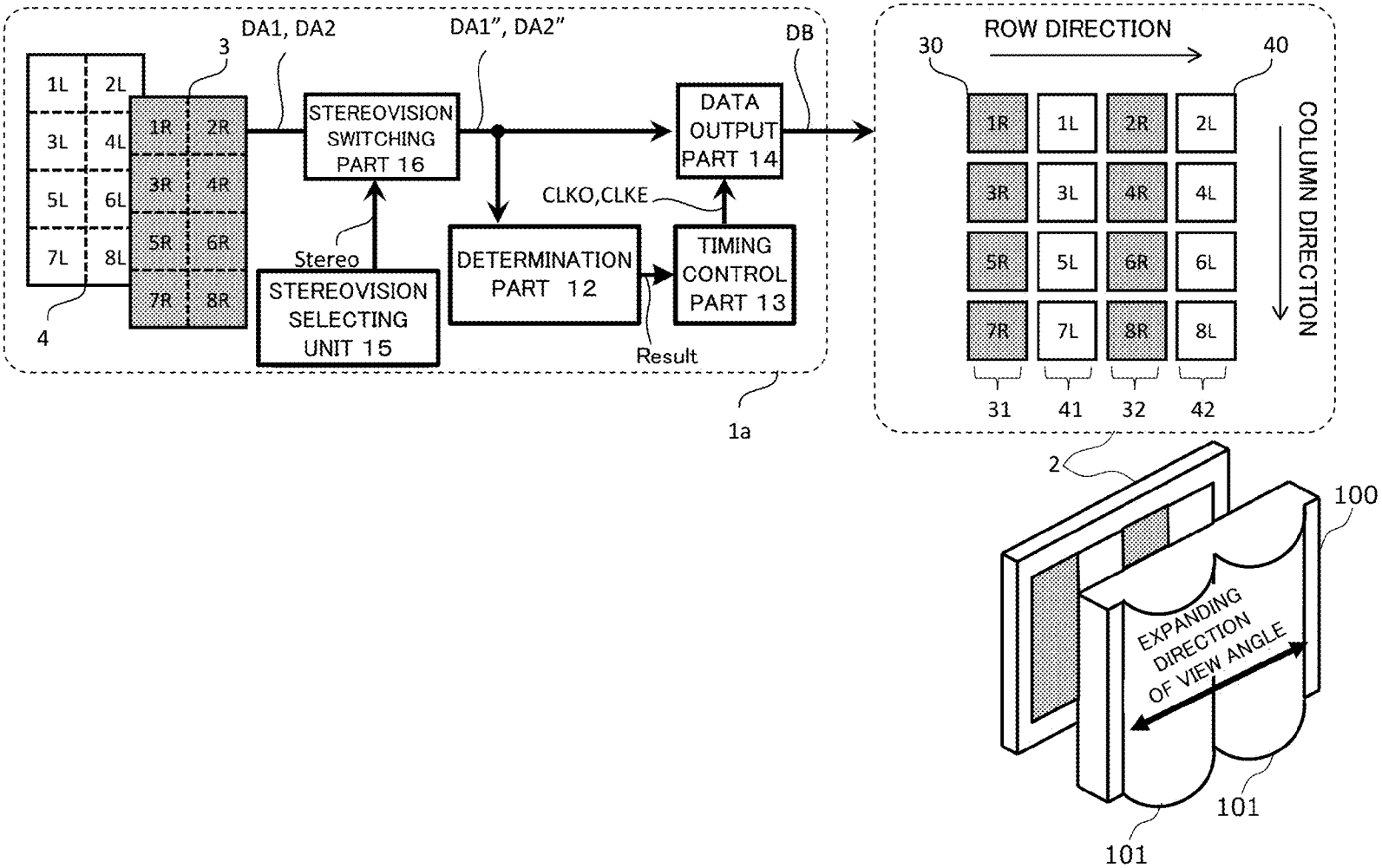
FIG. 28 is a block diagram illustrating the overall configuration of an example of non-limiting a display apparatus according to Embodiment 3.

Embodiment 3 includes such a function that an observer may select whether or not a stereoscopic image is to be viewed. FIG. 28 is a block diagram illustrating the configuration of a display apparatus according to Embodiment 3 of the present disclosure. The display apparatus according to Embodiment 3 comprises a signal processing unit 1*a* and a display panel 2. The signal processing unit 1*a* according to Embodiment 3 is different from that in Embodiment 1, and comprises a stereovision selecting unit 15 and a stereovision switching part 16.

The stereovision selecting unit 15 includes a function of outputting a stereovision selection signal Stereo to the stereovision switching part 16 in accordance with the selection of whether or not an observer is to view a stereoscopic image. The stereovision selection signal is set as "1" (Stereo=1) if the observer selects a stereoscopic view, whereas the stereovision selection signal is set as "0" (Stereo=0) if the observer selects a non-stereoscopic view, and is output to the stereovision switching part 16.

For example, the stereovision selecting unit 15 can be implemented by including an ON/OFF switch to be operated by the observer, who turns the switch ON in the case of stereoscopic viewing and OFF in the case of non-stereoscopic viewing, and configuring a circuit in which the stereovision selection signal is "1" (Stereo=1) during the state of the switch ON and the stereoscopic selection signal is "0" (Stereo=0) during the state of the switch OFF. A push button with lighting may be used for this ON/OFF switch, outputting Stereo=1 as ON when the light is turned on whereas Stereo=0 as OFF when the light is turned off, and ON/OFF may alternately be inverted every time the observer pushes the button.

Furthermore, for example, the stereovision selecting unit 15 may also be implemented by a circuit configured to detect a connection terminal for inputting a signal from the outside and a signal input through the connection terminal, and converting the signal into the stereovision selection signal Stereo in accordance with the detected signal.

The stereovision switching part 16 has a function of outputting the input two image signals DA1 and DA2 simply as two image signals without conversion (DA1"=DA1 and DA2"=DA2). The stereovision switching part 16 also has a function of distributing either one of DA1 and DA2, and outputting two image signals to be output as the same image signal (DA1"=DA1 and DA2"=DA1 or DA1"=DA2 and DA2"=DA2). Furthermore, the stereovision switching part 16 has a function of switching these outputs in accordance with the input stereovision selection signal Stereo. DA1" and DA2" output from the stereovision switching part 16 are input to the determination part 12 and the data output part 14.

Figure 29:
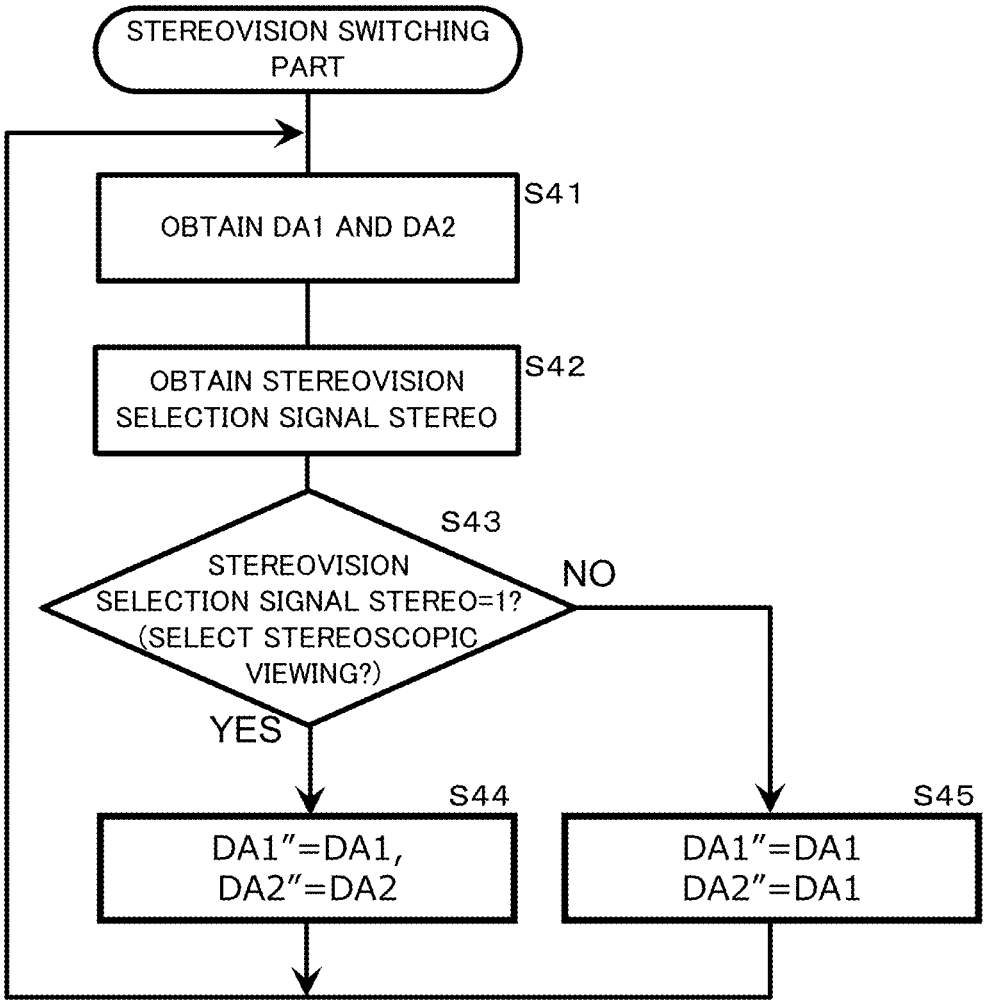
FIG. 29 is a flowchart illustrating the operation of a determination part according to Embodiment 3.

FIG. 29 is a flowchart illustrating the operation of the stereovision switching part 16. The stereovision switching part 16 obtains the image signal DA1 and the image signal DA2 (S41). Subsequently, the stereovision switching part 16 obtains the stereovision selection signal Stereo (S42). The stereovision switching part 16 determines whether or not the stereovision selection signal Stereo is 1 (S43). The stereovision switching part 16 controls the input DA1 and DA2 in accordance with the stereovision selection signal Stereo, and outputs DA1 and DA2. If an observer selects a stereoscopic viewing, i.e. Stereo=1 (S43: YES), the stereovision switching part 16 outputs DA1 as DA1" and DA2 as DA2" (S44). Thereafter, the stereovision switching part 16 returns the processing to step S41. If an observer selects a non-stereoscopic viewing, i.e. Stereo=0 (S43: NO), the stereovision switching part 16 outputs DA1 as DA1" and DA2" such that DA1" and DA2" are the same (S45). Thereafter, the stereovision switching part 16 returns the processing to step S41. It is noted that DA2 may be output as DA1" and DA2", as long as DA1" and DA2" are the same.

Subsequently, as in Embodiment 1, the timing control part 13 in accordance with the determination result of the determination part 12 controls the presence/absence of a phase difference between DB[0] and DB[1] output from the data output part 14.

Figure 30:
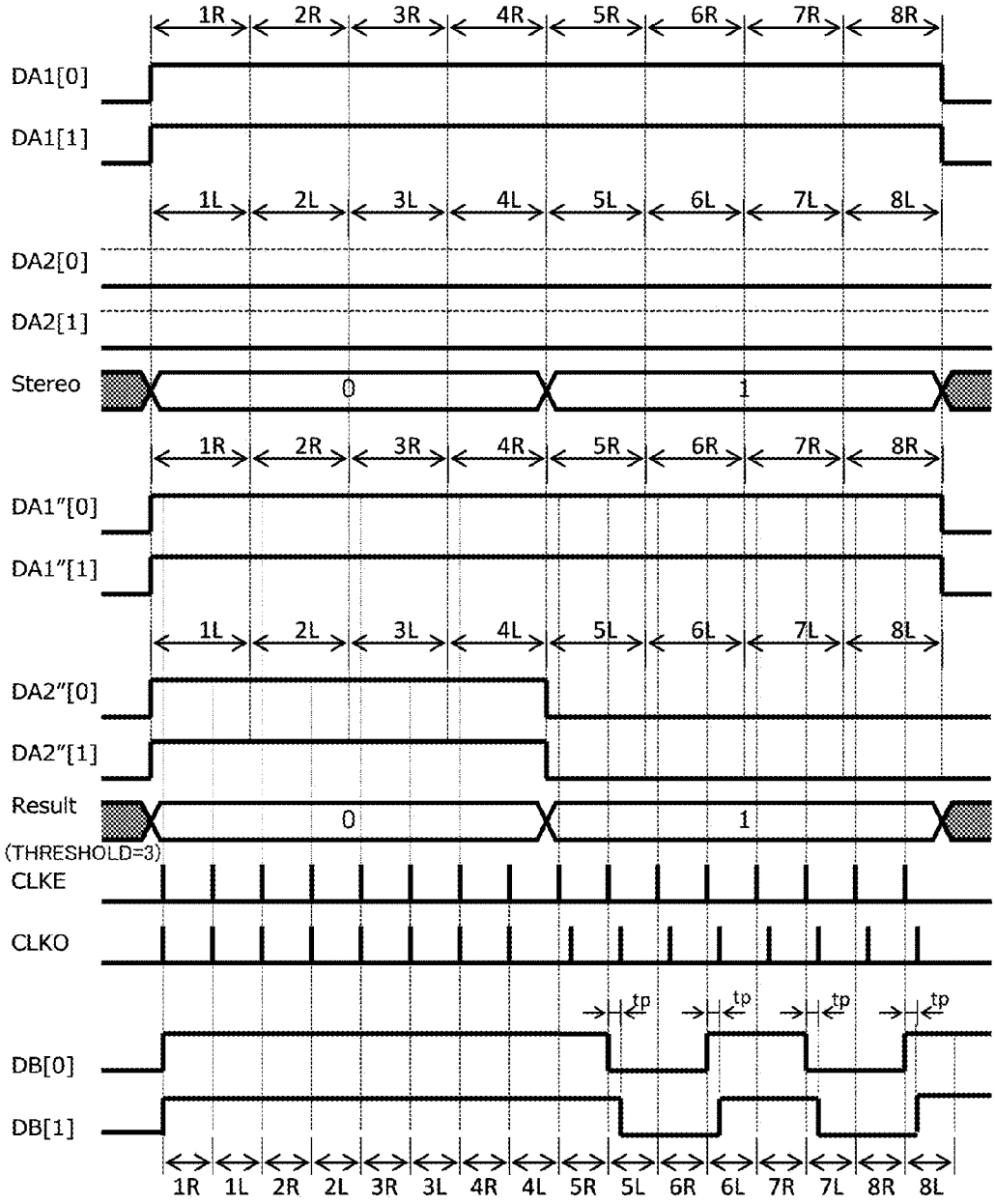
FIG. 30 is a timing chart illustrating an example of the operation of a signal processing unit according to Embodiment 3.

FIG. 30 is a timing chart illustrating the operation of the signal processing unit 1*a* including the stereovision selecting unit 15 and the stereovision switching part 16.

As illustrated in FIG. 30, according to Embodiment 3, as DA1" and DA2" are the same during the period of non-stereoscopic viewing (Stereo=0), no gradation difference is generated, no logical inversion is performed for DB, and no noise associated with the simultaneous switching is generated. In the period of stereoscopic viewing (Stereo=1) during which the gradation difference between DA1" and DA2" is determined as equal to or larger than the threshold (Result=1), such an effect is produced that the distortion affecting GND is dispersed in the time axis direction, since the rise and fall between DB[0] and DB[1] are not synchronized with each other, as in Embodiment 1.

Furthermore, if an observer feels eye fatigue in stereoscopic viewing or is difficult to view a stereoscopic image (e.g., if the observer's eyesight has a large difference between the right eye and the left eye or if the observer is a child who has a distance between the pupils smaller than that of an adult), the observer may interrupt the stereoscopic viewing with the use of the stereovision selecting unit 15.

In order to provide an observer with a stereoscopic image, a video image signal source (CPU, GPU, Blu-ray (registered trademark) player or TV tuner, for example) which can transmit a parallax image to a display apparatus often has a function of adjusting the amount of parallax in general. If the parallax is eliminated by the function of adjusting the amount of parallax, the observer cannot view a stereoscopic image. Thus, the parallax adjusting function may be used as the stereovision switching part 16 illustrated in FIG. 28. The configuration of using a video signal source as a stereovision switching part will be described below.

Figure 31:
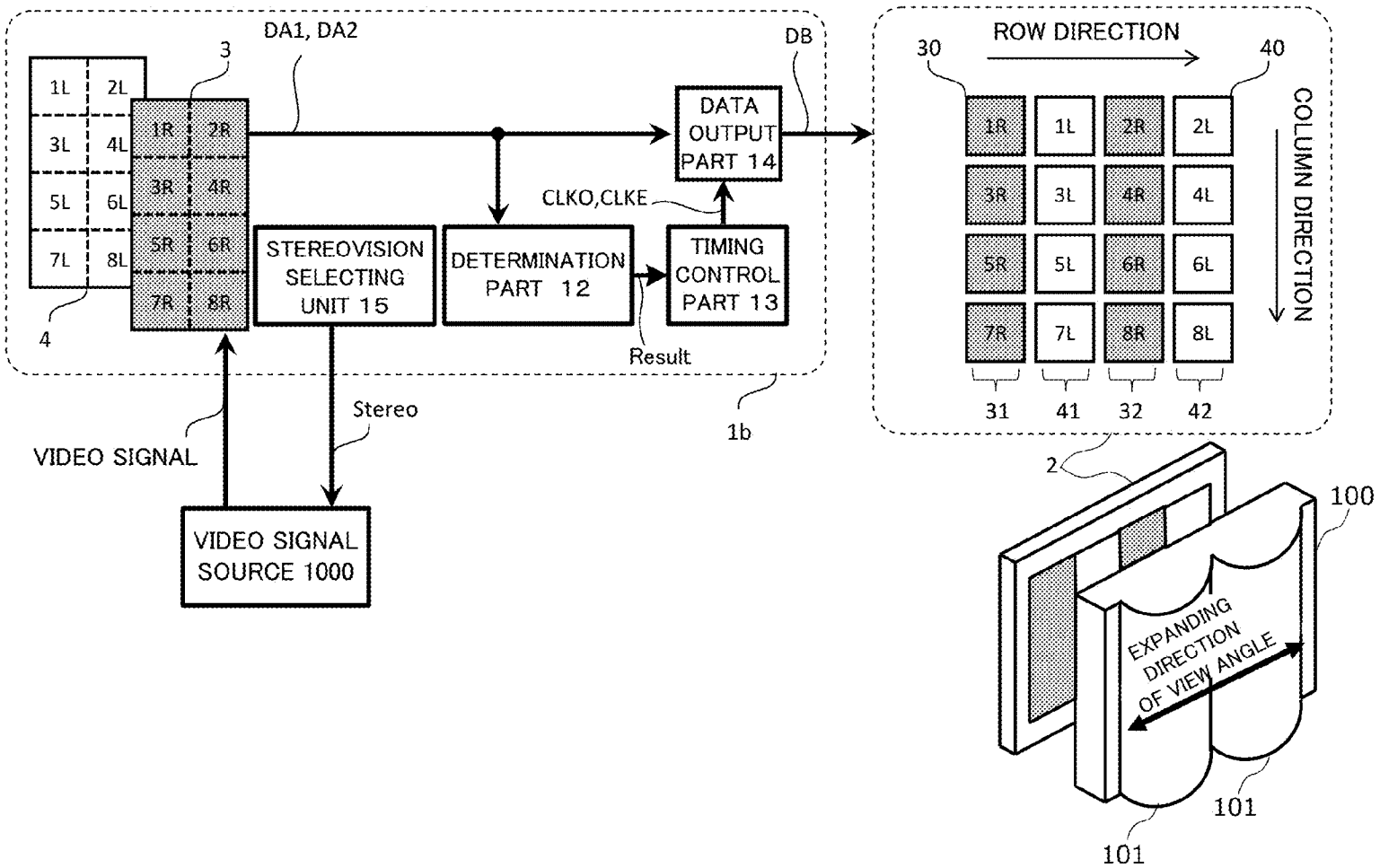
FIG. 31 is a block diagram illustrating another overall configuration of a display apparatus according to Embodiment 3.

FIG. 31 is a block diagram illustrating another configuration of the display apparatus according to Embodiment 3 of the present disclosure. Unlike FIG. 28, instead of the stereovision switching part 16 in the signal processing unit 1*b*, a video signal source 1000 for supplying the first pattern 3 and the second pattern 4 is provided. The stereovision selecting unit 15 outputs the stereovision selection signal Stereo to the video signal source 1000.

If the observer selects stereoscopic viewing (Stereo=1), the video signal source 1000 outputs the first pattern 3 and the second pattern 4 having parallax between them. If the observer selects non-stereoscopic viewing (Stereo=0), the video signal source 1000 outputs the first pattern 3 and the second pattern 4 with no parallax.

For the first pattern 3 and the second pattern 4 output by the video signal source 1000, in the case of 3D rendering in which a pattern with a depth feel is drawn on a flat surface based on a three-dimensional object or light source data, if the observer selects stereoscopic viewing (Stereo=1), the parallax is used for arithmetic operation. Accordingly, the video signal source 1000 outputs the first pattern 3 and the second pattern 4 with parallax between them after drawing. If the observer selects non-stereoscopic viewing (Stereo=0), the video signal source 1000 perform arithmetic operation with the parallax set as 0 and output the first pattern 3 and the second pattern 4 with no parallax after drawing.

Moreover, for example, in the case where the CPU performs arithmetic operation to generate an image with two sets of parallax based on a two-dimensional planar pattern such as image data and depth information data such as depth data, if the observer selects stereoscopic viewing (Stereo=1), the CPU performs the operation using the depth information. Accordingly, the first pattern 3 and the second pattern 4 with parallax between them are drawn and then output. If the observer selects non-stereoscopic viewing (Stereo=0), the CPU performs the operation without the use of the depth information, and outputs the images of the first pattern 3 and the second pattern 4 after drawing, or the two-dimensional planar patterns directly as the first pattern 3 and the second pattern 4.

For example, if the observer selects stereoscopic viewing (Stereo=1), the first pattern 3 and the second pattern 4 are output as they are. If the observer selects non-stereoscopic viewing (Stereo=0), the first pattern 3 is output as the first pattern 3 and a new second pattern 4, or the second pattern 4 is output as a new first pattern 3 and the second pattern 4.

Subsequently, as in Embodiment 1, based on the first pattern 3 and the second pattern 4 input from the video signal source 1000, the image signals DA1 and DA2 are input to the determination part 12. The timing control part 13 controls, in accordance with the determination result of the determination part 12, the presence/absence of a phase difference between DB[0] and DB[1] output from the data output part 14.

Furthermore, in the video signal source 1000, if the selection of non-stereoscopic viewing is made (Stereo=0), either one of the first pattern 3 and the second pattern 4 is generated and distributed to be output as the same pattern, so that a load on the pattern generation in the CPU or GPU may be alleviated.

It is noted that the stereovision selection signal Stereo may be processed using a transmission line for video signals while being included in various other signals superposed thereon and transmitted during a blanking period of video signals. For example, "InfoFrame transmitting 3D information" (meaning that a 3D video image is being transmitted) defined by the HDMI (registered trademark) standard Ver. 1.4, or information indicating the type of 3D mode of a video image, such as Frame Packing or Side-by-Side (Half).

While Embodiment 3 of the present disclosure has been described, the configuration and operation of Embodiment 3 are the same as those in Embodiment 1 except for the differences described above, and thus the description thereof will not be repeated here.

The display panel 2 used in the display apparatus according to Embodiment 3 of the present disclosure is similar to that in Embodiment 1, which is described with subpixels arranged in the matrix of four rows and four columns, while the display panel 2*a* in FIG. 11, the display panel 2*b* in FIG. 13 or the display panel 2*c* in FIG. 18 may also be applied to the display panel 2.

Furthermore, while the gradation difference between DA1" and DA2" is used in the determination part 12 according to Embodiment 3, the determination results, based on calculated the occupancy ratio of the region with a large gradation difference between DA1" and DA2" may be combined together, as described in Embodiment 2. This allows for detailed determination about the influence of the drive load and thereby suppressing the appearance rate of the phase shift processing to some degree. This can reduce the risk of the occurrence of a data error at the high drive frequency described above.

Moreover, while the timing control part 13 according to Embodiment 3 performs processing of varying the phase between CLKE and CLKO, Embodiment 3 is not limited to the variation in the phase. As described with reference to FIGS. 8C and 8D according to Embodiment 1, variation in the pulse width (see FIG. 8C) and variation in the cycle (see FIG. 8D) may be combined with the phase difference. By combining either or all of them with the phase difference, the frequency components constituting noise may be more dispersed, which can further disperse the distortion affecting GND in the time axis direction.

Embodiment 4

While Embodiment 1 described that DB obtained by coupling the first pattern 3 with the second pattern 4 is output to the display panel 2, DB is constituted by two or more clock lines in Embodiment 4.

Figure 32A:
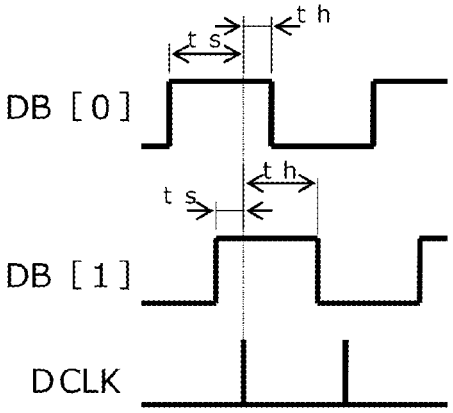
FIG. 32A illustrates an example of the operation of a data output part according to Embodiment 4.
Figure 32B:
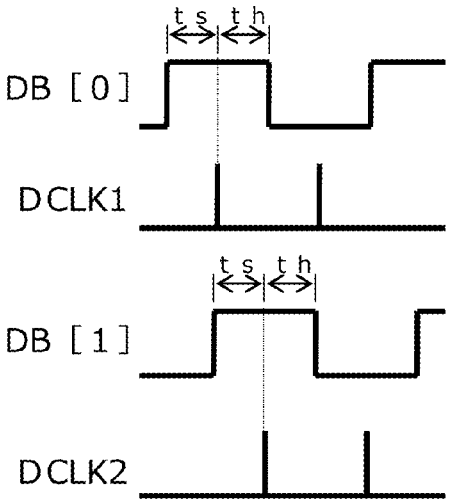
FIG. 32B illustrates an example of the operation of a data output part according to Embodiment 4.

FIGS. 32A and 32B are timing chart illustrating an example where DB is constituted by two clock lines at the data output part 14. In FIG. 32A, as in Embodiment 1, DB[0] and DB[1] are constituted by one clock line. In FIG. 32B, DB[0] and DB[1] according to Embodiment 4 are constituted by two dot clock lines of DCLK 1 and DCLK 2 having different phases.

The configuration and operation of Embodiment 4 are the same as those in Embodiment 1 except for the differences described above, and thus the description thereof will not be repeated here.

In the case where such a process is applied as to have different phases between DBs, as in DB[0] and DB[1], a setup time ts or a hold time th is also different between DBs. For example, in FIG. 32A, DB[0] has a shorter th with respect to DCLK whereas DB[1] has a shorter ts, which may cause a risk of insufficient setup time ts and hold time th necessary at the display panel side if the drive frequency is significantly increased. This also makes it difficult to provide the setup time ts and the hold time th with a margin for accommodating the variation in the operating temperature of the display apparatus, the variation in fabricating of a DB signal path, the influence of noise from the outside and so forth. Thus, a data error may occur.

In Embodiment 4, as illustrated in FIG. 32B, DB[0] and DB[1] in which the phase and cycle are varied are output to the display panel using two dot clock signals with different phases (DCLK1 and DCLK2 in FIG. 32B). Accordingly, even if the drive frequency is significantly increased, the frequency components constituting noise may be dispersed in the time axis direction, while appropriate setup time ts and hold time th may be secured as well as the margin as described above, which can reduce the risk of the occurrence of a data error.

Though two clocks are used in Embodiment 4, more than two clocks may also be used. For example, clocks with different phases may be used for each of 8-bit buses for each of RGB obtained by dividing 24-bit bus constituted by 8 bits of each of RGB.

Embodiment 5

Figure 33A:
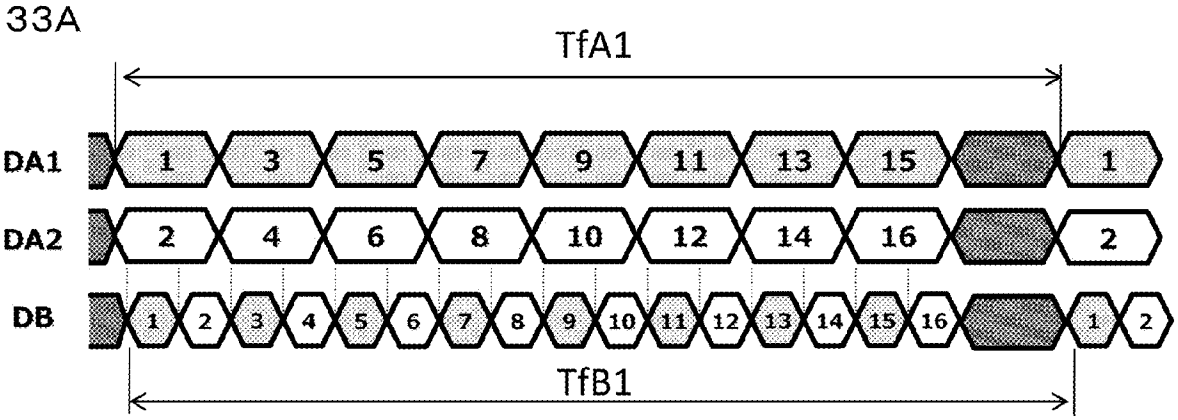
FIG. 33A illustrates an example of the operation of a data output part according to Embodiment 5.
Figure 33B:
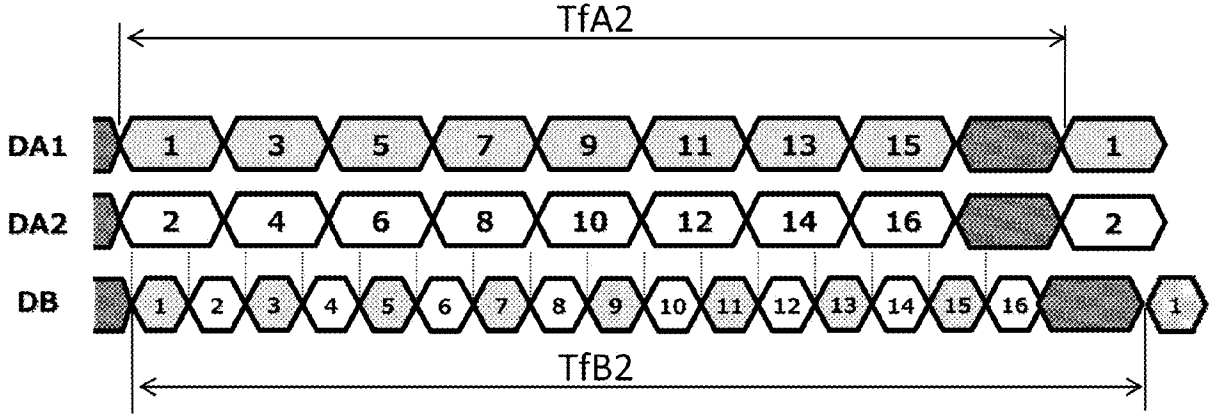
FIG. 33B illustrates an example of the operation of a data output part according to Embodiment 5.

In Embodiment 5, the frequency of DB may be varied at the data output part 14. FIGS. 33A and 33B are timing charts illustrating an example of the data output part 14, in which FIG. 33A represents the case in Embodiment 1 where the frequency is not varied whereas FIG. 33B represents the case in Embodiment 5 where the frequency of DB is varied.

The configuration and operation of Embodiment 5 are the same as those in Embodiment 1 except for the differences described above, and thus the description thereof will not be repeated here.

In FIG. 33A, the relationship between one frame period TfA1 for DA1, DA2 and one frame period TfB1 for DB is represented by TfA1=TfB1. In FIG. 33B, the relationship between one frame period TfA2 for DA1, DA2 and one frame period TfB2 for DB is represented by TfA2<TfB2. This is to further disperse the distortion affecting GND in the time axis direction by the reduction of the drive frequency illustrated in FIG. 20B.

Figure 34A:
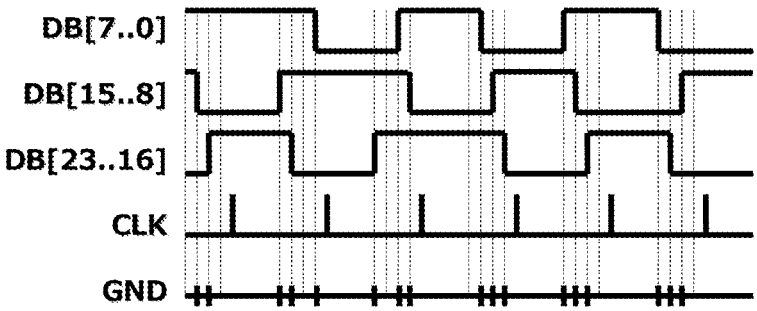
FIG. 34A illustrates variation of DB and distortion of GND according to Embodiment 5.
Figure 34B:
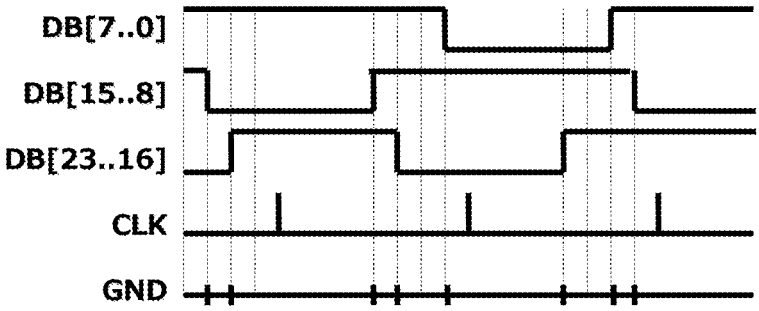
FIG. 34B illustrates variation of DB and distortion of GND according to Embodiment 5.

The effect of Embodiment 5 will be specifically described below with reference to FIGS. 34A and 34B. FIGS. 34A and 34B illustrate variation and distortion on GND in a certain period of DB to be input to the data driver 10, in the case where the first pattern 3 corresponds to black and the second pattern 4 corresponds to white in the display panel 2*c* illustrated in FIG. 18.

DB is constituted by three sets of DBs, including 8 bits of gradation values DB[0]-DB[7] for potentials output from D1 and D4 of the data driver 10, 8 bits of gradation values DB[8]-DB[15] for potentials output from D2 and D5, and 8 bits of gradation values DB[16]-DB[23] for potentials output from D3.

In the display apparatus, assuming that the 8-bit gradation value $(FF)_{16}$ corresponds to white and $(00)_{16}$ corresponds to black, DB[0]-[7] and DB[16]-[23] alternately repeat High and Low whereas DB[8]-[15] alternately repeat Low and High for each CLK cycle. Accordingly, the cycle varies so as to be different for each of the three sets of DBs in addition to the phase difference. FIG. 34A shows a result obtained under the condition of TfA1=TfB1 when TfA1 and TfB1 are both set as 16.67 ms.

It can be seen that the number of generating of distortions on GND during a certain period is reduced in FIG. 34B to which the condition of TfA2<TfB2 with TfB2 being twice as much as TfA2 is applied, and at the same time, the interval of generating of distortion on GND is made longer, compared to FIG. 34A. As an example where the distortion affecting GND is alleviated, the variation rate of the negative power supply is 0.04% under the condition of TfA1=TfB1, while it is further suppressed to 0.01% under the condition of TfA2<TfB2.

As described above, even in the case where the drive frequency of the display apparatus according to the present disclosure is increased and one frame period TfA2 of input image data is significantly shortened, the timing of rise and fall between data outputs may be shifted by the application of Embodiment 5. That is, by further dispersing the distortion affecting GND in the time axis direction, the effect of suppressing a drive load as well as a noise affecting the display quality may be produced. Moreover, by varying the frequency of DB, the margin for the setup time ts and the hold time th as described in Embodiment 4 may more easily be secured.

Embodiment 6

In Embodiment 1, the determination part 12 determines whether or not the gradation difference ΔDA between DA1 and DA2 is equal to or larger than the threshold, and the timing control part 13 in accordance with the determination result of the determination part 12 controls the presence/absence of a phase difference between DB[0] and DB[1] output from the data output part 14. In Embodiment 6, in addition to the determination based on the gradation difference ΔDA, detection is made as to whether the change in DB is for the fall from High to Low or for the rise from Low to High, based on DA1 and DA2. The determination part 12 determines whether or not the detected change corresponds to a predetermined change. The timing control part 13 in accordance with the determination result of the determination part 12 controls the presence/absence of a phase difference between DB[0] and DB[1] output from the data output part 14. In Embodiment 6, the determination and control serve not to synchronize either one of the rise and fall between DB[0] and DB[1].

Generally, an active element such as an IC which handles digital signals performs switching operation. In Embodiments 1 to 4, ideal digital signal waveforms consisting only of two states of ON and OFF in the switching operation are described with reference to the drawings. In practice, however, two more states in the middle between ON and OFF, i.e. the state of transition from OFF to ON and the state of transition from ON to OFF, are present.

Figure 35A:
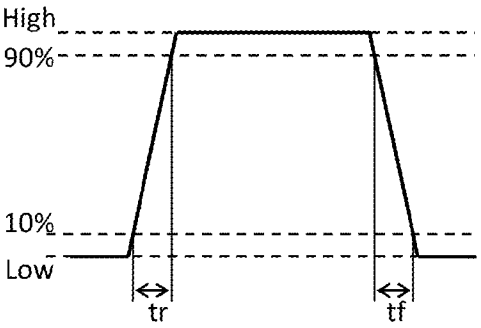
FIG. 35A illustrates an example of digital signal waveforms according to Embodiment 6.
Figure 35B:
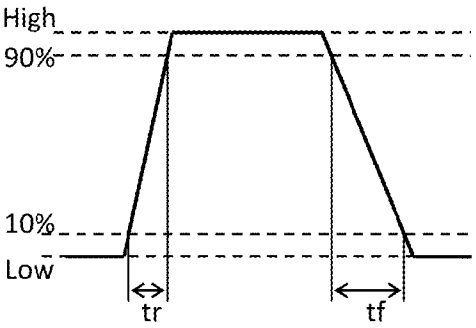
FIG. 35B illustrates an example of digital signal waveforms according to Embodiment 6.
Figure 35C:
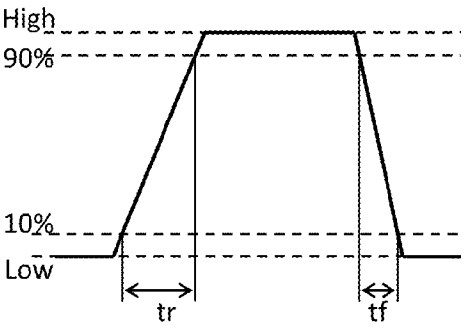
FIG. 35C illustrates an example of digital signal waveforms according to Embodiment 6.

FIGS. 35A, 35B, and 35C illustrate an example of digital signal waveforms including the two intermediate states described above. Each of the digital signals shown in FIGS. 35A, 35B, and 35C represent waveforms switching from Low to High, and back to Low. The digital signal has a rise time tr during which the signal amplitude rises from 10% to 90% when switched from Low to High, and a fall time tf during which the signal amplitude falls from 90% to 10% when switched from High to Low. In the relationship between tr and tf, the digital signal waveforms have three characteristics respectively indicated as FIG. 35A to FIG. 35C.

FIG. 35A corresponds to the condition of tr=tf, showing a horizontally symmetrical trapezoid for the digital signal waveform. On the other hand, each of FIG. 35B corresponding to the condition of tr<tf and FIG. 35C corresponding to the condition of tr>tf shows an asymmetrical trapezoid for the digital signal waveform. As such, compared to the case of the symmetrical trapezoid, in the state of the asymmetrical trapezoid, the margin for the setup time ts and the hold time th cannot be ensured if the same amount of phase difference is provided for the rise time and fall time.

Figure 36A:
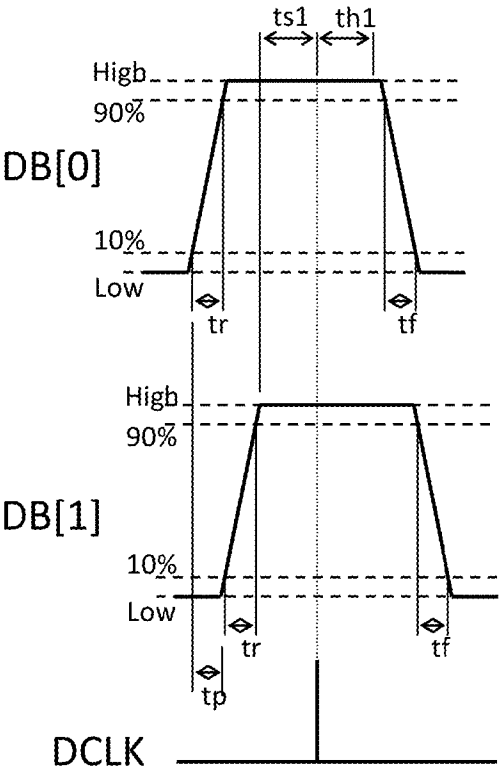
FIG. 36A illustrates an example of a phase difference provided between adjacent DBs according to Embodiment 6.
Figure 36B:
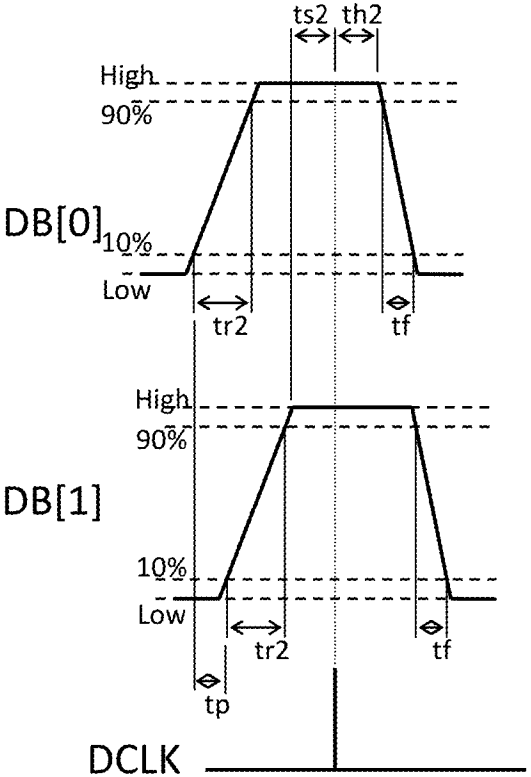
FIG. 36B illustrates an example of a phase difference provided between adjacent DBs according to Embodiment 6.

FIGS. 36A and 36B illustrate the influence of a phase difference on the setup time ts and hold time th for the rise time tr in the cases of tr=rf and tr>tf among the conditions described above.

In the case of FIG. 36A, for the digital signals DB[0] and DB[1] under the condition of tr=tf, the timing control part 13 controls to provide the phase difference tp between DB[0] and DB[1].

In the case of FIG. 36B, for the digital signals DB[0] and DB[1] under the condition of tr2>tf, the timing control part 13 which is the same as that in FIG. 36A controls to provide the phase difference tp between DB[0] and DB[1].

In each of FIG. 36A and FIG. 36B, the timing for DCLK is arranged so that the setup time has the same length as that of the hold time for DB[0]. Compared to the setup time ts1 and hold time th1 in FIG. 36A, the setup time ts2 and hold time th2 in FIG. 36B are shorter.

Figure 36C:
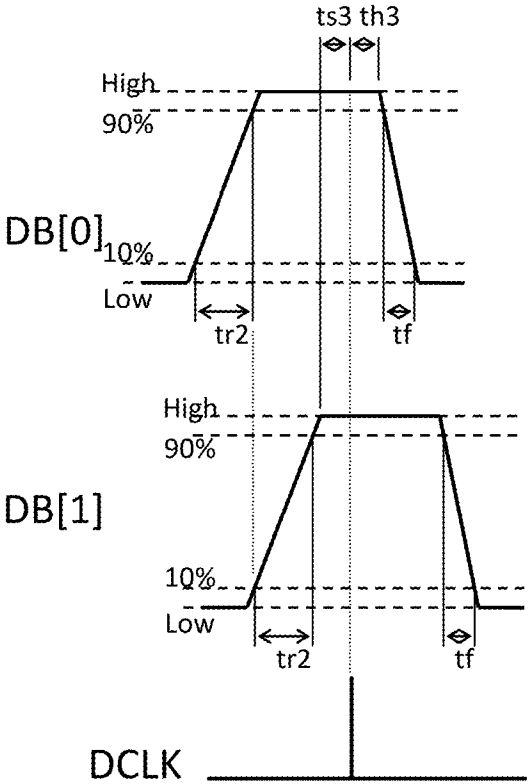
FIG. 36C illustrates an example of a phase difference provided between adjacent DBs according to Embodiment 6.

As in FIG. 36B, FIG. 36C illustrate digital signals DB[0] and DB[1] under the condition of tr2>tf. In order to reduce the simultaneous switching noise causing the distortion on GND, it is desirable to avoid simultaneous switching between DB[0] and DB[1]. Thus, in FIG. 36C, a phase difference equal to that in the rise time tr2 is provided which is larger than the phase difference tp in FIG. 36B. The setup time ts3 and hold time th3 in FIG. 36C are even shorter than ts2 and th2 in FIG. 36B.

Thus, as for DB between the signal processing unit 1 and the display panel 2, the timing control part 13 controls to provide a phase difference only for a shorter one of the rise time tr and the fall time tf, so as to ensure the margin in the setup time and the hold time.

Figure 37:
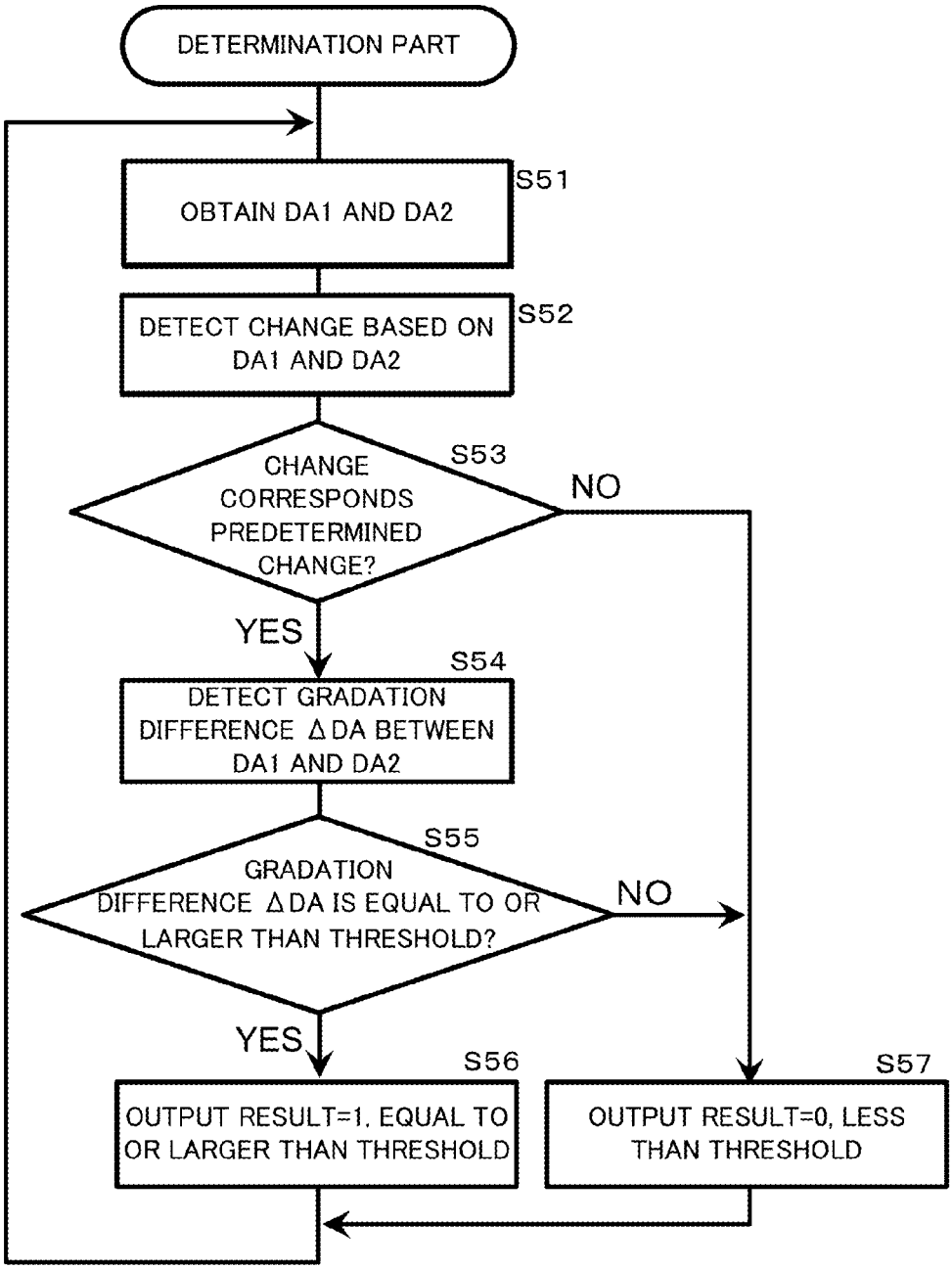
FIG. 37 is a flowchart illustrating the operation of a determination part according to Embodiment 6.

FIG. 37 is a flowchart illustrating the operation of the determination part 12 according to Embodiment 6. The determination part 12 obtains DA1 and DA2 (S51). The determination part 12 detects a change based on DA1 and DA2 input to the determination part 12 (S52). The determination part 12 determines whether or not the detected change corresponds to a predetermined change (S53). If the change corresponds to the predetermined change (S53: YES), the gradation difference ΔDA between DA1 and DA2 is detected (S54). Thereafter, the determination part 12 determines whether or not the gradation difference ΔDA is equal to or larger than a threshold (S55). If the determination part 12 determines the gradation difference ΔDA is as equal to or larger than the threshold (S55: YES), the determination part 12 sets 1 to the determination result Result, outputs Result to the timing control part 13 (S56), and returns the processing to step S51. If the determination part 12*b* determines that the gradation difference ΔDA is smaller than the threshold (S55: NO), 0 is set to the determination result Result, which is output to the timing control part 13 (S57). The determination part 12 thereafter returns the processing to step S51. If the detected change does not correspond to the predetermined change (S53: NO), the determination part 12 does not carry out detection of the gradation difference ΔDA, sets 0 to Result as the determination result of less than the threshold (S57), and returns the processing to step S51.

The change detected based on DA1 and DA2 corresponds to the rise time tr or the fall time tf, and the predetermined change corresponds to a shorter one thereof. To detect if the change corresponds to the predetermined change, corresponding bits of DA1 and DA2 are compared with one another.

For example, DB[0] illustrated in FIG. 7 according to Embodiment 1 shows a change in the fall from High to Low during the period of 1R to the period of 1L. The change in the fall for DB[0] may be detected from High which is set to DA1[0] in the corresponding period of 1R and from Low which is set to DA2[0] in the corresponding period of 1L.

Likewise, based on Low which is set to DA1[0] during the period of 2R and High which is set to DA2[0] during the period of 2L, such a change may be detected that DB[0] rises from Low to High during the period of 2R to the period of 2L.

As described above, in the case where the change detected from the corresponding bits for DA1 and DA2 does not match with the predetermined change, no determination is made as to whether or not the gradation difference ΔDA is equal to or larger than the threshold. As such, irrespective of the gradation difference ΔDA, whether or not the gradation difference ΔDA is equal to or larger than the threshold is determined if the result of less than the threshold, i.e. Result=0, is output and the detected change is the predetermined change. Thus, the timing control part 13 controls the presence/absence of a phase difference in a predetermined shorter one of the rise time tr and the fall time tf.

Figure 38A:
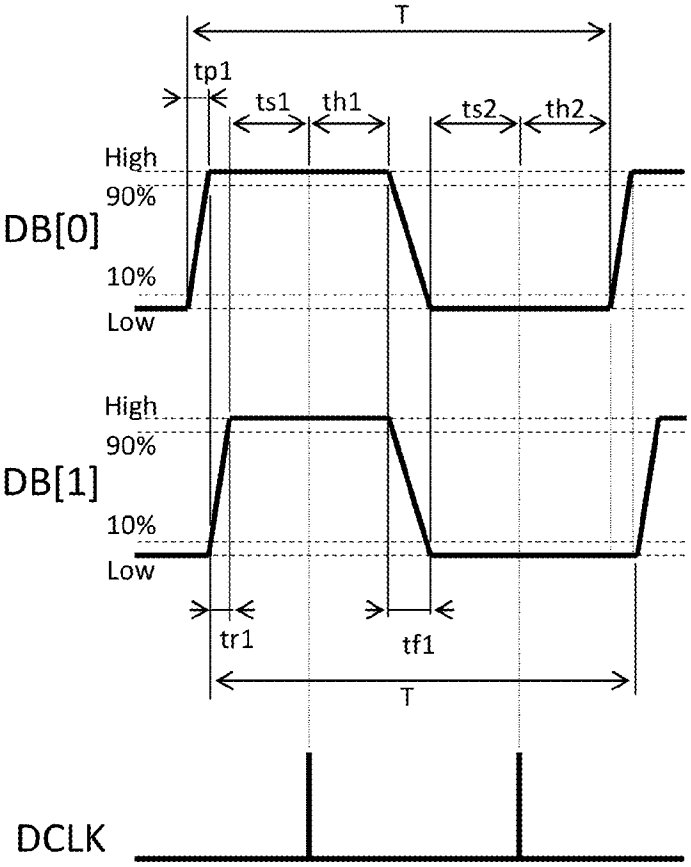
FIG. 38A illustrates an effect obtained in Embodiment 6.
Figure 38B:
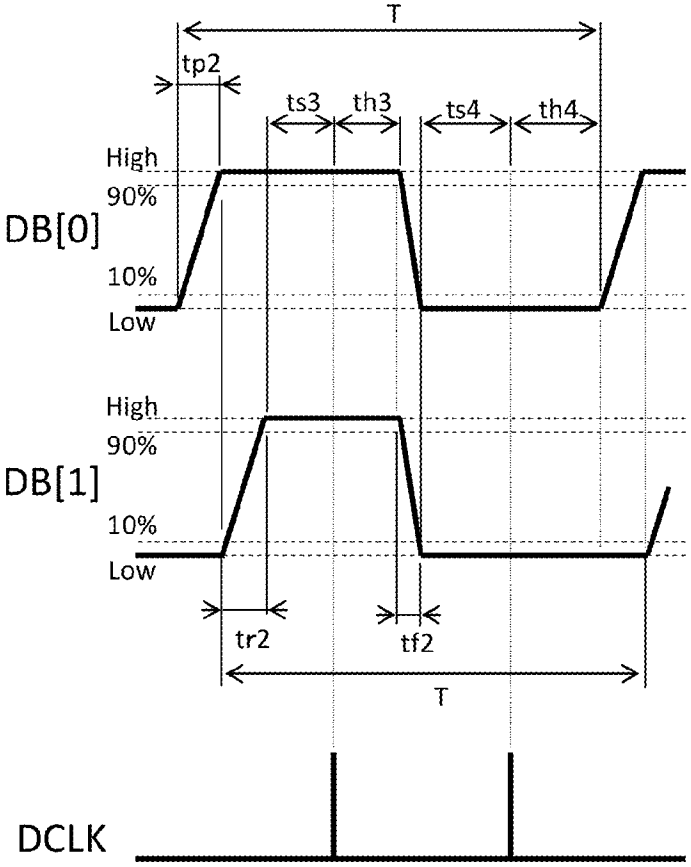
FIG. 38B illustrates an effect obtained in Embodiment 6.

The effect of Embodiment 6 will be described with reference to FIGS. 38A and 38B. In FIGS. 38A and 38B, DB[0] and DB[1] have phase differences that are different from each other, and the setup times are indicated as ts1, ts2, ts3 and ts4, whereas the hold times are indicated as th1, th2, th3 and th4 with respect to DCLK.

As for DBs indicated in FIG. 38A and FIG. 38B, the period representing the intermediate state corresponding to the addition of the rise time and the fall time (tr1+tf1=tr2+tf2) is the same as well as the cycle T. In FIG. 38A, under the condition of tr1:tf1=1:2, a phase difference tp1 having the same length of that of tr1 is provided, securing ts1, th1, ts2 and th2. Here, the setup time ts1 for tr1 with a phase difference may be reduced similarly to the reduction of the hold time th1 for tf1 without a phase difference. This can prevent the situation of biased frequencies of data errors caused by the margin not being secured in the setup time or hold time due to a ratio of the response time between tr1 and tf1. A similar effect may be obtained in the case of tr1<tf1/2.

In FIG. 38B, under the condition of tr2:tf2=2:1, a phase difference tp2 having the same length as that of tr2 is provided, securing ts3, th3, ts4 and th4.

Comparison for the secured setup time and the secured hold time shows that ts3 and th3 are shorter than ts1 and th1. Thus, depending on the setting for the phase difference, the setup time as well as hold time may be different. Though ts4 and th4 are secured for a longer period of time compared to ts3 and th3, phase adjustment may be required to conform to the short period of ts3 and th3 if the dot clock DCLK is a single clock with a constant cycle. It is therefore difficult to secure the margin in the setup time and the hold time.

As described above, in the case where a phase difference is provided, a shorter one of the rise time and fall time is set to half the longer one thereof or less, so that the distortion affecting GND is reduced while easily securing the margin in the setup and hold time. Moreover, shifting of a phase oscillates a signal in the time axis direction. The signal oscillation may appear on the display as noise. According to Embodiment 6, a phase shift is carried out at either one of the rise and fall, thereby facilitating phase adjustment of a clock for sampling signals which is performed to reduce noise on the display.

Figure 39A:
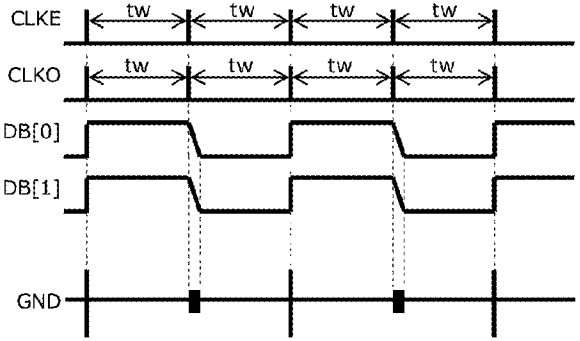
FIG. 39A illustrates the influence of distortion on GND according to Embodiment 6.
Figure 39B:
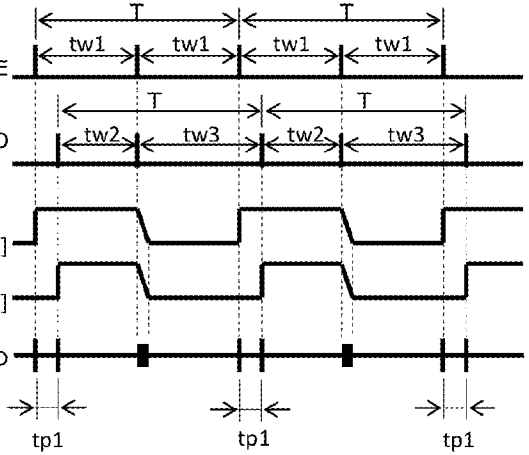
FIG. 39B illustrates the influence of distortion on GND according to Embodiment 6.
Figure 39C:
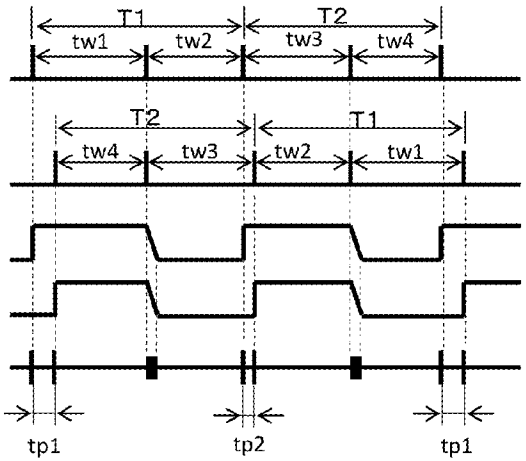
FIG. 39C illustrates the influence of distortion on GND according to Embodiment 6.

Furthermore, the variations in the pulse width and cycle in Embodiment 1 as described with reference to FIGS. 8A, 8B, and 8C may also be applied to Embodiment 6. FIGS. 39A, 39B and 39C illustrate the influence of distortion caused on GND. Since no phase difference is present in FIG. 39A, the spike-like noise generated on GND at the rise time has a large amplitude. Here, as illustrated in FIG. 39B, by varying the pulse width, the spike-like noise generated on GND is dispersed in the time axis direction with the phase difference tp, which suppresses the amplitude. Likewise, variation in cycle may also be applied as illustrated in FIG. 39C, in which, compared to the example illustrated in FIG. 39B, the frequency component constituting distortion caused on GND is switched on the continuous time axis. This can reduce the probability of being affected by an external noise other than DB.

It is noted that the amplitude of the spike-like noise generated on GND illustrated in FIGS. 39A, 39B and 39C is different between the timing for the rise time and the timing for the fall time. This is because the rise time and the fall time have different lengths, the fall time being longer than the rise time and thus has the spike-like noise extending in the time axis direction.

While Embodiment 6 of the present disclosure has been described, the configuration and operation of Embodiment 6 are the same as those in Embodiment 1 except for the differences described above, and thus the description thereof will not be repeated here.

Embodiment 7

In Embodiment 7, a high definition color display apparatus is employed in which unit pixels each constituted by different colors of subpixels are arranged in row and column directions on a display panel 2. According to Embodiment 7, a threshold for determining a phase difference or the presence/absence of variation in the pulse width or cycle is set based on whether or not the gradation values of subpixels that are adjacent to each other in the row or column direction are inverted from each other.

A unit pixel in a general color display panel is constituted by subpixels of RGB which are the three primary colors of light, which expresses a red display by turning on only the subpixel of R while turning off the subpixels of G and B. In the case of a white display, the subpixels of RGB are turned on, and RGB are mixed together to express white. As such, different multiple colors are expressed by combinations of subpixels of different colors. Moreover, the number of colors to be expressed may further be increased by controlling the luminance of subpixels. For example, in the case of including three subpixels of RGB, $2^3=8$ colors may be expressed. Furthermore, if the brightness is controlled in gradation of 256 levels for each subpixel of RGB, about 16,770,000($(2^3)^8$) colors may be expressed.

While Embodiment 1 uses, as a threshold, the gradation difference between adjacent subpixels for determination on a phase difference, Embodiment 7 uses, as a threshold, whether or not the gradation levels are inverted between adjacent subpixels.

Figure 40:
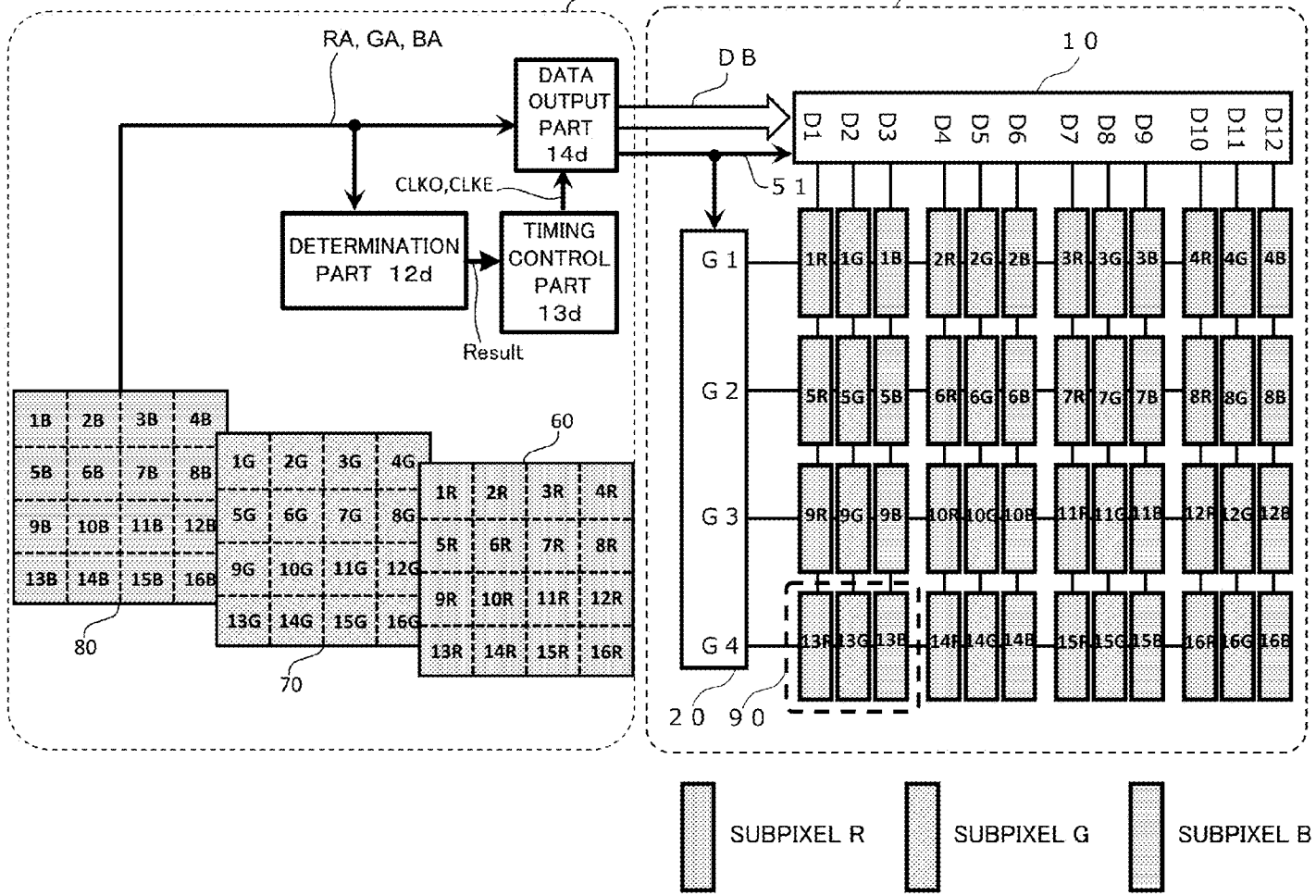
FIG. 40 is a block diagram illustrating the overall configuration of an example of non-limiting a display apparatus according to Embodiment 7.

FIG. 40 illustrates a schematic view of a display apparatus according to Embodiment 7. Embodiment 7 is different from the embodiments described above in the operation of the signal processing unit 1 because the display panel 2*d* and the input image data 60, 70 and 80 are configured differently.

In the display panel 2*d*, unit pixels 90 each constituted by subpixels R, G and B for each color are arranged in four rows and four columns, and display is realized without the intermediary of the lenticular lens 100.

Input image data includes three patterns of an R pattern 60 constituted by gradation values corresponding to the subpixels 1R to 16R in the display panel 2*d*, a G pattern 70 constituted by gradation values corresponding to the subpixels of 1G to 16G in the display panel 2*d*, and a B pattern 80 constituted by gradation values corresponding to the subpixels of 1B to 16B in the display panel 2*d*.

Signals input to the determination part 12*d* are: an image signal RA obtained by reading out gradation values corresponding to subpixels 1R to 16R in an orderly manner from the R pattern 60; and an image signal GA obtained by reading out gradation values corresponding to subpixels of 1G to 16G in an orderly manner from the G pattern 70. Furthermore, an image signal BA obtained by reading out gradation values corresponding to subpixels 1B to 16B in an orderly manner from the B pattern 80 is input to the determination part 12*d*.

Figure 41:
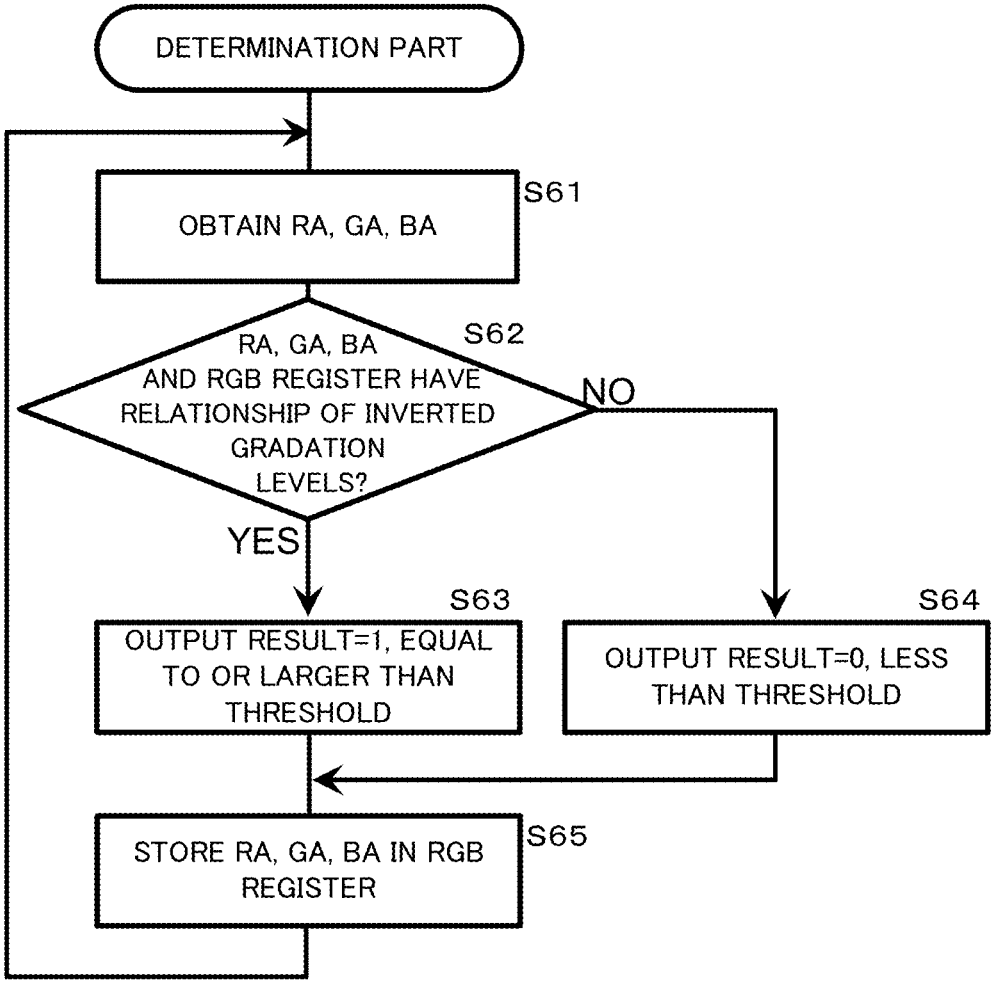
FIG. 41 is a flowchart illustrating the operation of a determination part according to Embodiment 7.

FIG. 41 is a flowchart illustrating the operation of the determination part 12*d*. The determination part 12*d* obtains RA which is an image signal of the R pattern 60, GA which is an image signal of the G pattern 70, and BA which is an image signal of the B pattern 80 (S61). Based on the obtained RA, GA, BA and an RGB resistor which will be described later, the determination part 12*d* determines, subsequently, whether or not corresponding gradation values in order of between the subpixels R and G, between the subpixels of G and B, and between the subpixels of B and R have the relationship of inverted gradation levels (S62).

The determination on the relationship of inverted gradation levels is made by determining whether or not an inverted gradation value obtained from the gradation value for one of adjacent subpixels is equal to the gradation value for the other one of the adjacent subpixels, based on the gradation values of the obtained three image signals RA, GA and BA as well as the RGB resistor. Here, the inverted gradation value is obtained by subtracting the actual gradation value from the maximum value to be taken by a gradation value.

An example of two-bit gradation indicates that the maximum value taken by a gradation value is $(11)_2$, which is 3. Here, the inverted gradation value of the gradation value 0 for one of the adjacent subpixels is represented by 3(=3-0). Here, if the gradation value for the other one of the adjacent subpixels is 3, it is determined as having the relationship of inverted gradation levels since it is equal to the inverted gradation value.

In general, digitized gradation values start from 0 and the maximum value taken by a gradation value is 3 in the case of the 2-bit gradation, 7 in the case of the 3-bit gradation and 255 in the case of 8-bit gradation, which are odd numbers. Thus, the determination as described above may be applicable.

It is to be noted that the above relationship is not satisfied when the maximum value taken by the gradation value is an even number, not corresponding to the values as described above. For example, if the maximum value taken by the gradation value is 4, the inverted gradation value for the gradation value 2 is 2(=4−2), which is a case where the obtained inverted gradation value is not inverted.

Moreover, the RGB resistor is a resistor for temporarily storing a gradation value, which holds the gradation value unless overwritten, and can read the gradation values individually from RA, GA and BA and write the gradation values.

As a result of determination, if the relationship corresponds to inverted gradation levels (S62: YES), the determination part 12*d* sets 1 to the determination result Result and outputs Result to the timing control part 13*d* (S63). If otherwise (S62: NO), the determination part 12*d* sets 0 to the determination result Result and outputs Result to the timing control part 13*d* (S64). After the output, the determination part 12*d* stores RA, GA and BA in the RGB resistor (S65), and returns the processing to step S61. The RGB resistor in which RA, GA and BA are stored is used for determination on whether or not the subsequently obtained RA, GA and BA have the relationship of inverted gradation levels. Note that the cycle for determination conforms to the cycle of DB.

Figure 42:
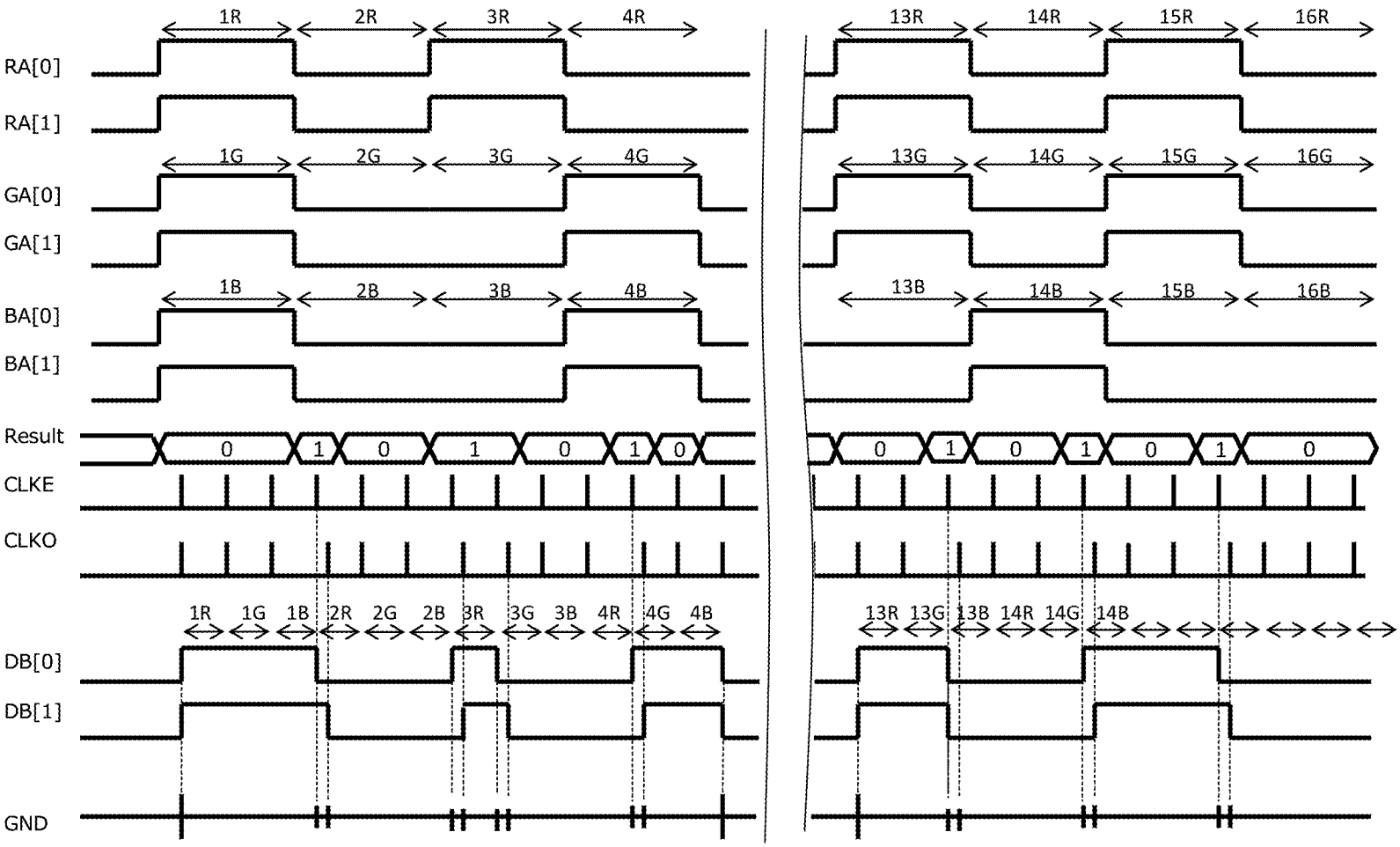
FIG. 42 is a timing chart illustrating the operation of a signal processing unit according to Embodiment 7.

FIG. 42 is a timing chart illustrating an operation example of the signal processing unit 1 including the determination part 12*d*. Image signals RA[0]-[1], GA[0]-[1] and BA[0]-[1] input to the determination part 12*d* as well as DB[0]-[1] output from the data output part 14*d* to the display panel 2*d* indicate four gradation values of 0 to 3 by digital signals of two bits of $(00)_0$ to $(11)_2$, with the High level being $(1)_2$ and the Low level being $(0)_2$. Moreover, the gradation value of $(00)_2$ is set as black whereas $(11)_2$ is set as white. Result indicates a determination result of the determination part 12*d*, taking the value of 1 or 0.

In FIG. 42, 1R-4R, 13R-16R, 1G-4G, 13G-16G, 1B-4B and 13B-16B (5R-12R, 5G-12G and 5B-12B are not illustrated for simplification) indicate the correspondence with the subpixels in the display panel 2*d*.

First, determination on gradation inversion is made between 1R and 1G. As illustrated in FIG. 42, since the gradation value of 1R is $(11)_2$ and the gradation value of 1G is $(11)_2$, not showing the relationship of inverted gradation levels, the determination part 12*d* sets 0 to the determination result Result. Likewise, since 1G and 1B do not have the relationship of inverted gradation levels, the determination part 12*d* sets 0 to the determination result Result.

Next, since 1B has the gradation value $(11)_2$ whereas 2R has the gradation value $(00)_2$, showing the relationship of inverted gradation levels, the determination part 12*d* sets 1 to the determination result Result.

Next, since 2R has the gradation value $(00)_2$ whereas 2G and 2B each has the gradation value of $(00)_2$, not showing the relationship of inverted gradation levels continuously, the determination part 12*d* sets 0 to the determination result Result.

Next, since 2B has the gradation value of $(00)_2$ whereas 3R has the gradation value of $(11)_2$, and 3G has the gradation value of $(00)_2$, showing the relationship of inverted gradation levels continuously, the determination part 12*d* sets 1 to the determination result Result.

Subsequently, sequential determinations are made as to whether or not the corresponding gradation values have inverted gradation levels in order of between the subpixels R and G, between G and B, and between B and R. The determination results Result are then output to the timing control part 13*d*.

The timing control part 13*d* outputs CLKE and CLKO with a phase difference to the data output part 14*d* during the period in which Result is 1. Further, the cycle of each of CLKE and CLKO corresponds to a third of the cycle of each of RA, GA and BA.

The data output part 14*d*, as in Embodiment 1, using CLKE and CLKO output from the timing control part 13*d*, sequentially latches RA, GA and BA to DB[0]-DB[1] in the time axis direction, and outputs the latched DB to the display panel 2*d*.

In the example above, DB is latched using CLKE and CLKO with the phase difference controlled by the determination part 12*d*. Accordingly, in the case where adjacent subpixels have the relationship of inverted gradation levels, the corresponding DB[0]-[1] may be provided with phase shift processing so as not to be logically inverted at the same time, which can disperse the influence of distortion on GND in the time axis direction.

While the determination part 12*d* according to Embodiment 7 performs determination between subpixels, such as between 1R and 1G, determination before 1R or after 16B may additionally be performed. Since no subpixel is present before 1R or after 16B in practice, such determination cannot be used to determine the relationship of inverted gradation levels on the display. It may, however, address the occurrence of noise due to simultaneous switching on the periphery of the display by determining whether or not logical inversion is performed for all bits of digital signals.

Each of image signals RA, GA, BA and DB corresponding to RGB subpixels is described as a digital signal composed of two bits for the sake of convenience, which however is not intended to limit the number of bits of a digital signal.

While the display panel 2*d* used in the display apparatus according to Embodiment 7 of the present disclosure was described with the subpixels of RGB, the subpixels constituting the display apparatus of the present disclosure are not limited thereto. Furthermore, though unit pixels constituted by the subpixels of RGB are arranged in a matrix of four rows and four columns, this arrangement is for merely simplifying the illustration and will not limit in any way the number of pixels.

Moreover, the determination part 12*d* according to Embodiment 7 determines the presence/absence of a phase difference based on whether or not adjacent subpixels have the relationship of inverted gradation levels, which will not limit the present disclosure. For example, elements described in Embodiments 1 to 5 may also be combined with one another. For example, as in Embodiment 1, the determination part 12*d* may make a determination by using a gradation difference between adjacent subpixels as a threshold.

Moreover, as described in Embodiment 2, by determining whether or not the region with the inverted gradation levels is equal to or larger than a predetermined number of unit pixels, the appearance rate of the phase shift processing may be suppressed to some extent. Thus, a data error, which has an increased risk of occurrence thereof in the case of a higher drive frequency of the display apparatus may be reduced.

Moreover, while the timing control part 13*d* according to Embodiment 7 performs processing of varying the phase between CLKE and CLKO if the determination result Result is 1, the present disclosure is not limited to the variation in the phase. As described with reference to FIGS. 8C and 8D according to Embodiment 1, variation in the pulse width (see FIG. 8C) and variation in the cycle (see FIG. 8D) may be combined with the difference in the phase. By combining them with the phase difference, the frequency components constituting noise may be more dispersed, which can further disperse the distortion affecting GND in the time axis direction.

In addition, the data output part 14*d* may be constituted by two or more clock lines. This may produce an effect similar to that in Embodiment 4 (description with reference to FIG. 32B).

As to the operation in Embodiment 7 described above, the following description may also be applied.

In the case where certain image data is used, if the gradation difference between adjacent subpixels is large enough to exceed the threshold, the determination result Result of 1 is obtained as described above, and the coupled image signal DB is output while ensuring the rise or fall of the bit signals of DB not to be synchronized.

For the image data described above, the difference in the maximum gradation values within the image signals is modulated in advance to the threshold or smaller, so that the determination result Result of 0 is obtained and the coupled image signal DB may be output while ensuring the rise and fall of the bit signals of DB to be synchronized with one another.

As such, even if the same image data is used, by controlling only the maximum gradation difference within an image in advance, control for synchronization or non-synchronization may be possible for the rise and fall of bit signals of the coupled image signal DB.

Embodiment 8

While Embodiment 7 uses, as a threshold, whether or not the gradation levels are inverted between adjacent subpixels in the determination on a phase difference, Embodiment 8 uses, as a threshold, whether or not the gradation levels are inverted between adjacent unit pixels.

Figure 43:
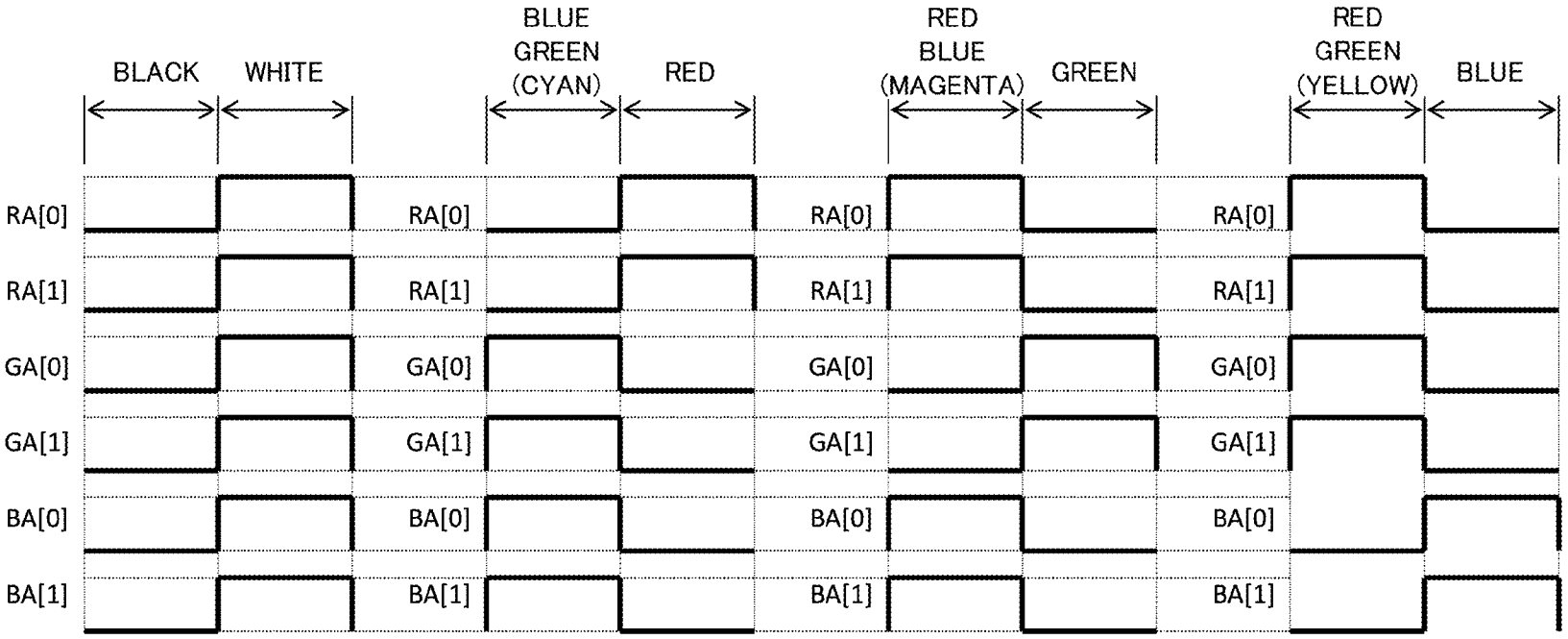
FIG. 43 illustrates complementary colors and inversion of gradation levels according to Embodiment 8.

FIG. 43 illustrates digital signals of gradation levels in a unit pixel of a color display panel constituted by general RGB subpixels. RA[0] and RA[1] are digital signals indicating the gradation levels of R subpixels, GA[0] and GA[1] are digital signals indicating the gradation levels of G subpixels, and BA[0] and BA[1] are digital signals indicating the gradation levels of B subpixels. As illustrated, inversion in gradation levels includes, in addition to "black and white" in which all the RGB subpixels are turned off or on, combinations of subpixels. The combinations include, for example, "blue green (cyan) and red" where only the R subpixels are turned off or on, "red blue (magenta) and green" where only the G subpixels are turned off or on, and "red green (yellow) and blue" where only the B subpixels are turned off or on, each of the described combination of colors having the relationship of complementary colors.

Embodiment 8 has the same configuration as that illustrated in FIG. 40 according to Embodiment 7, except for the operation of the determination part 12*d* which performs determination on a phase difference using, as a threshold, whether or not adjacent unit pixels have the relationship of inverted gradation levels while including the relationship of the complementary colors as described above.

Figure 44:
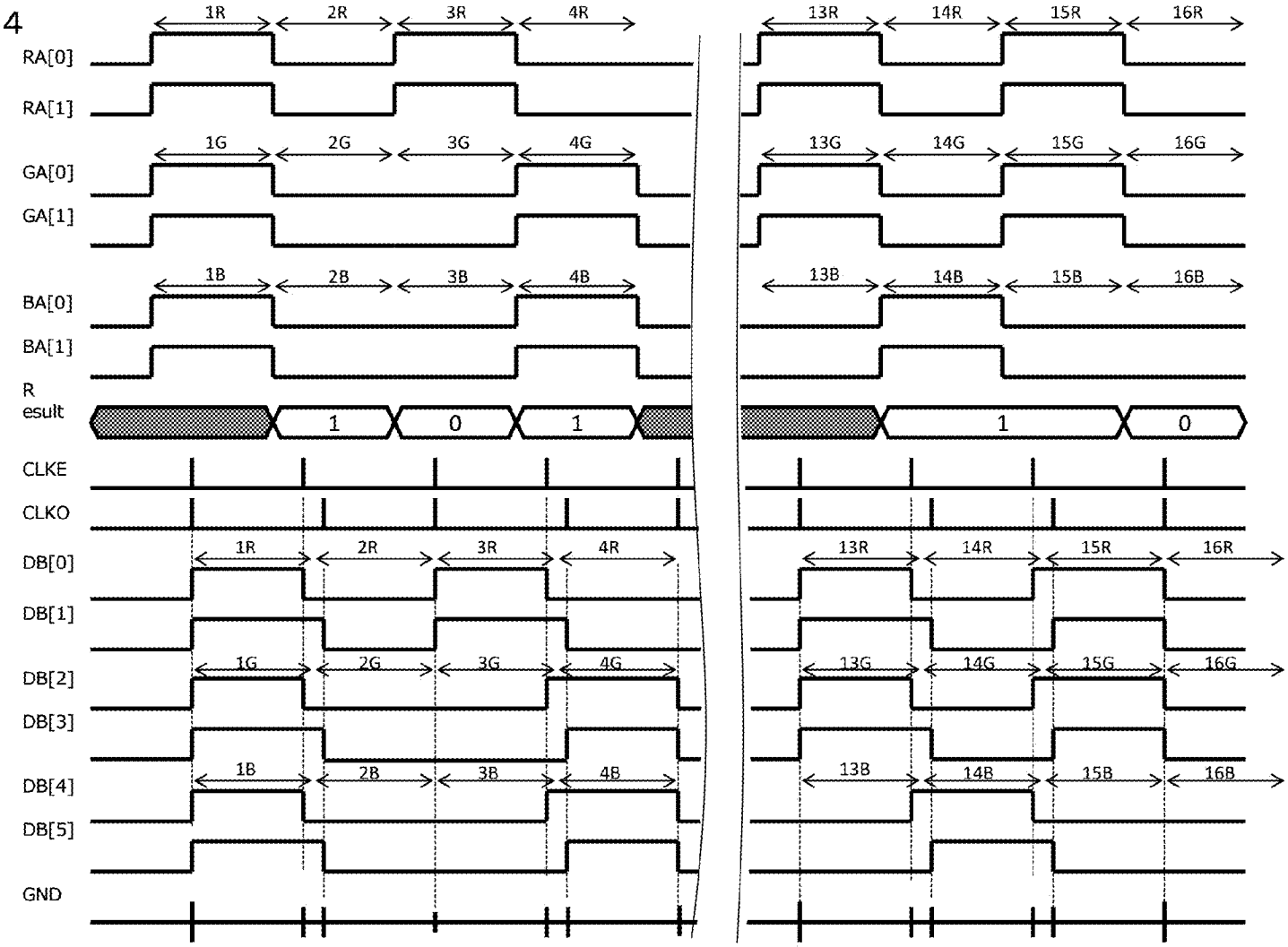
FIG. 44 is a timing chart illustrating the operation of a signal processing unit according to Embodiment 8.

FIG. 44 is a timing chart illustrating an operation example of the signal processing unit 1 including the determination part 12*d*. Whether or not adjacent unit pixels have the relationship of inverted gradation levels may be determined based on whether or not all the subpixels of the same color constituting the adjacent unit pixels have the relationship of inverted gradation levels.

In FIG. 44, 1R has the gradation value of $(11)_2$ whereas 2R has the gradation value of $(00)_2$, indicating that the gradation values are inverted between 1R and 2R. Likewise, the gradation values are inverted from $(11)_2$ to $(00)_2$ between 1G and 2G, and between 1B and 2B. Moreover, the display of unit pixels has the relationship of inverted gradation levels such as "white and black." Accordingly, the determination part 12*d* sets 1 to the determination result Result.

Next, 2R has the gradation value $(00)_2$ whereas 3R has the gradation value $(11)_2$, indicating that the gradation values are inverted between 2R and 3R. However, the gradation values are not changed from $(00)_2$ between 2G and 3G, and between 2B and 3B. Moreover, the unit pixels are not displayed with the relationship of inverted gradation levels, such as "black and red." Accordingly, the determination part 12*d* sets 0 to the determination result Result. Subsequently, sequential determinations are made as to whether or not the unit pixels have the relationship of inverted gradation levels, and the determination results Result are then output to the timing control unit 13*d*.

In the signal processing unit 1 according to Embodiment 7, the cycle of CLKE and CLKO is one third of the cycle of RA, GA or BA, and RA, GA and BA are latched to DB using CLKE and CLKO sequentially in the time axis direction. In Embodiment 8, with the use of CLKE and CLKO having the same cycle as that of RA, GA or BA, the number of bits of DB is extended compared to Embodiment 7 and RA, GA and BA are latched in parallel.

As DB is extended to 6 bits, RA[0]-RA[1] are coupled to DB[0]-DB[1], GA[0]-GA[1] are coupled to DB[2]-DB[3], and BA[0]-BA[1] are coupled to DB[4]-DB[5], and therefore the frequency may be reduced to one third of the frequency of DB in FIG. 42. This can further disperse the influence of distortion on GND in the time axis direction.

The configuration and operation of Embodiment 8 are the same as those in Embodiment 7 except for the differences described above, and thus the description thereof will not be repeated here.

Each of image signals RA, GA, BA and DB corresponding to RGB subpixels is described as a digital signal composed of two bits for the sake of convenience, which however will not limit the number of bits of a digital signal.

While the display panel 2*d* used in the display apparatus according to Embodiment 8 of the present disclosure was described with the subpixels of RGB as in Embodiment 7, the subpixels constituting the display apparatus of the present disclosure are not limited thereto. Furthermore, though unit pixels constituted by the subpixels of RGB are arranged in a matrix of four rows and four columns, this arrangement will not limit in any way the number of pixels.

Moreover, the determination part 12*d* according to Embodiment 8 determines the presence/absence of a phase difference based on whether or not adjacent unit pixels have the relationship of inverted gradation levels, which will not limit the present disclosure. For example, elements described in Embodiments 1 to 7 may also be combined with one another. For example, as in Embodiment 1, the determination part 12*d* may make a determination by using a gradation difference between adjacent subpixels as a threshold.

Moreover, as described in Embodiment 2, by determining whether or not the region with the inverted gradation levels corresponds to a predetermined or larger number of unit pixels, the appearance rate of the phase shift processing may be suppressed to some extent. Thus, a data error, which has an increased risk of occurrence thereof in the case of an increased drive frequency of the display apparatus, may be reduced.

Furthermore, while the timing control part 13*d* according to Embodiment 8 performs processing of varying the phase between CLKE and CLKO if the determination result Result is 1, the present disclosure is not limited to the variation in the phase. As described with reference to FIGS. 8C and 8D according to Embodiment 1, variation in the pulse width (see FIG. 8C) and variation in the cycle (see FIG. 8D) may be combined with the difference in the phase. By combining both or either of them with the phase difference, the frequency components constituting noise may be more dispersed, which can further disperse the influence on the distortion exerting on GND in the time axis direction.

As to the operation in Embodiment 8 described above, the following description may also be applied.

In the case where certain image data is used, if the gradation difference between adjacent unit pixels is large enough to exceed the threshold, the determination result Result of 1 is obtained as described above, and the coupled image signal DB is output while ensuring the rise or fall of the bit signals of DB not to be synchronized.

For the image data described above, the difference in the maximum gradation values within the image signals is modulated in advance to the threshold or less, so that the determination result Result of 0 is obtained and the coupled image signal DB may be output while ensuring the rise and fall of the bit signals of DB to be synchronized with one another.

As such, even if the same image data is used, by controlling only the difference between the maximum gradation values within an image in advance, control for synchronization or non-synchronization may be possible for the rise and fall of bit signals of the coupled image signal DB.

It is to be noted that each of Embodiments 2 to 6 may also have a practical pixel layout in which a unit pixel has a trapezoidal-shaped aperture as in Examples 2 or 3.

As described above, by the use of the method of transmitting display data from a signal processing unit to a display panel in the display apparatus according to the present disclosure, even if the drive frequency of the display apparatus is increased, the timings of fall and rise between data outputs are shifted, thereby dispersing the distortion affecting the GND in the time axis direction. This produces an effect of suppressing a drive load as well as a noise affecting the display quality.

While the present disclosure has been described above according to Embodiments 1 to 8, it is not limited to the embodiments described above. Various modifications that can be understood by a person with ordinary skills in the art may also be added to the configuration and details of the present disclosure. The present disclosure also encompasses an appropriate combination of a part or whole of the configurations in different embodiments.

What is claimed is:

1. A display apparatus comprising:

a display panel in which unit pixels each constituted by at least a first subpixel displaying a first pattern and a second subpixel displaying a second pattern are alternately arranged in a row or column direction; and a signal processor configured to:

modulate, for image data including the first pattern and image data including the second pattern, a difference in maximum gradation values in the image data, and control synchronization or non-synchronization of a rise or fall between bit signals of a coupled image signal input to the display panel;

detect a gradation difference between a first image signal input to a subpixel and a second image signal input to a subpixel adjacent to said subpixel, and determine whether or not the gradation difference is equal to or larger than a preset threshold;

generate two or more data coupling clock signals having a same cycle, phase and pulse width, output the two or more data coupling clock signals as they are if determined that the gradation difference is smaller than the threshold, and control at least one of the cycle, phase or pulse width so that a rise or fall is not synchronized between the two or more data coupling clock signals to output the two or more data coupling clock signals if determined that the gradation difference is equal to or larger than the threshold; and output a coupled image signal obtained by coupling the first image signal with the second image signal using the two or more data coupling clock signals, to the display panel.

2. A display apparatus comprising:

a display panel in which unit pixels each constituted by at least a first subpixel displaying a first pattern and a second subpixel displaying a second pattern are alternately arranged in a row or column direction; and a signal processor configured to:

modulate, for image data including the first pattern and image data including the second pattern, a difference in maximum gradation values in the image data, and control synchronization or non-synchronization of a rise or fall between bit signals of a coupled image signal input to the display panel;

detect, for each unit pixel, a gradation difference between a first image signal input to the first subpixel and a second image signal input to the second subpixel, and determine whether or not the gradation difference is equal to or larger than a preset threshold;

generate two or more data coupling clock signals having a same cycle, phase and pulse width, output the two or more data coupling clock signals as they are if determined that the gradation difference is smaller than the threshold, and control at least one of the cycle, phase or pulse width so that a rise or fall is not synchronized between the two or more data coupling clock signals to output the two or more data coupling clock signals if determined that the gradation difference is equal to or larger than the threshold; and output a coupled image signal obtained by coupling the first image signal with the second image signal using the two or more data coupling clock signals, to the display panel.

3. The display apparatus according to claim 1, wherein the signal processor is further configured to determine, after determining that the gradation difference is equal to or larger than the preset threshold, whether or not a region having the gradation difference is equal to or larger than a predetermined number of subpixels preset in accordance with the gradation difference.

4. The display apparatus according to claim 1, further comprising a stereovision selector configured to select whether or not an observer is to view a stereoscopic image, wherein the stereovision selector is further configured to output a stereovision selecting signal in accordance with the selection.

5. The display apparatus according to claim 4, further comprising a stereovision switch configured to output the first image signal and the second image signal to the determination part in a form of having parallax between the first and second image signals if the selection is made to view the stereoscopic image by the stereovision selector, and output the first image signal and the second image signal to the determination part in a form of not having parallax between the first and second image signals if the selection is made not to view the stereoscopic image by the stereovision selector.

6. The display apparatus according to claim 1, wherein the signal processor is further configured to output one coupled image signal based on two or more dot clock signals.

7. The display apparatus according to claim 1, wherein the signal processor is further configured to output two or more coupled image signals based on two or more dot clock signals, respectively.

8. The display apparatus according to claim 1, wherein the signal processor is further configured to vary a frequency of a coupled image signal.

9. The display apparatus according to claim 1, wherein the signal processor is further configured to:

detect a change in a rise or fall of the coupled image signal based on the two or more data coupling clock signals, and determine whether or not the detected change corresponds to either one of the rise and fall which has a shorter response time, and output the two or more data coupling clock signals based on the determination.

10. The display apparatus according to claim 1, wherein the signal processor is further configured to control, if determined that the gradation difference is equal to or larger than the threshold, at least one of the cycle, phase and pulse width so that either one of the rise and fall which has a shorter response time is not synchronized between the two or more data coupling clock signals, and output the two or more data coupling clock signals.

11. The display apparatus according to claim 9, wherein the shorter response time is equal to or less than a half of a response time for the other one of the rise and fall in data output part.

12. The display apparatus according to claim 1, wherein the display apparatus includes gate lines arranged in parallel with one another in a column direction, subpixels adjacent to each other in a row direction are alternately connected to adjacent gate lines, and subpixels adjacent to each other in a column direction are connected to a same gate line at every two columns.

13. The display apparatus according to claim 1, wherein the display apparatus includes gate lines arranged in parallel with one another in a row direction, subpixels adjacent to each other in a column direction are alternately connected to adjacent gate lines, and subpixels adjacent to each other in a row direction are connected to a same gate line at every two rows.

14. A method of processing an image signal input to a display panel in which unit pixels each constituted by a first subpixel displaying a first pattern and a second subpixel displaying a second pattern are alternately arranged in a row or column direction, comprising:

obtaining a first image signal input to the first subpixel and a second image signal input to the second subpixel;

detecting a gradation difference between the first image signal and the second image signal for each unit pixel;

determining whether or not the gradation difference is equal to or larger than a threshold;

outputting two or more clock signals with a same cycle, a same phase and a same pulse width generated for coupling the first image signal with the second image signal in synchronization with one another, if determined that the gradation difference is smaller than the threshold; and controlling at least one of the cycle, phase or pulse width so that the two or more clock signals are not synchronized with one another to output the two or more clock signals, if determined that the gradation difference is equal to or larger than the threshold.

15. A display apparatus, comprising:

a display panel in which unit pixels each constituted by at least a first subpixel displaying a first pattern and a second subpixel displaying a second pattern are alternately arranged in a row or column direction; and a signal processor configured to:

control, for image data including the first pattern and image data including the second pattern, synchronization or non-synchronization of a rise or fall between bit signals of a coupled image signal input to the display panel;

detect a gradation difference between a first image signal input to a subpixel and a second image signal input to a subpixel adjacent to said subpixel, and determine whether or not the gradation difference is equal to or larger than a preset threshold;

generate two or more data coupling clock signals having a same cycle, phase and pulse width, output the two or more data coupling clock signals as they are if determined that the gradation difference is smaller than the threshold, and control at least one of the cycle, phase or pulse width so that a rise or fall is not synchronized between the two or more data coupling clock signals to output the two or more data coupling clock signals if determined that the gradation difference is equal to or larger than the threshold; and output a coupled image signal obtained by coupling the first image signal with the second image signal using the two or more data coupling clock signals, to the display panel.

16. A display apparatus, comprising:

a display panel in which unit pixels each constituted by at least a first subpixel displaying a first pattern and a second subpixel displaying a second pattern are alternately arranged in a row or column direction; and a signal processor configured to:

control, for image data including the first pattern and image data including the second pattern, synchronization or non-synchronization of a rise or fall between bit signals of a coupled image signal input to the display panel;

detect, for each unit pixel, a gradation difference between a first image signal input to the first subpixel and a second image signal input to the second subpixel, and determine whether or not the gradation difference is equal to or larger than a preset threshold;

generate two or more data coupling clock signals having a same cycle, phase and pulse width, output the two or more data coupling clock signals as they are if determined that the gradation difference is smaller than the threshold, and control at least one of the cycle, phase or pulse width so that a rise or fall is not synchronized between the two or more data coupling clock signals to output the two or more data coupling clock signals if determined that the gradation difference is equal to or larger than the threshold; and output a coupled image signal obtained by coupling the first image signal with the second image signal using the two or more data coupling clock signals, to the display panel.

* * * * *